US007209878B2

(12) United States Patent
Chen

(10) Patent No.: US 7,209,878 B2
(45) **Date of Patent: *Apr. 24, 2007**

(54) NOISE FEEDBACK CODING METHOD AND SYSTEM FOR EFFICIENTLY SEARCHING VECTOR QUANTIZATION CODEVECTORS USED FOR CODING A SPEECH SIGNAL

(75) Inventor: Juin-Hwey Chen, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 590 days.

This patent is subject to a terminal disclaimer.

(21) Appl. No.: 09/832,132

(22) Filed: Apr. 11, 2001

(65) Prior Publication Data

US 2002/0072904 A1 Jun. 13, 2002

Related U.S. Application Data

(63) Continuation-in-part of application No. 09/722,077, filed on Nov. 27, 2000.

(60) Provisional application No. 60/242,700, filed on Oct. 25, 2000.

(51) Int. Cl.
*G10L 19/00* (2006.01)
*G10L 19/04* (2006.01)
*G10L 21/02* (2006.01)

(52) U.S. Cl. ..... 704/220; 704/219; 704/222; 704/226

(58) Field of Classification Search ..... 704/219–220, 704/224–226, 201, 222; 381/94.1
See application file for complete search history.

(56) References Cited

U.S. PATENT DOCUMENTS 2,927,962 A 3/1960 Cutler ..... 178/43.5
4,220,819 A 9/1980 Atal ..... 179/1
4,317,208 A 2/1982 Araseki et al. ..... 375/27
4,776,015 A 10/1988 Takeda et al. ..... 381/41
4,791,654 A 12/1988 De Marca et al. ..... 375/122
4,811,396 A 3/1989 Yatsuzuka ..... 381/30
4,860,355 A 8/1989 Copperi ..... 381/36
4,896,361 A 1/1990 Gerson ..... 381/40

(Continued)

FOREIGN PATENT DOCUMENTS

EP 0 573 216 A2 12/1993

OTHER PUBLICATIONS

E.G. Kimme and F.F. Kuo, "Synthesis of Optimal Filters for a Feedback Quantization System*," IEEE Transactions on Circuit Theory, The Institute of Electrical and Electronics Engineers, Inc., vol. CT-10, No. 3, Sep. 1963, pp. 405-413.

(Continued)

*Primary Examiner*—David Hudspeth
*Assistant Examiner*—James S. Wozniak
(74) *Attorney, Agent, or Firm*—Sterne, Kessler, Goldstein & Fox P.L.L.C.

(57) ABSTRACT

A system for performing a computationally efficient method of searching through N Vector Quantization (VQ) codevectors for a preferred one of the N VQ codevectors predicts a speech signal to derive a residual signal, derives a ZERO-INPUT response error vector common to each of the N VQ codevectors, derives N ZERO-STATE response error vectors each based on a corresponding one of the N VQ codevectors, and selects the preferred one of the N VQ codevectors based on the N ZERO-STATE response error vectors and the ZERO-INPUT response error vector.

38 Claims, 34 Drawing Sheets

The portion of the codec structure that is used in prediction residual VQ codebook search of the two-stage noise feedback codec of Fig. 5.

U.S. PATENT DOCUMENTS

| | | | | | |
|---|---|---|---|---|---|
| 4,918,729 | A | | 4/1990 | Kudoh | 381/36 |
| 4,963,034 | A | * | 10/1990 | Cuperman et al. | 704/222 |
| 4,969,192 | A | * | 11/1990 | Chen et al. | 704/222 |
| 5,007,092 | A | | 4/1991 | Galand et al. | 381/36 |
| 5,060,269 | A | | 10/1991 | Zinser | 381/38 |
| 5,195,168 | A | | 3/1993 | Yong | |
| 5,204,677 | A | | 4/1993 | Akagiri et al. | 341/118 |
| 5,206,884 | A | | 4/1993 | Bhaskar | |
| 5,313,554 | A | | 5/1994 | Ketchum | 395/2.28 |
| 5,414,796 | A | * | 5/1995 | Jacobs et al. | 704/221 |
| 5,432,883 | A | * | 7/1995 | Yoshihara | 704/219 |
| 5,475,712 | A | * | 12/1995 | Sasaki | 704/219 |
| 5,487,086 | A | | 1/1996 | Bhaskar | 375/243 |
| 5,493,296 | A | * | 2/1996 | Sugihara | 341/76 |
| 5,651,091 | A | | 7/1997 | Chen | |
| 5,675,702 | A | * | 10/1997 | Gerson et al. | 704/223 |
| 5,710,863 | A | | 1/1998 | Chen | |
| 5,734,789 | A | * | 3/1998 | Swaminathan et al. | 704/206 |
| 5,745,871 | A | | 4/1998 | Chen | |
| 5,790,759 | A | | 8/1998 | Chen | |
| 5,826,224 | A | * | 10/1998 | Gerson et al. | 704/222 |
| 5,828,996 | A | * | 10/1998 | Iijima et al. | 704/220 |
| 5,873,056 | A | | 2/1999 | Liddy et al. | |
| 6,014,618 | A | | 1/2000 | Patel et al. | 704/207 |
| 6,055,496 | A | | 4/2000 | Heidari et al. | 704/222 |
| 6,104,992 | A | * | 8/2000 | Gao et al. | 704/220 |
| 6,131,083 | A | | 10/2000 | Miseki et al. | 704/217 |
| 6,249,758 | B1 | * | 6/2001 | Mermelstein | 704/220 |

OTHER PUBLICATIONS

John Makhoul and Michael Berouti, "Adaptive Noise Spectral Shaping and Entropy Coding in Predictive Coding of Speech," IEEE Transactions on Acoustics, Speech, and Signal Processing, IEEE, vol. ASSP-27, No. 1, Feb. 1979, pp. 63-73.

Bishnu S. Atal and Manfred R. Schroeder, "Predictive Coding of Speech Signals and Subjective Error Criteria," IEEE Transactions on Acoustics, Speech, and Signal Processing, IEEE, vol. ASSP-27, No. 3, Jun. 1979, pp. 247-254.

Ira A. Gerson and Mark A. Jasiuk, "Techniques for Improving the Performance of CELP-Type Speech Coders," IEEE Journal on Selected Areas in Communications, IEEE, vol. 10, No. 5, Jun. 1992, pp. 858-865.

Cheng-Chieh Lee, "An Enhanced ADPCM Coder for Voice Over Packet Networks," International Journal of Speech Technology, Kluwer Academic Publishers, 1999, pp. 343-357.

Marcellin, M.W. and Fischer, T.R., "A Trellis-Searched 16 KBIT/SEC Speech Coder with Low-Delay," *Proceedings of the Workshop on Speech Coding for Telecommunications*, Kluwer Publishers, 1989, pp. 47-56.

Watts, L. and Cuperman, V., "A Vector ADPCM Analysis-By-Synthesis Configuration for 16 kbit/s Speech Coding," *Proceedings of the Global Telecommunications Conference and Exhibition* (*Globecom*), IEEE, 1988, pp. 275-279.

International Search Report issued May 3, 2002 for Appln. No. PCT/US01/42786, 6 pages.

Hayashi, S. et al., "Low Bit-Rate CELP Speech Coder with Low Delay," *Signal Processing*, Elsevier Science B.V., vol. 72, 1999, pp. 97-105.

Tokuda, K. et al., "Speech Coding Based on Adaptive Mel-Cepstral Analysis," IEEE, 1994, pp. I-197-I-200.

International Search Report issued Sep. 11, 2002 for Appln. No. PCT/US01/42787, 6 pages.

* cited by examiner

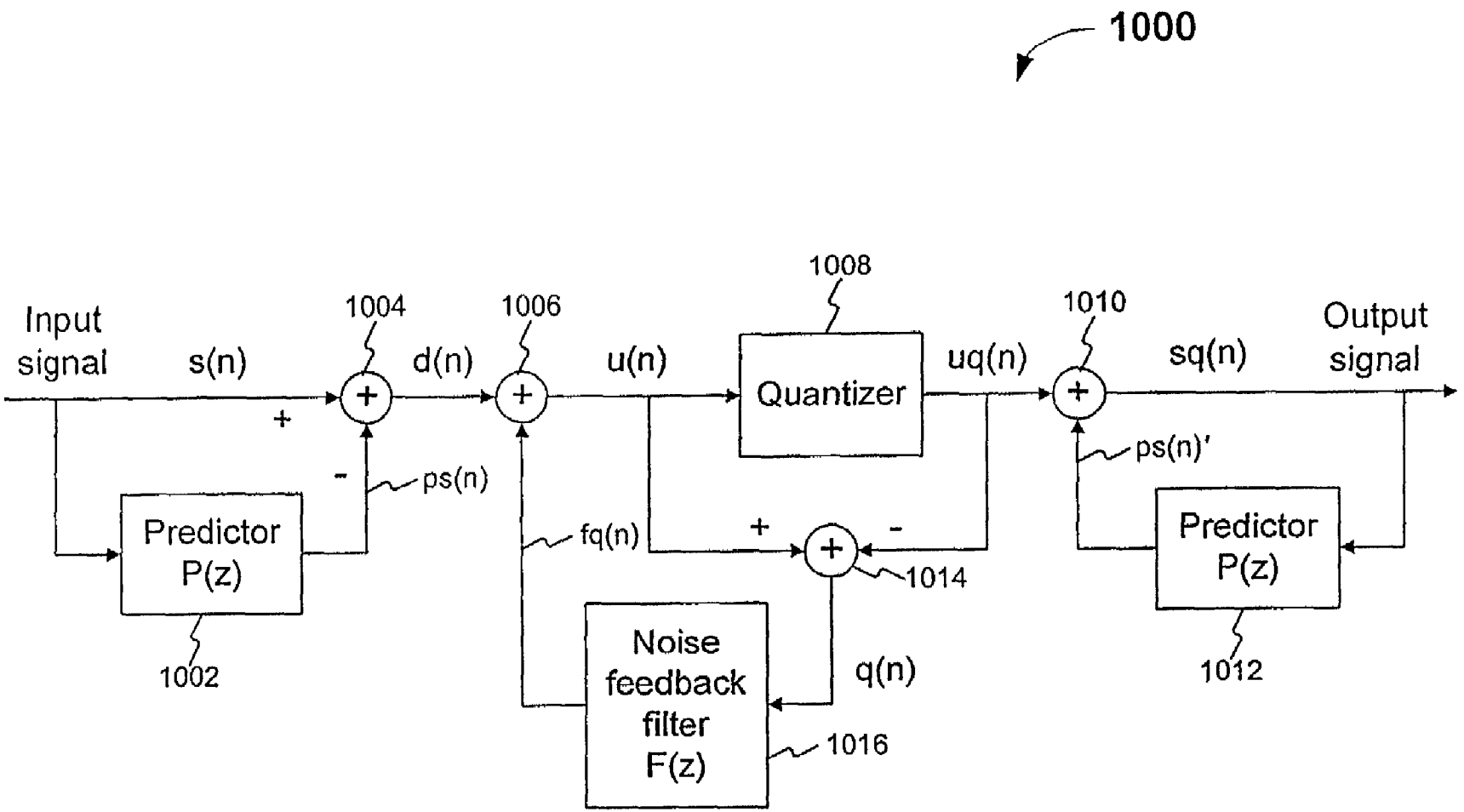
Figure 1 Conventional Noise Feedback Coding

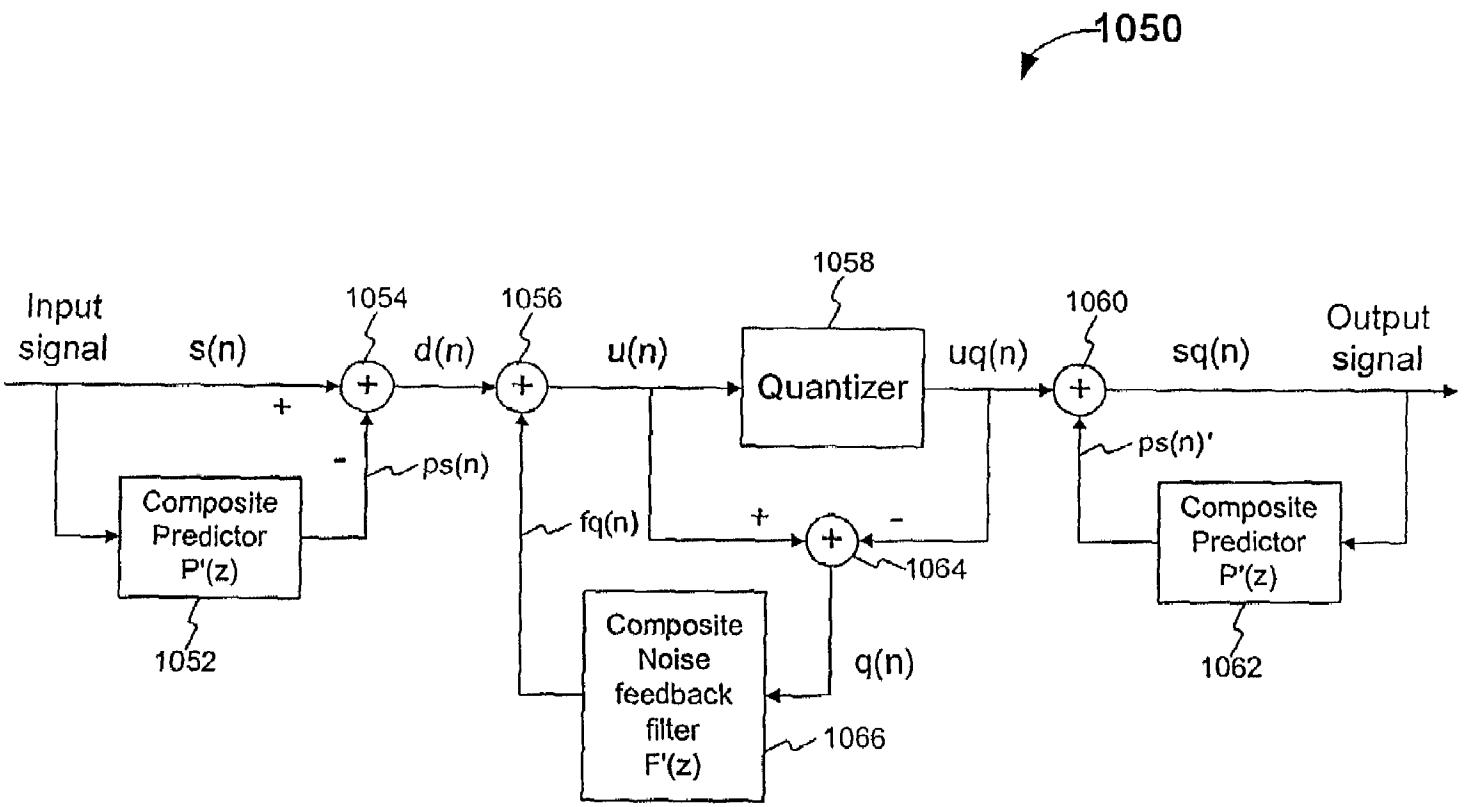
Figure 1A Noise Feedback Coding Using Composite Short-Term and Long-Term Predictors and Composite Short-Term and Long-Term Filter

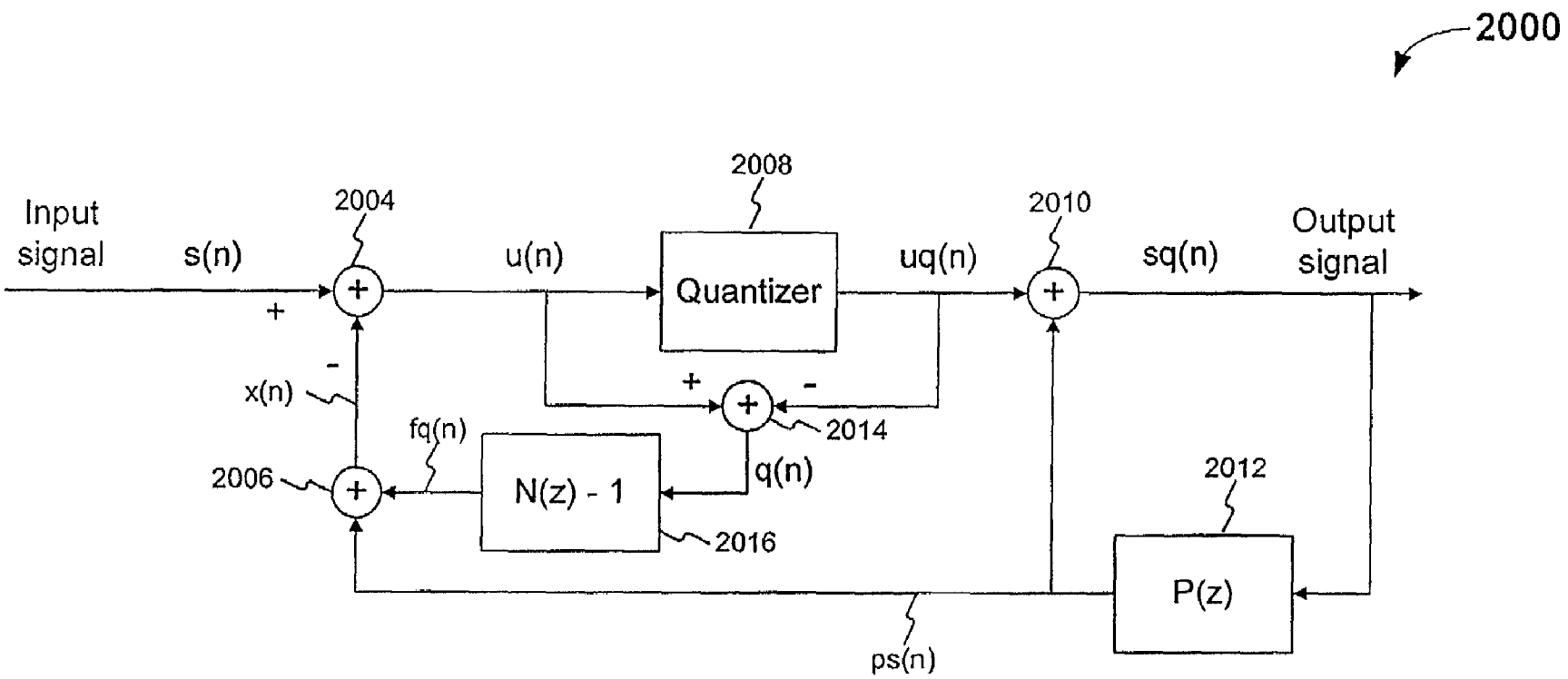
Figure 2 An alternative form of conventional Noise Feedback Coding

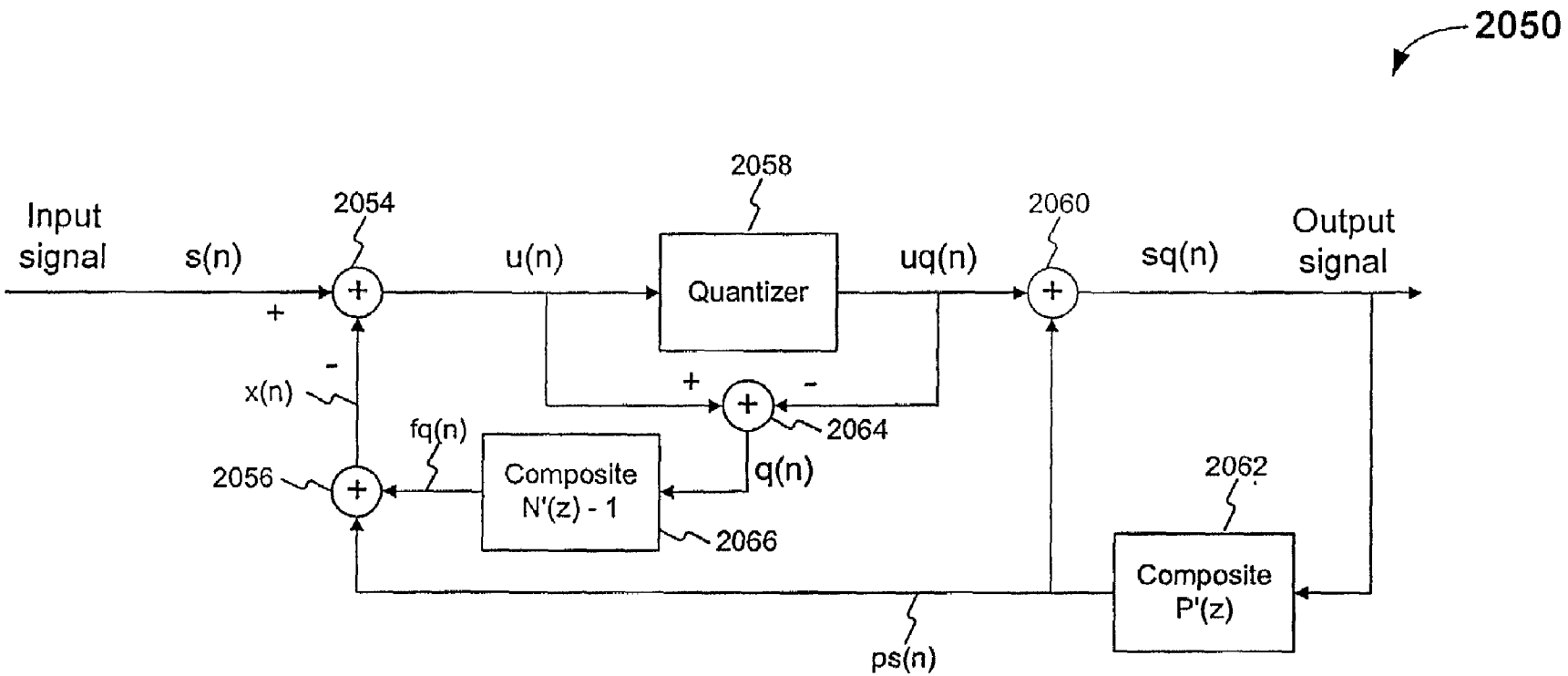
Figure 2A Noise Feedback Coding Using Composite Predictor and Composite Noise Filter

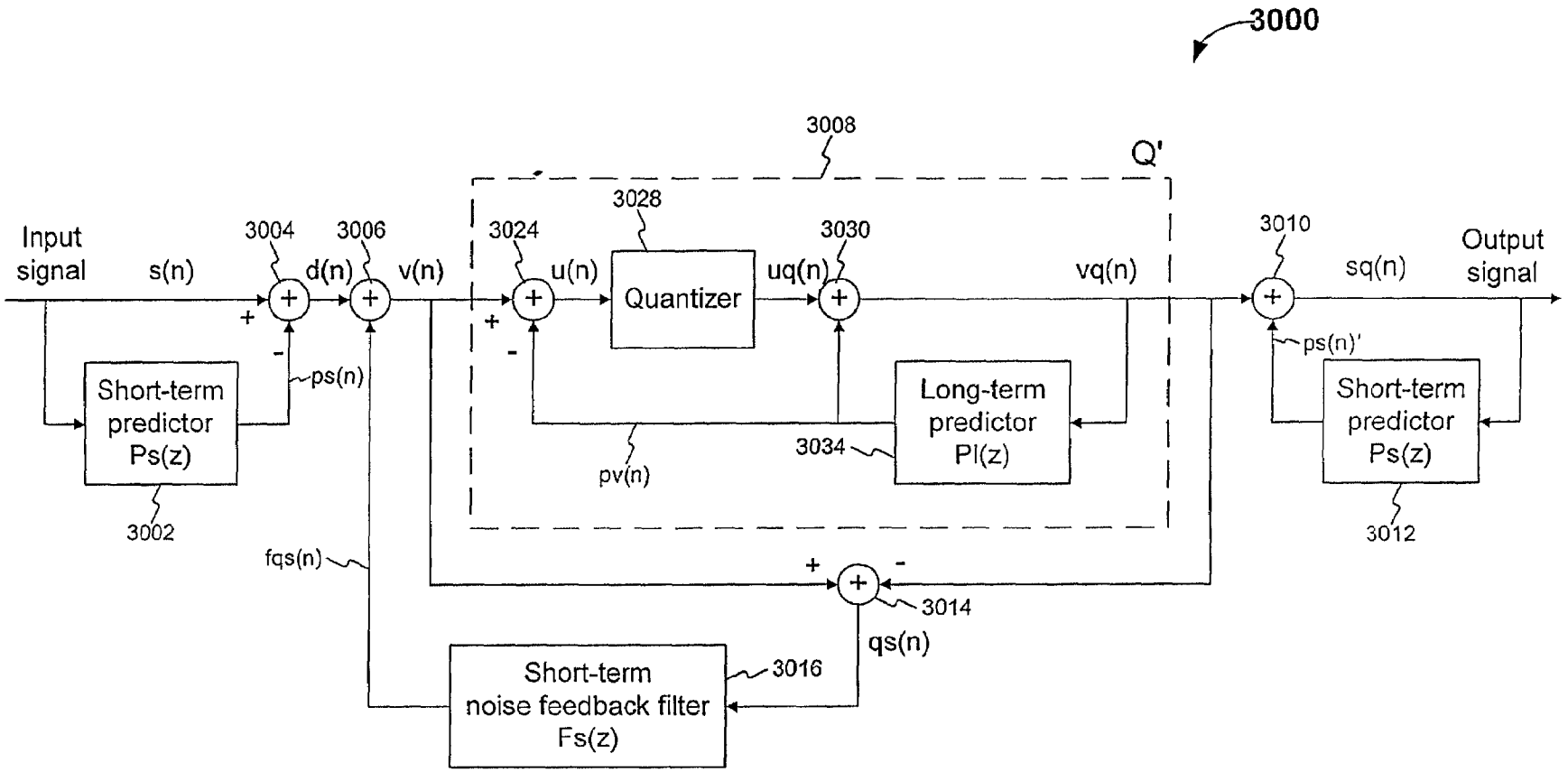
Figure 3 Noise Feedback Coding with short-term and long-term prediction but only short-term noise spectral shaping

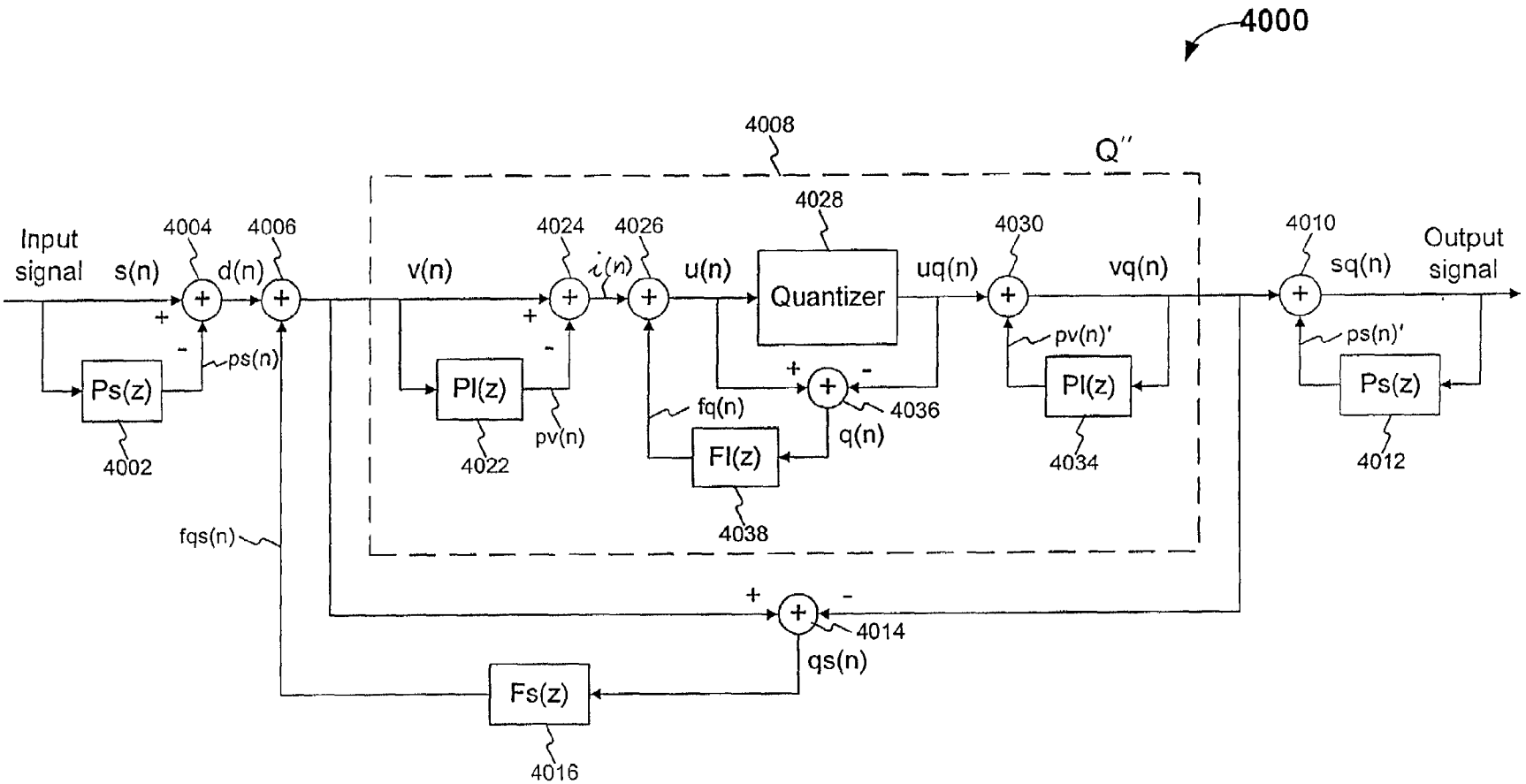
Figure 4 Nested two-stage Noise Feedback Coding structure with short-term and long-term prediction and short-term and long-term noise spectral shaping

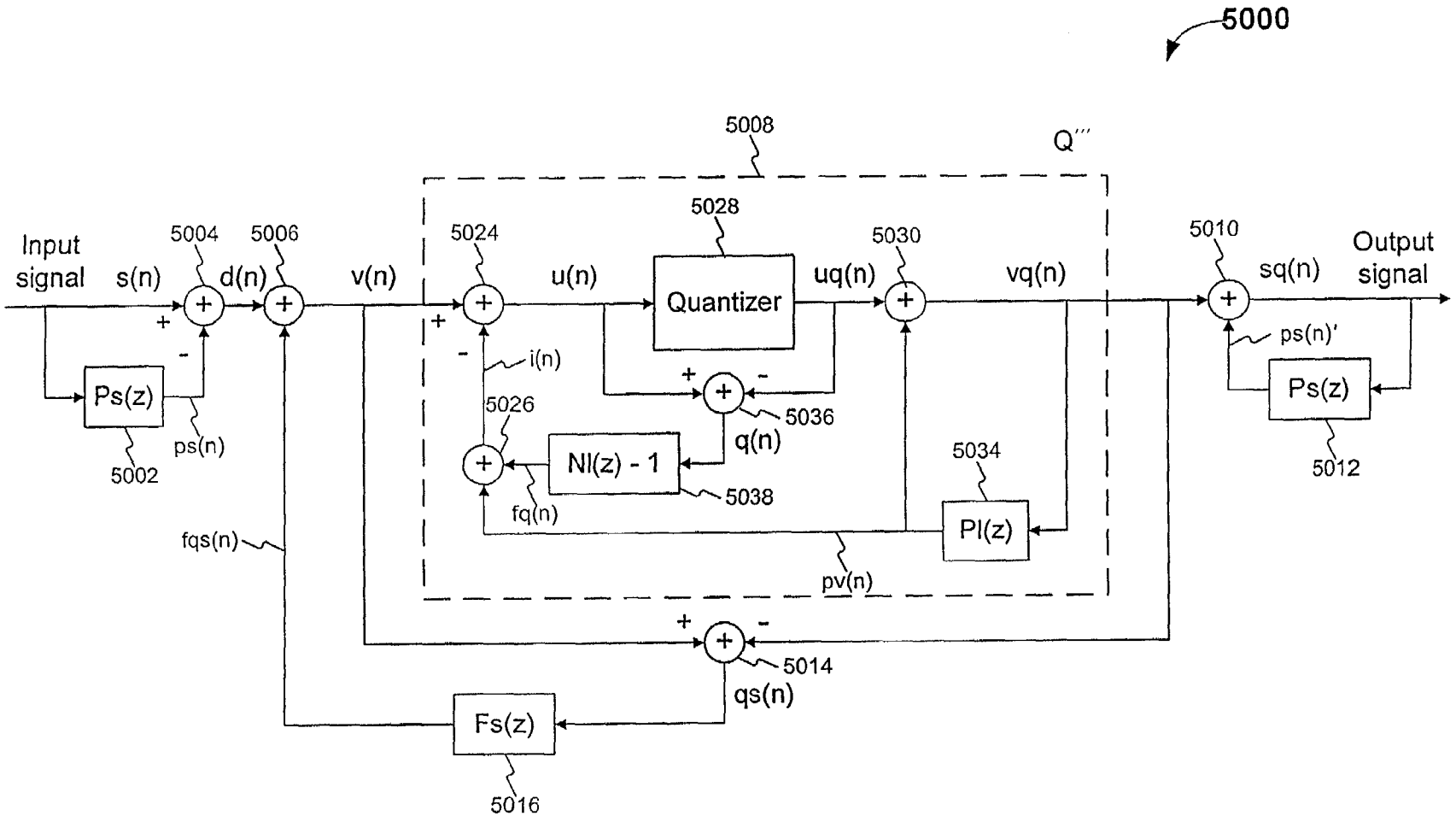
Figure 5 An alternative nested two-stage Noise Feedback Coding structure with short-term and long-term prediction and short-term and long-term noise spectral shaping

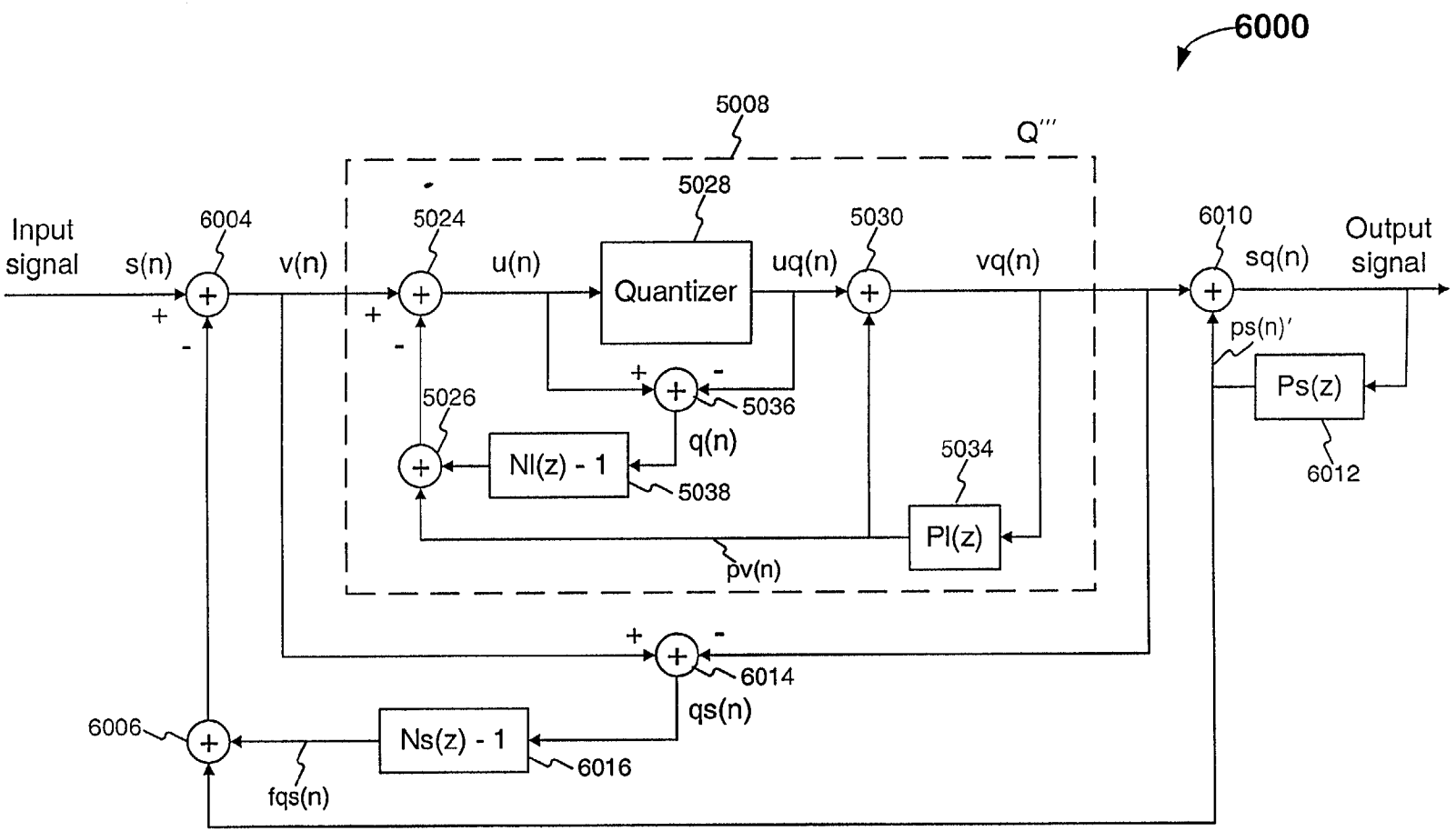
Figure 6 Another alternative nested two-stage Noise Feedback Coding structure with short-term and long-term prediction and short-term and long-term noise spectral shaping

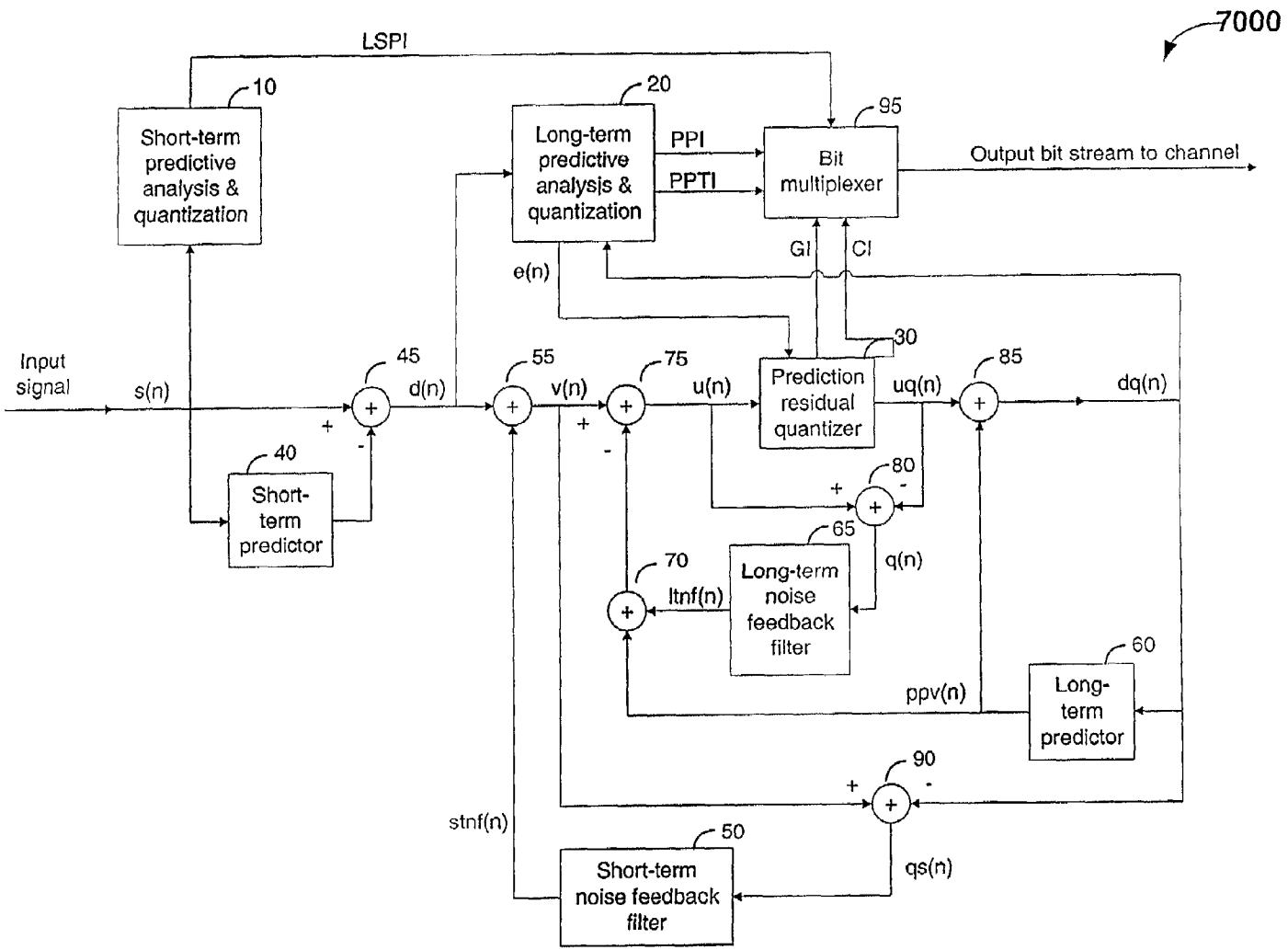
Figure 7 Encoder of a nested two-stage noise feedback codec (TSNFC)

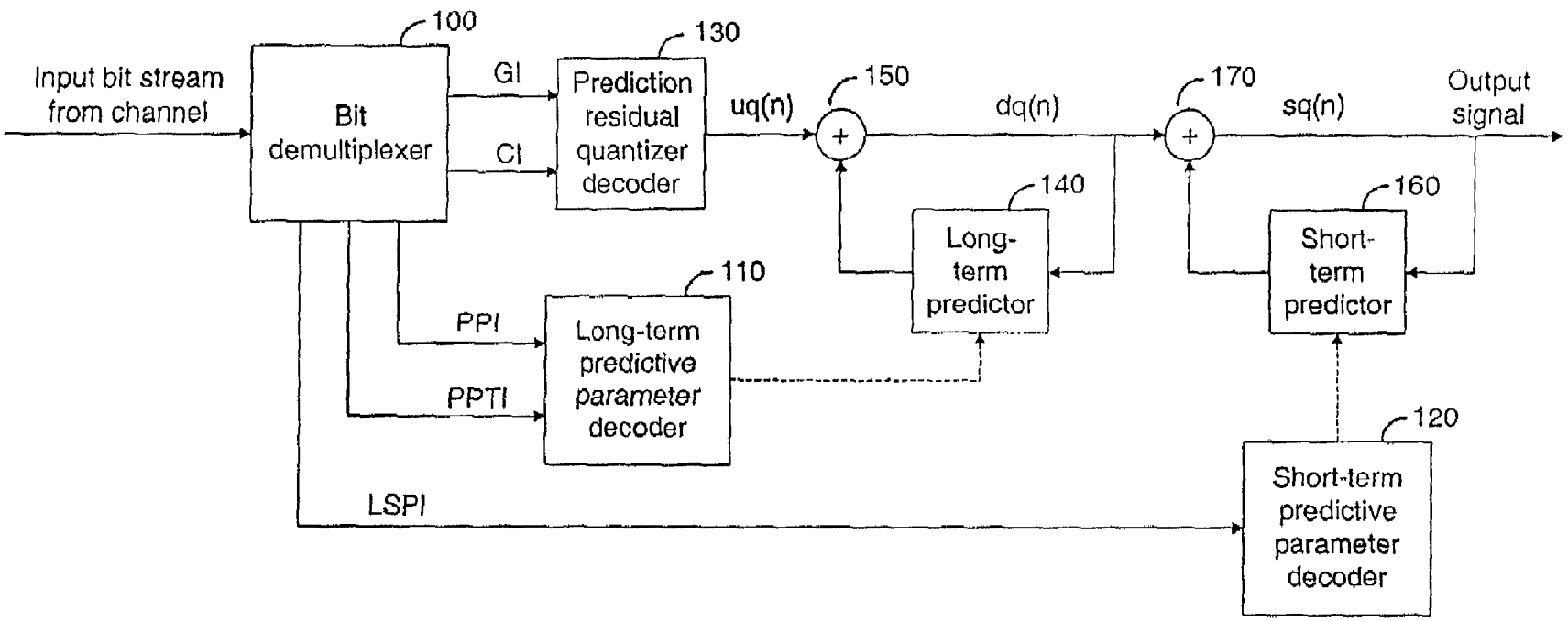
Figure 8 Decoder corresponding to the TSNFC encoder in Fig. 7

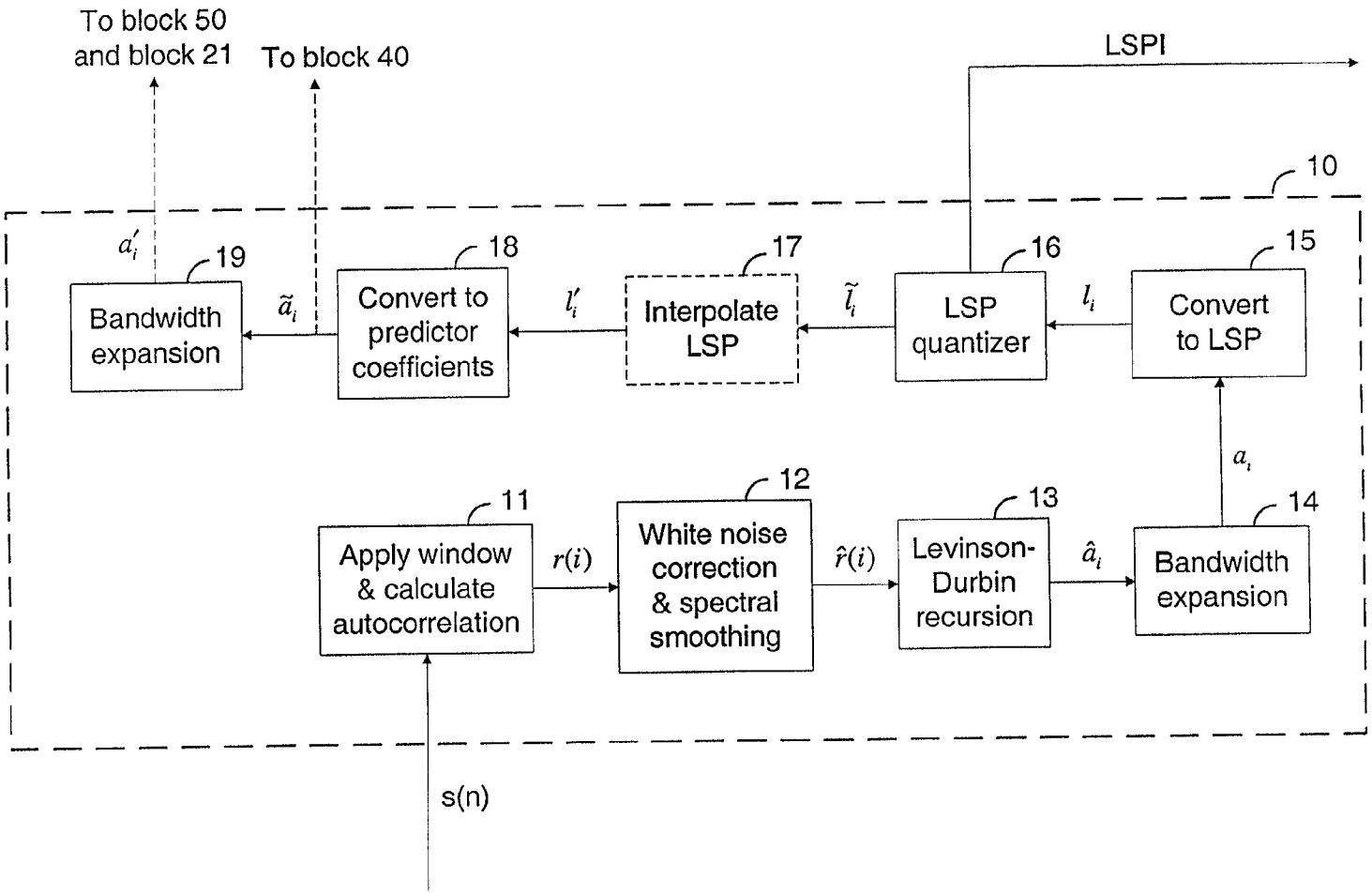
Figure 9 Short-term predictive analysis and quantization (block 10)

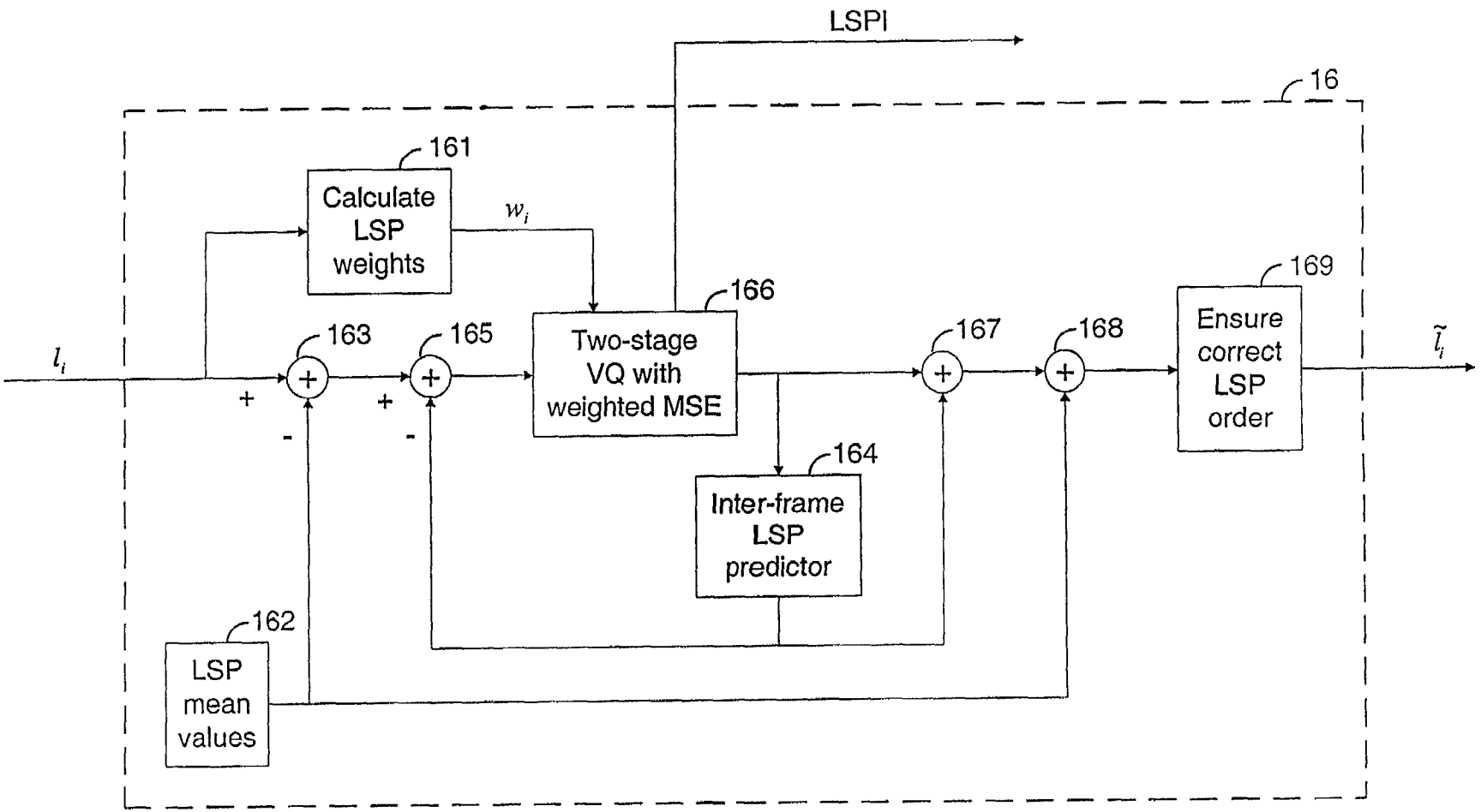
Figure 10 LSP quantizer (block 16)

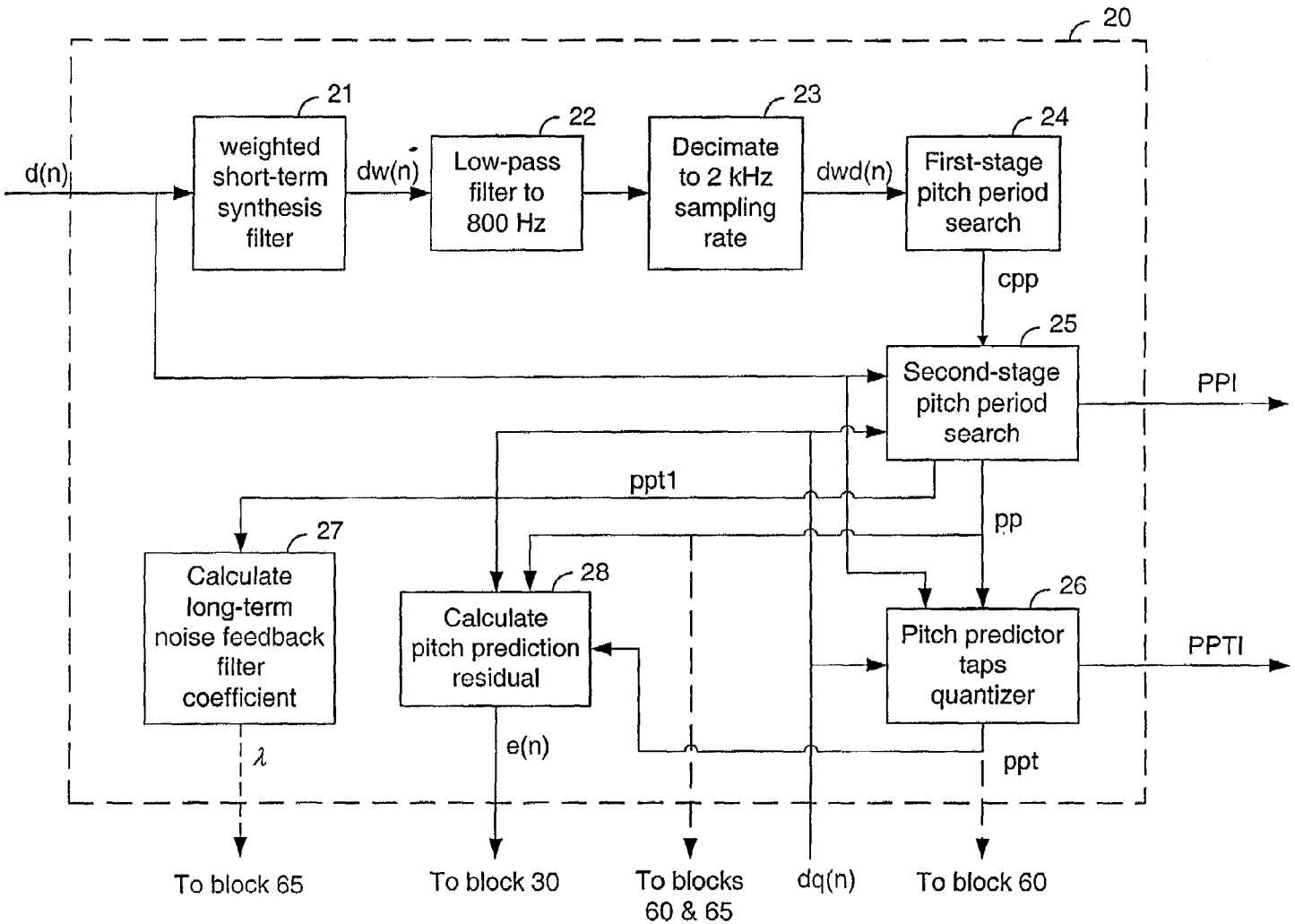
Figure 11 Long-term predictive analysis and quantization (block 20)

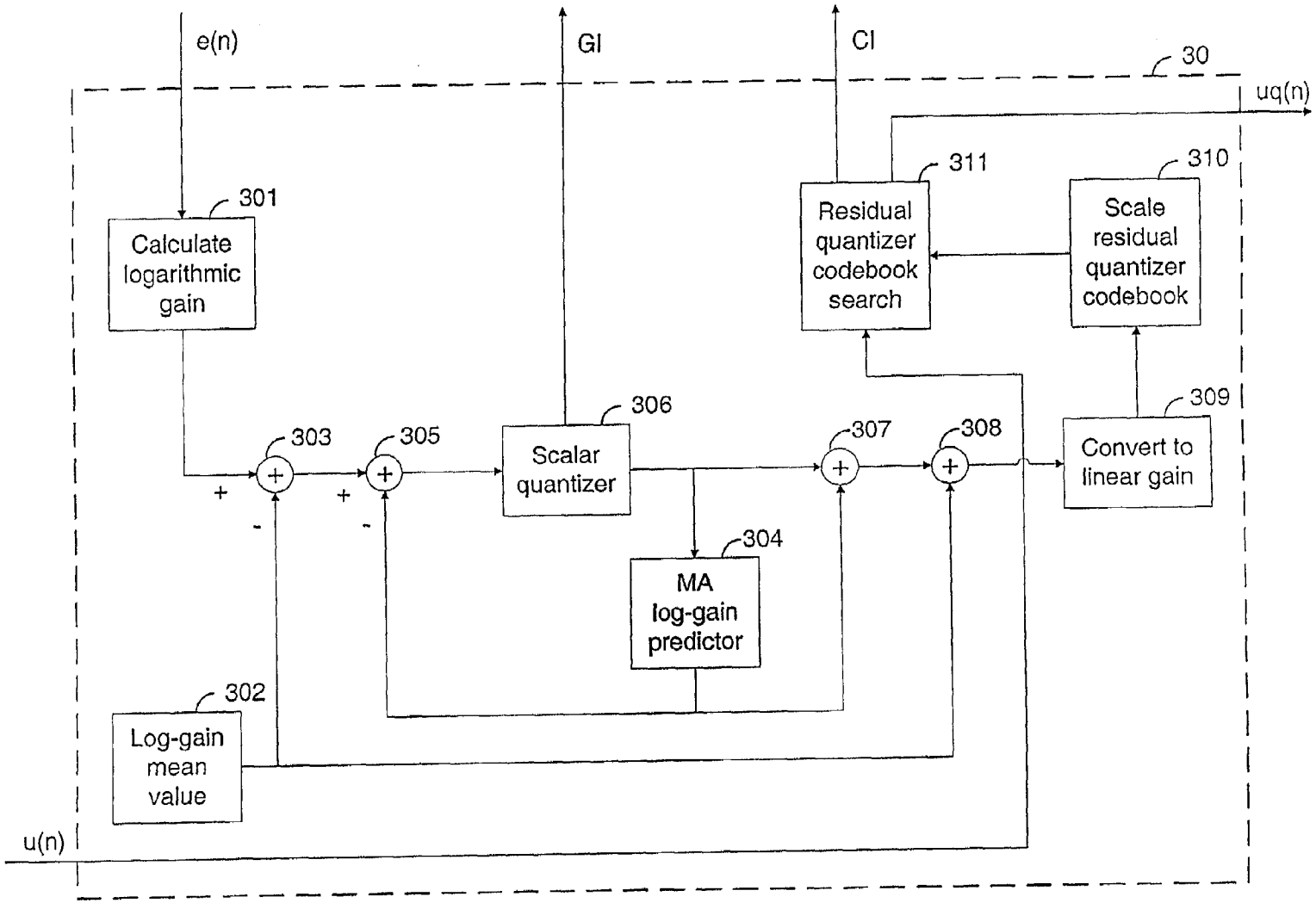
Figure 12 Prediction residual quantizer (block 30)

The portion of the codec structure that is used in prediction residual VQ codebook search of the two-stage noise feedback codec of Fig. 5.

Filter structure during the calculation of the zero-input response of q(n) of Fig. 13C.

Filter structure during the calculation of the zero-state response of q(n) in Fig. 13C.

A filter structure equivalent to the structure in Fig. 15A.

NOISE FEEDBACK CODING METHOD AND SYSTEM FOR EFFICIENTLY SEARCHING VECTOR QUANTIZATION CODEVECTORS USED FOR CODING A SPEECH SIGNAL

CROSS-REFERENCE TO RELATED APPLICATIONS

The present application is a Continuation-in-Part (CIP) of application Ser. No. 09/722,077, filed on Nov. 27, 2000, entitled "Method and Apparatus for One-Stage and Two-Stage Noise Feedback Coding of Speech and Audio Signals," and claims priority to Provisional Application No. 60/242,700, filed on Oct. 25, 2000, entitled "Methods for Two-Stage Noise Feedback Coding of Speech and Audio Signals," each of which is incorporated herein in its entirety by reference.

BACKGROUND OF THE INVENTION

1. Field of the Invention

This invention relates generally to digital communications, and more particularly, to digital coding (or compression) of speech and/or audio signals.

2. Related Art

In speech or audio coding, the coder encodes the input speech or audio signal into a digital bit stream for transmission or storage, and the decoder decodes the bit stream into an output speech or audio signal. The combination of the coder and the decoder is called a codec.

In the field of speech coding, the most popular encoding method is predictive coding. Rather than directly encoding the speech signal samples into a bit stream, a predictive encoder predicts the current input speech sample from previous speech samples, subtracts the predicted value from the input sample value, and then encodes the difference, or prediction residual, into a bit stream. The decoder decodes the bit stream into a quantized version of the prediction residual, and then adds the predicted value back to the residual to reconstruct the speech signal. This encoding principle is called Differential Pulse Code Modulation, or DPCM. In conventional DPCM codecs, the coding noise, or the difference between the input signal and the reconstructed signal at the output of the decoder, is white. In other words, the coding noise has a flat spectrum. Since the spectral envelope of voiced speech slopes down with increasing frequency, such a flat noise spectrum means the coding noise power often exceeds the speech power at high frequencies. When this happens, the coding distortion is perceived as a hissing noise, and the decoder output speech sounds noisy. Thus, white coding noise is not optimal in terms of perceptual quality of output speech.

The perceptual quality of coded speech can be improved by adaptive noise spectral shaping, where the spectrum of the coding noise is adaptively shaped so that it follows the input speech spectrum to some extent. In effect, this makes the coding noise more speech-like. Due to the noise masking effect of human hearing, such shaped noise is less audible to human ears. Therefore, codecs employing adaptive noise spectral shaping gives better output quality than codecs giving white coding noise.

In recent and popular predictive speech coding techniques such as Multi-Pulse Linear Predictive Coding (MPLPC) or Code-Excited Linear Prediction (CELP), adaptive noise spectral shaping is achieved by using a perceptual weighting filter to filter the coding noise and then calculating the mean-squared error (MSE) of the filter output in a closed-loop codebook search. However, an alternative method for adaptive noise spectral shaping, known as Noise Feedback Coding (NFC), had been proposed more than two decades before MPLPC or CELP came into existence.

The basic ideas of NFC date back to C. C. Cutler in a U.S. Patent entitled "Transmission Systems Employing Quantization," U.S. Pat. No. 2,927,962, issued Mar. 8, 1960. Based on Cutler's ideas, E. G. Kimme and F. F. Kuo proposed a noise feedback coding system for television signals in their paper "Synthesis of Optimal Filters for a Feedback Quantization System," *IEEE Transactions on Circuit Theory*, pp. 405–413, September 1963. Enhanced versions of NFC, applied to Adaptive Predictive Coding (APC) of speech, were later proposed by J. D. Makhoul and M. Berouti in "Adaptive Noise Spectral Shaping and Entropy Coding in Predictive Coding of Speech," *IEEE Transactions on Acoustics, Speech, and Signal Processing*, pp. 63–73, February 1979, and by B. S. Atal and M. R. Schroeder in "Predictive Coding of Speech Signals and Subjective Error Criteria," *IEEE Transactions on Acoustics, Speech, and Signal Processing*, pp. 247–254, June 1979. Such codecs are sometimes referred to as APC-NFC. More recently, NFC has also been used to enhance the output quality of Adaptive Differential Pulse Code Modulation (ADPCM) codecs, as proposed by C. C. Lee in "An enhanced ADPCM Coder for Voice Over Packet Networks," *International Journal of Speech Technology*, pp. 343–357, May 1999.

In noise feedback coding, the difference signal between the quantizer input and output is passed through a filter, whose output is then added to the prediction residual to form the quantizer input signal. By carefully choosing the filter in the noise feedback path (called the noise feedback filter), the spectrum of the overall coding noise can be shaped to make the coding noise less audible to human ears. Initially, NFC was used in codecs with only a short-term predictor that predicts the current input signal samples based on the adjacent samples in the immediate past. Examples of such codecs include the systems proposed by Makhoul and Berouti in their 1979 paper. The noise feedback filters used in such early systems are short-term filters. As a result, the corresponding adaptive noise shaping only affects the spectral envelope of the noise spectrum. (For convenience, we will use the terms "short-term noise spectral shaping" and "envelope noise spectral shaping" interchangeably to describe this kind of noise spectral shaping.)

In addition to the short-term predictor, Atal and Schroeder added a three-tap long-term predictor in the APC-NFC codecs proposed in their 1979 paper cited above. Such a long-term predictor predicts the current sample from samples that are roughly one pitch period earlier. For this reason, it is sometimes referred to as the pitch predictor in the speech coding literature. (Again, the terms "long-term predictor" and "pitch predictor" will be used interchangeably.) While the short-term predictor removes the signal redundancy between adjacent samples, the pitch predictor removes the signal redundancy between distant samples due to the pitch periodicity in voiced speech. Thus, the addition of the pitch predictor further enhances the overall coding efficiency of the APC systems. However, the APC-NFC codec proposed by Atal and Schroeder still uses only a short-term noise feedback filter. Thus, the noise spectral shaping is still limited to shaping the spectral envelope only.

In their paper entitled "Techniques for Improving the Performance of CELP-Type Speech Coders," *IEEE Journal on Selected Areas in Communications*, pp. 858–865, June 1992, I. A. Gerson and M. A. Jasiuk reported that the output speech quality of CELP codecs could be enhanced by shaping the coding noise spectrum to follow the harmonic fine structure of the voiced speech spectrum. (We will use the terms "harmonic noise shaping" or "long-term noise shaping" interchangeably to describe this kind of noise spectral shaping.) They achieved this goal by using a harmonic weighting filter derived from a three-tap pitch predictor. The effect of such harmonic noise spectral shaping is to make the noise intensity lower in the spectral valleys between pitch harmonic peaks, at the expense of higher noise intensity around the frequencies of pitch harmonic peaks. The noise components around the frequencies of pitch harmonic peaks are better masked by the voiced speech signal than the noise components in the spectral valleys between harmonics. Therefore, harmonic noise spectral shaping further reduces the perceived noise loudness, in addition to the reduction already provided by the shaping of the noise spectral envelope alone.

In Lee's May 1999 paper cited earlier, harmonic noise spectral shaping was used in addition to the usual envelope noise spectral shaping. This is achieved with a noise feedback coding structure in an ADPCM codec. However, due to ADPCM backward compatibility constraint, no pitch predictor was used in that ADPCM-NFC codec.

As discussed above, both harmonic noise spectral shaping and the pitch predictor are desirable features of predictive speech codecs that can make the output speech less noisy. Atal and Schroeder used the pitch predictor but not harmonic noise spectral shaping. Lee used harmonic noise spectral shaping but not the pitch predictor. Gerson and Jasiuk used both the pitch predictor and harmonic noise spectral shaping, but in a CELP codec rather than an NFC codec. Because of the Vector Quantization (VQ) codebook search used in quantizing the prediction residual (often called the excitation signal in CELP literature), CELP codecs normally have much higher complexity than conventional predictive noise feedback codecs based on scalar quantization, such as APC-NFC. For speech coding applications that require low codec complexity and high quality output speech, it is desirable to improve the scalar-quantization-based APC-NFC so it incorporates both the pitch predictor and harmonic noise spectral shaping.

The conventional NFC codec structure was developed for use with single-stage short-term prediction. It is not obvious how the original NFC codec structure should be changed to get a coding system with two stages of prediction (short-term prediction and pitch prediction) and two stages of noise spectral shaping (envelope shaping and harmonic shaping).

Even if a suitable codec structure can be found for two-stage APC-NFC, another problem is that the conventional APC-NFC is restricted to scalar quantization of the prediction residual. Although this allows the APC-NFC codecs to have a relatively low complexity when compared with CELP and MPLPC codecs, it has two drawbacks. First, scalar quantization limits the encoding bit rate for the prediction residual to integer number of bits per sample (unless complicated entropy coding and rate control iteration loop are used). Second, scalar quantization of prediction residual gives a codec performance inferior to vector quantization of the excitation signal, as is done in most modern codecs such as CELP. All these problems are addressed by the present invention.

SUMMARY OF THE INVENTION

Terminology

Predictor:

A predictor P as referred to herein predicts a current signal value (e.g., a current sample) based on previous or past signal values (e.g., past samples). A predictor can be a short-term predictor or a long-term predictor. A short-term signal predictor (e.g., a short term speech predictor) can predict a current signal sample (e.g., speech sample) based on adjacent signal samples from the immediate past. With respect to speech signals, such "short-term" predicting removes redundancies between, for example, adjacent or close-in signal samples. A long-term signal predictor can predict a current signal sample based on signal samples from the relatively distant past. With respect to a speech signal, such "long-term" predicting removes redundancies between relatively distant signal samples. For example, a long-term speech predictor can remove redundancies between distant speech samples due to a pitch periodicity of the speech signal.

The phrases "a predictor P predicts a signal s(n) to produce a signal ps(n)" means the same as the phrase "a predictor P makes a prediction ps(n) of a signal s(n)." Also, a predictor can be considered equivalent to a predictive filter that predictively filters an input signal to produce a predictively filtered output signal.

Coding Noise and Filtering Thereof:

Often, a speech signal can be characterized in part by spectral characteristics (i.e., the frequency spectrum) of the speech signal. Two known spectral characteristics include 1) what is referred to as a harmonic fine structure or line frequencies of the speech signal, and 2) a spectral envelope of the speech signal. The harmonic fine structure includes, for example, pitch harmonics, and is considered a long-term (spectral) characteristic of the speech signal. On the other hand, the spectral envelope of the speech signal is considered a short-term (spectral) characteristic of the speech signal.

Coding a speech signal can cause audible noise when the encoded speech is decoded by a decoder. The audible noise arises because the coded speech signal includes coding noise introduced by the speech coding process, for example, by quantizing signals in the encoding process. The coding noise can have spectral characteristics (i.e., a spectrum) different from the spectral characteristics (i.e., spectrum) of natural speech (as characterized above). Such audible coding noise can be reduced by spectrally shaping the coding noise (i.e., shaping the coding noise spectrum) such that it corresponds to or follows to some extent the spectral characteristics (i.e., spectrum) of the speech signal. This is referred to as "spectral noise shaping" of the coding noise, or "shaping the coding noise spectrum." The coding noise is shaped to follow the speech signal spectrum only "to some extent" because it is not necessary for the coding noise spectrum to exactly follow the speech signal spectrum. Rather, the coding noise spectrum is shaped sufficiently to reduce audible noise, thereby improving the perceptual quality of the decoded speech.

Accordingly, shaping the coding noise spectrum (i.e. spectrally shaping the coding noise) to follow the harmonic fine structure (i.e., long-term spectral characteristic) of the speech signal is referred to as "harmonic noise (spectral) shaping" or "long-term noise (spectral) shaping." Also, shaping the coding noise spectrum to follow the spectral envelope (i.e., short-term spectral characteristic) of the speech signal is referred to a "short-term noise (spectral) shaping" or "envelope noise (spectral) shaping."

In the present invention, noise feedback filters can be used to spectrally shape the coding noise to follow the spectral characteristics of the speech signal, so as to reduce the above mentioned audible noise. For example, a short-term noise feedback filter can short-term filter coding noise to spectrally shape the coding noise to follow the short-term spectral characteristic (i.e., the envelope) of the speech signal. On the other hand, a long-term noise feedback filter can long-term filter coding noise to spectrally shape the coding noise to follow the long-term spectral characteristic (i.e., the harmonic fine structure or pitch harmonics) of the speech signal. Therefore, short-term noise feedback filters can effect short-term or envelope noise spectral shaping of the coding noise, while long-term noise feedback filters can effect long-term or harmonic noise spectral shaping of the coding noise, in the present invention.

SUMMARY

The first contribution of this invention is the introduction of a few novel codec structures for properly achieving two-stage prediction and two-stage noise spectral shaping at the same time. We call the resulting coding method Two-Stage Noise Feedback Coding (TSNFC). A first approach is to combine the two predictors into a single composite predictor; we can then derive appropriate filters for use in the conventional single-stage NFC codec structure. Another approach is perhaps more elegant, easier to grasp conceptually, and allows more design flexibility. In this second approach, the conventional single-stage NFC codec structure is duplicated in a nested manner. As will be explained later, this codec structure basically decouples the operations of the long-term prediction and long-term noise spectral shaping from the operations of the short-term prediction and short-term noise spectral shaping. In the literature, there are several mathematically equivalent single-stage NFC codec structures, each with its own pros and cons. The decoupling of the long-term NFC operations and short-term NFC operations in this second approach allows us to mix and match different conventional single-stage NFC codec structures easily in our nested two-stage NFC codec structure. This offers great design flexibility and allows us to use the most appropriate single-stage NFC structure for each of the two nested layers. When these two-stage NFC codec uses a scalar quantizer for the prediction residual, we call the resulting codec a Scalar-Quantization-based, Two-Stage Noise Feedback Codec, or SQ-TSNFC for short.

The present invention provides a method and apparatus for coding a speech or audio signal. In one embodiment, a predictor predicts the speech signal to derive a residual signal. A combiner combines the residual signal with a first noise feedback signal to produce a predictive quantizer input signal. A predictive quantizer predictively quantizes the predictive quantizer input signal to produce a predictive quantizer output signal associated with a predictive quantization noise, and a filter filters the predictive quantization noise to produce the first noise feedback signal.

The predictive quantizer includes a predictor to predict the predictive quantizer input signal, thereby producing a first predicted predictive quantizer input signal. The predictive quantizer also includes a combiner to combine the predictive quantizer input signal with the first predicted predictive quantizer input signal to produce a quantizer input signal. A quantizer quantizes the quantizer input signal to produce a quantizer output signal, and deriving logic derives the predictive quantizer output signal based on the quantizer output signal.

In another embodiment, a predictor short-term and long-term predicts the speech signal to produce a short-term and long-term predicted speech signal. A combiner combines the short-term and long-term predicted speech signal with the speech signal to produce a residual signal. A second combiner combines the residual signal with a noise feedback signal to produce a quantizer input signal. A quantizer quantizes the quantizer input signal to produce a quantizer output signal associated with a quantization noise. A filter filters the quantization noise to produce the noise feedback signal.

The second contribution of this invention is the improvement of the performance of SQ-TSNFC by introducing a novel way to perform vector quantization of the prediction residual in the context of two-stage NFC. We call the resulting codec a Vector-Quantization-based, Two-Stage Noise Feedback Codec, or VQ-TSNFC for short. In conventional NFC codecs based on scalar quantization of the prediction residual, the codec operates sample-by-sample. For each new input signal sample, the corresponding prediction residual sample is calculated first. The scalar quantizer quantizes this prediction residual sample, and the quantized version of the prediction residual sample is then used for calculating noise feedback and prediction of subsequent samples. This method cannot be extended to vector quantization directly. The reason is that to quantize a prediction residual vector directly, every sample in that prediction residual vector needs to be calculated first, but that cannot be done, because from the second sample of the vector to the last sample, the unquantized prediction residual samples depend on earlier quantized prediction residual samples, which have not been determined yet since the VQ codebook search has not been performed. In VQ-TSNFC, we determine the quantized prediction residual vector first, and calculate the corresponding unquantized prediction residual vector and the energy of the difference between these two vectors (i.e. the VQ error vector). After trying every codevector in the VQ codebook, the codevector that minimizes the energy of the VQ error vector is selected as the output of the vector quantizer. This approach avoids the problem described earlier and gives significant performance improvement over the TSNFC system based on scalar quantization. A fast VQ search apparatus according to the present invention uses ZERO-INPUT and ZERO-STATE filter structures to compute corresponding ZERO-INPUT and ZERO-STATE responses, and then selects a preferred codevector based on the responses.

The third contribution of this invention is the reduction of VQ codebook search complexity in VQ-TSNFC. First, a sign-shape structured codebook is used instead of an unconstrained codebook. Each shape codevector can have either a positive sign or a negative sign. In other words, given any codevector, there is another codevector that is its mirror image with respect to the origin. For a given encoding bit rate for the prediction residual VQ, this sign-shape structured codebook allows us to cut the number of shape codevectors in half, and thus reduce the codebook search complexity. Second, to reduce the complexity further, we pre-compute and store the contribution to the VQ error vector due to filter memories and signals that are fixed during the codebook search. Then, only the contribution due to the VQ codevector needs to be calculated during the codebook search. This reduces the complexity of the search significantly.

The fourth contribution of this invention is a closed-loop VQ codebook design method for optimizing the VQ codebook for the prediction residual of VQ-TSNFC. Such closed-loop optimization of VQ codebook improves the codec performance significantly without any change to the codec operations.

This invention can be used for input signals of any sampling rate. In the description of the invention that follows, two specific embodiments are described, one for encoding 16 kHz sampled wideband signals at 32 kb/s, and the other for encoding 8 kHz sampled narrowband (telephone-bandwidth) signals at 16 kb/s.

BRIEF DESCRIPTION OF THE DRAWINGS

The present invention is described with reference to the accompanying drawings. In the drawings, like reference numbers indicate identical or functionally similar elements.

FIG. 1 is a block diagram of a first conventional noise feedback coding structure or codec.

FIG. 1A is a block diagram of an example NFC structure or codec using composite short-term and long-term predictors and a composite short-term and long-term noise feedback filter, according to a first embodiment of the present invention.

FIG. 2 is a block diagram of a second conventional noise feedback coding structure or codec.

FIG. 2A is a block diagram of an example NFC structure or codec using a composite short-term and long-term predictor and a composite short-term and long-term noise feedback filter, according to a second embodiment of the present invention.

FIG. 3 is a block diagram of a first example arrangement of an example NFC structure or codec, according to a third embodiment of the present invention.

FIG. 4 is a block diagram of a first example arrangement of an example nested two-stage NFC structure or codec, according to a fourth embodiment of the present invention.

FIG. 5 is a block diagram of a first example arrangement of an example nested two-stage NFC structure or codec, according to a fifth embodiment of the present invention.

FIG. 6 is a block diagram of a first example arrangement of an example nested two-stage NFC structure or codec, according to a sixth embodiment of the present invention.

FIG. 7 is a detailed block diagram of an example NFC encoding structure or coder based on the codec of FIG. 5, according to a preferred embodiment of the present invention.

FIG. 8 is a detailed block diagram of an example NFC decoding structure or decoder for decoding encoded speech signals encoded using the coder of FIG. 7.

FIG. 9 is a detailed block diagram of a short-term linear predictive analysis and quantization signal processing block of the coder of FIG. 7. The signal processing block obtains coefficients for a short-term predictor and a short-term noise feedback filter of the coder of FIG. 7.

FIG. 10 is a detailed block diagram of a Line Spectrum Pair (LSP) quantizer and encoder signal processing block of the short-term linear predictive analysis and quantization signal processing block of FIG. 9.

FIG. 11 is a detailed block diagram of a long-term linear predictive analysis and quantization signal processing block of the coder of FIG. 7. The signal processing block obtains coefficients for a long-term predictor and a long-term noise feedback filter of the coder of FIG. 7.

FIG. 12 is a detailed block diagram of a prediction residual quantizer of the coder of FIG. 7.

DETAILED DESCRIPTION OF THE INVENTION

Table of Contents

Figure 5A:
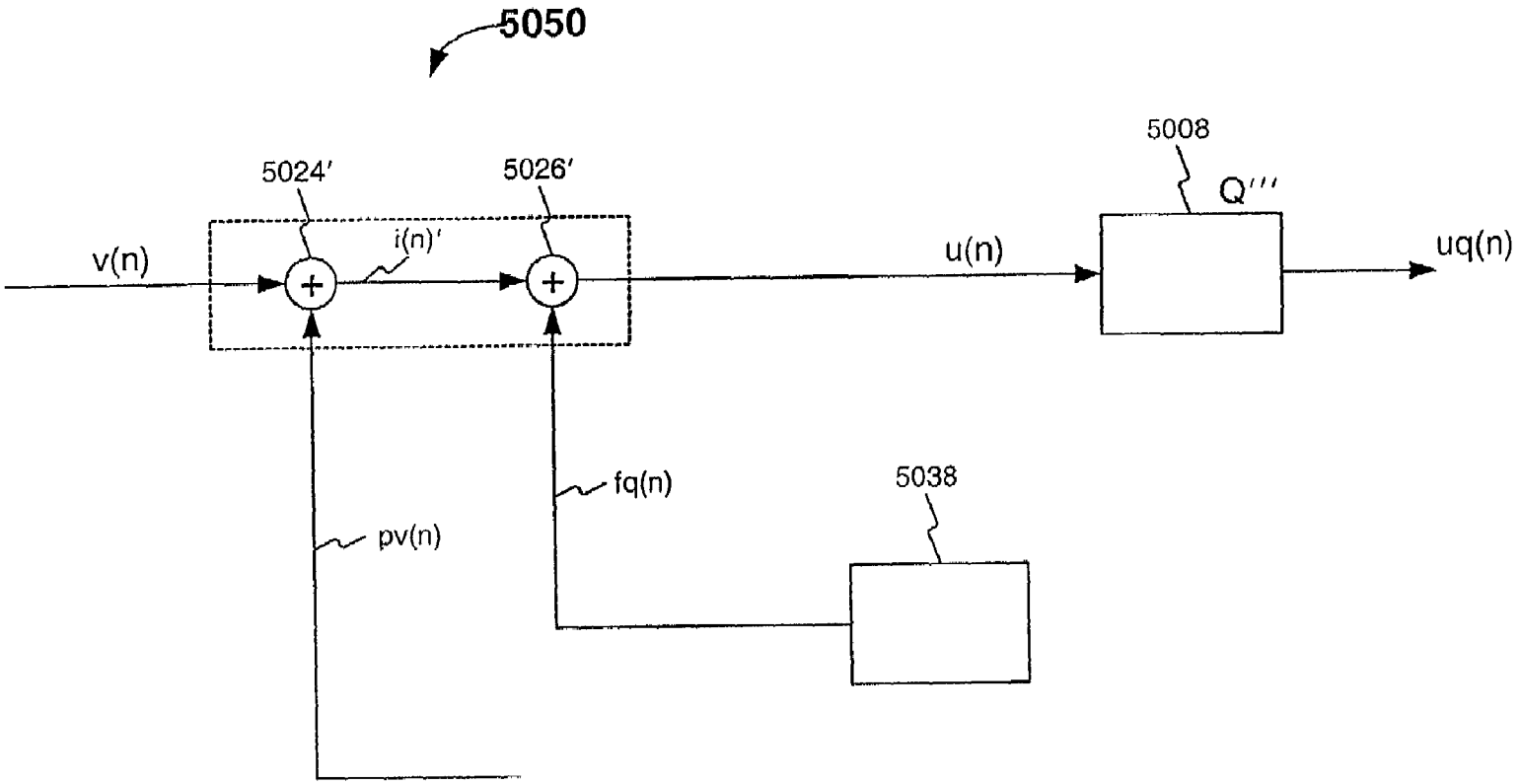
FIG. 5A is a block diagram of an alternative but mathematically equivalent signal combining arrangement corresponding to a signal combining arrangement of FIG. 5.

I. Conventional Noise Feedback Coding
A. First Conventional Codec
B. Second Conventional Codec
II. Two-Stage Noise Feedback Coding
A. Composite Codec Embodiments
1. First Codec Embodiment—Composite Codec
2. Second Codec Embodiment—Alternative Composite Codec
B. Codec Embodiments Using Separate Short-Term and Long-Term Predictors (Two-Stage Prediction) and Noise Feedback Coding
1. Third Code Embodiment—Two Stage Prediction With One Stage Noise Feedback
2. Fourth Codec Embodiment—Two Stage Prediction With Two Stage Noise Feedback (Nested Two Stage Feedback Coding)
3. Fifth Codec Embodiment—Two Stag Prediction With Two Stage Noise Feedback (Nested Two Stage Feedback Coding)
4. Sixth Codec Embodiment—Two Stage Prediction With Two Stage Noise Feedback (Nested Two Stage Feedback Coding)
5. Coding Method
III. Overview of Preferred Embodiment (Based on the Fifth Embodiment Above)
IV. Short Term Linear Predictive Analysis and Quantization
V. Short-Term Linear Prediction of Input Signal
VI. Long-Term Linear Predictive Analysis and Quantization
VII. Quantization of Residual Gain
VIII. Scalar Quantization of Linear Prediction Residual Signal
IX. Vector Quantization of Linear Prediction Residual Signal
A. General VQ Search
1. High-Level Embodiment
a. System
b. Methods
2. Example Specific Embodiment
a. System
b. Methods
B. Fast VQ Search
1. High-Level Embodiment
a. System
b. Methods
2. Example Specific Embodiment
a. ZERO-INPUT Response
b. ZERO-STATE Response
1. ZERO-STATE Response—First Embodiment
2. ZERO-STATE Response—Second Embodiment
3. Further Reduction in Computational Complexity
X. Closed-Loop Residual Codebook Optimization
XI. Decoder Operations
XII. Hardware and Software Implementations
XIII. Conclusion

I. Conventional Noise Feedback Coding

Before describing the present invention, it is helpful to first describe the conventional noise feedback coding schemes.

A. First Conventional Coder

FIG. 1 is a block diagram of a first conventional NFC structure or codec 1000. Codec 1000 includes the following functional elements: a first predictor 1002 (also referred to as predictor P(z)); a first combiner or adder 1004; a second combiner or adder 1006; a quantizer 1008; a third combiner or adder 1010; a second predictor 1012 (also referred to as a predictor P(z)); a fourth combiner 1014; and a noise feedback filter 1016 (also referred to as a filter F(z)).

Codec 1000 encodes a sampled input speech or audio signal s(n) to produce a coded speech signal, and then decodes the coded speech signal to produce a reconstructed speech signal sq(n), representative of the input speech signal s(n). Reconstructed output speech signal sq(n) is associated with an overall coding noise r(n)=s(n)−sq(n). An encoder portion of codec 1000 operates as follows. Sampled input speech or audio signal s(n) is provided to a first input of combiner 1004, and to an input of predictor 1002. Predictor 1002 makes a prediction of current speech signal s(n) values (e.g., samples) based on past values of the speech signal to produce a predicted signal ps(n). This process is referred to as predicting signal s(n) to produce predicted signal ps(n). Predictor 1002 provides predicted speech signal ps(n) to a second input of combiner 1004. Combiner 1004 combines signals s(n) and ps(n) to produce a prediction residual signal d(n).

Combiner 1006 combines residual signal d(n) with a noise feedback signal fq(n) to produce a quantizer input signal u(n). Quantizer 1008 quantizes input signal u(n) to produce a quantized signal uq(n). Combiner 1014 combines (that is, differences) signals u(n) and uq(n) to produce a quantization error or noise signal q(n) associated with the quantized signal uq(n). Filter 1016 filters noise signal q(n) to produce feedback noise signal fq(n).

A decoder portion of codec 1000 operates as follows. Exiting quantizer 1008, combiner 1010 combines quantizer output signal uq(n) with a prediction ps(n)' of input speech signal s(n) to produce reconstructed output speech signal sq(n). Predictor 1012 predicts input speech signal s(n) to produce predicted speech signal ps(n)', based on past samples of output speech signal sq(n).

The following is an analysis of codec 1000 described above. The predictor P(z) (1002 or 1012) has a transfer function of $$P(z) = \sum_{i=1}^{M} a_i z^{-i},$$

where M is the predictor order and $a_i$ is the i-th predictor coefficient. The noise feedback filter F(z) (1016) can have many possible forms. One popular form of F(z) is given by $$F(z) = \sum_{i=1}^{L} f_i z^{-i}.$$

Atal and Schroeder used this form of noise feedback filter in their 1979 paper, with L=M, and $f_i=\alpha^i a_i$, or $F(z)=P(z/\alpha)$.

With the NFC codec structure 1000 in FIG. 1, it can be shown that the codec reconstruction error, or coding noise, is given by $$r(n) = s(n) - sq(n) = \sum_{i=1}^{M} a_i r(n-i) + q(n) - \sum_{i=1}^{L} f_i q(n-i),$$

or in terms of z-transform representation, $$R(z) = \frac{1 - F(z)}{1 - P(z)} Q(z).$$

If the encoding bit rate of the quantizer 1008 in FIG. 1 is sufficiently high, the quantization error q(n)=u(n)−uq(n) is roughly white. From the equation above, it follows that the magnitude spectrum of the coding noise r(n) will have the same shape as the magnitude of the frequency response of the filter [1−F(z)]/[1−P(z)]. If F(z)=P(z), then R(z)=Q(z), the coding noise is white, and the system 1000 in FIG. 1 is equivalent to a conventional DPCM codec. If F(z)=0, then R(z)=Q(z)/[1−P(z)], the coding noise has the same spectral shape as the input signal spectrum, and the codec system 1000 in FIG. 1 becomes a so-called "open-loop DPCM" codec. If F(z) is somewhere between P(z) and 0, for example, F(z)=P(z/α), where 0<α<1, then the spectrum of the coding noise is somewhere between a white spectrum and the input signal spectrum. Coding noise spectrally shaped this way is indeed less audible than either the white noise or the noise with spectral shape identical to the input signal spectrum.

B. Second Conventional Codec

FIG. 2 is a block diagram of a second conventional NFC structure or codec 2000. Codec 2000 includes the following functional elements: a first combiner or adder 2004; a second combiner or adder 2006; a quantizer 2008; a third combiner or adder 2010; a predictor 2012 (also referred to as a predictor P(z)); a fourth combiner 2014; and a noise feedback filter 2016 (also referred to as a filter N(z)−1).

Codec 2000 encodes a sampled input speech signal s(n) to produce a coded speech signal, and then decodes the coded speech signal to produce a reconstructed speech signal sq(n), representative of the input speech signal s(n). Reconstructed speech signal sq(n) is associated with an overall coding noise r(n)=s(n)−sq(n). Codec 2000 operates as follows. A sampled input speech or audio signal s(n) is provided to a first input of combiner 2004. A feedback signal x(n) is provided to a second input of combiner 2004. Combiner 2004 combines signals s(n) and x(n) to produce a quantizer input signal u(n). Quantizer 2008 quantizes input signal u(n) to produce a quantized signal uq(n) (also referred to as a quantizer output signal uq(n)). Combiner 2014 combines (that is, differences) signals u(n) and uq(n) to produce a quantization error or noise signal q(n) associated with the quantized signal uq(n). Filter 2016 filters noise signal q(n) to produce feedback noise signal fq(n). Combiner 2006 combines feedback noise signal fq(n) with a predicted signal ps(n) (i.e., a prediction of input speech signal s(n)) to produce feedback signal x(n).

Exiting quantizer 2008, combiner 2010 combines quantizer output signal uq(n) with prediction or predicted signal ps(n) to produce reconstructed output speech signal sq(n). Predictor 2012 predicts input speech signal s(n) (to produce predicted speech signal ps(n)) based on past samples of output speech signal sq(n). Thus, predictor 2012 is included in the encoder and decoder portions of codec 2000.

Makhoul and Berouti proposed codec structure 2000 in their 1979 paper cited earlier. This equivalent, known NFC codec structure 2000 has at least two advantages over codec 1000. First, only one predictor P(z) (2012) is used in the structure. Second, if N(z) is the filter whose frequency response corresponds to the desired noise spectral shape, this codec structure 2000 allows us to use [N(z)−1] directly as the noise feedback filter 2016. Makhoul and Berouti showed in their 1979 paper that very good perceptual speech quality can be obtained by choosing N(z) to be a simple second-order finite-impulse-response (FIR) filter.

The codec structures in FIGS. 1 and 2 described above can each be viewed as a predictive codec with an additional noise feedback loop. In FIG. 1, a noise feedback loop is added to the structure of an "open-loop DPCM" codec, where the predictor in the encoder uses unquantized original input signal as its input. In FIG. 2, on the other hand, a noise feedback loop is added to the structure of a "closed-loop DPCM" codec, where the predictor in the encoder uses the quantized signal as its input. Other than this difference in the signal that is used as the predictor input in the encoder, the codec structures in FIG. 1 and FIG. 2 are conceptually very similar.

II. Two-Stage Noise Feedback Coding

The conventional noise feedback coding principles described above are well-known prior art. Now we will address our stated problem of two-stage noise feedback coding with both short-term and long-term prediction, and both short-term and long-term noise spectral shaping.

A. Composite Codec Embodiments

A first approach is to combine a short-term predictor and a long-term predictor into a single composite short-term and long-term predictor, and then re-use the general structure of codec 1000 in FIG. 1 or that of codec 2000 in FIG. 2 to construct an improved codec corresponding to the general structure of codec 1000 and an improved codec corresponding to the general structure of codec 2000. Note that in FIG. 1, the feedback loop to the right of the symbol uq(n) that includes the adder 1010 and the predictor loop (including predictor 1012) is often called a synthesis filter, and has a transfer function of 1/[1−P(z)]. Also note that in most predictive codecs employing both short-term and long-term prediction, the decoder has two such synthesis filters cascaded: one with the short-term predictor and the other with the long-term predictor in the feedback loop. Let Ps(z) and Pl(z) be the transfer functions of the short-term predictor and the long-term predictor, respectively. Then, the cascaded synthesis filter will have a transfer function of $$\frac{1}{[1 - Ps(z)][1 - Pl(z)]} = \frac{1}{1 - Ps(z) - Pl(z) + Ps(z)Pl(z)} = \frac{1}{1 - P'(z)},$$

where P'(z)=Ps(z)+Pl(z)−Ps(z)Pl(z) is the composite predictor (for example, the predictor that includes the effects of both short-term prediction and long-term prediction).

Similarly, in FIG. 1, the filter structure to the left of the symbol d(n), including the adder 1004 and the predictor loop (i.e., including predictor 1002), is often called an analysis filter, and has a transfer function of 1−P(z). If we cascade two such analysis filters, one with the short-term predictor and the other with the long-term predictor, then the transfer function of the cascaded analysis filter is $$[1-Ps(z)][1-Pl(z)]=1-Ps(z)-Pl(z)+Ps(z)Pl(z)=1-P'(z).$$

Therefore, one can replace the predictor P(z) (1002 or 1012) in FIG. 1 and the predictor P(z) (2012) in FIG. 2 by the composite predictor P'(z)=Ps(z)+Pl(z)−Ps(z)Pl(z) to get the effect of two-stage prediction. To get both short-term and long-term noise spectral shaping, one can use the general coding structure of codec 1000 in FIG. 1 and choose the filter transfer function F(z)=Ps(z/α)+Pl(z/β)−Ps(z/α)Pl(z/β) =F'(z). Then, the noise spectral shape will follow the frequency response of the filter $$\frac{1-F'(z)}{1-P'(z)} = \frac{1-Ps(z/\alpha)-Pl(z/\beta)+Ps(z/\alpha)Pl(z/\beta)}{1-Ps(z)-Pl(z)+Ps(z)Pl(z)} = \frac{[1-Ps(z/\alpha)]}{[1-Ps(z)]}\frac{[1-Pl(z/\beta)]}{[1-Pl(z)]}$$

Thus, both short-term noise spectral shaping and long-term spectral shaping are achieved, and they can be individually controlled by the parameters α and β, respectively.

1. First Codec Embodiment—Composite Codec

FIG. 1A is a block diagram of an example NFC structure or codec 1050 using composite short-term and long-term predictors P'(z) and a composite short-term and long-term noise feedback filter F'(z), according to a first embodiment of the present invention. Codec 1050 reuses the general structure of known codec 1000 in FIG. 1, but replaces the predictors P(z) and filter of codec 1000 F(z) with the composite predictors P'(z) and the composite filter F'(z), as is further described below.

1050 includes the following functional elements: a first composite short-term and long-term predictor 1052 (also referred to as a composite predictor P'(z)); a first combiner or adder 1054; a second combiner or adder 1056; a quantizer 1058; a third combiner or adder 1060; a second composite short-term and long-term predictor 1062 (also referred to as a composite predictor P'(z)); a fourth combiner 1064; and a composite short-term and long-term noise feedback filter 1066 (also referred to as a filter F'(z)).

The functional elements or blocks of codec 1050 listed above are arranged similarly to the corresponding blocks of codec 1000 (described above in connection with FIG. 1) having reference numerals decreased by "50." Accordingly, signal flow between the functional blocks of codec 1050 is similar to signal flow between the corresponding blocks of codec 1000.

Codec 1050 encodes a sampled input speech signal s(n) to produce a coded speech signal, and then decodes the coded speech signal to produce a reconstructed speech signal sq(n), representative of the input speech signal s(n). Reconstructed speech signal sq(n) is associated with an overall coding noise r(n)=s(n)−sq(n). An encoder portion of codec 1050 operates in the following exemplary manner. Composite predictor 1052 short-term and long-term predicts input speech signal s(n) to produce a short-term and long-term predicted speech signal ps(n). Combiner 1054 combines short-term and long-term predicted signal ps(n) with speech signal s(n) to produce a prediction residual signal d(n).

Combiner 1056 combines residual signal d(n) with a short-term and long-term filtered, noise feedback signal fq(n) to produce a quantizer input signal u(n). Quantizer 1058 quantizes input signal u(n) to produce a quantized signal uq(n) (also referred to as a quantizer output signal) associated with a quantization noise or error signal q(n). Combiner 1064 combines (that is, differences) signals u(n) and uq(n) to produce the quantization error or noise signal q(n). Composite filter 1066 short-term and long-term filters noise signal q(n) to produce short-term and long-term filtered, feedback noise signal fq(n). In codec 1050, combiner 1064, composite short-term and long-term filter 1066, and combiner 1056 together form a noise feedback loop around quantizer 1058. This noise feedback loop spectrally shapes the coding noise associated with codec 1050, in accordance with the composite filter, to follow, for example, the short-term and long-term spectral characteristics of input speech signal s(n).

A decoder portion of coder 1050 operates in the following exemplary manner. Exiting quantizer 1058, combiner 1060 combines quantizer output signal uq(n) with a short-term and long-term prediction ps(n)' of input speech signal s(n) to produce a quantized output speech signal sq(n). Composite predictor 1062 short-term and long-term predicts input speech signal s(n) (to produce short-term and long-term predicted signal ps(n)') based on output signal sq(n).

2. Second Codec Embodiment—Alternative Composite Codec

As an alternative to the above described first embodiment, a second embodiment of the present invention can be constructed based on the general coding structure of codec 2000 in FIG. 2. Using the coding structure of codec 2000 with P(z) replaced by composite function P'(z), one can choose a suitable composite noise feedback filter N'(z)−1 (replacing filter 2016) such that it includes the effects of both short-term and long-term noise spectral shaping. For example, N'(z) can be chosen to contain two FIR filters in cascade: a short-term filter to control the envelope of the noise spectrum, while another, long-term filter, controls the harmonic structure of the noise spectrum.

FIG. 2A is a block diagram of an example NFC structure or codec 2050 using a composite short-term and long-term predictor P'(z) and a composite short-term and long-term noise feedback filter N'(z)−1, according to a second embodiment of the present invention. Codec 2050 includes the following functional elements: a first combiner or adder 2054; a second combiner or adder 2056; a quantizer 2058; a third combiner or adder 2060; a composite short-term and long-term predictor 2062 (also referred to as a predictor P'(z)); a fourth combiner 2064; and a noise feedback filter 2066 (also referred to as a filter N'(z)−1).

The functional elements or blocks of codec 2050 listed above are arranged similarly to the corresponding blocks of codec 2000 (described above in connection with FIG. 2) having reference numerals decreased by "50." Accordingly, signal flow between the functional blocks of codec 2050 is similar to signal flow between the corresponding blocks of codec 2000.

Codec 2050 operates in the following exemplary manner. Combiner 2054 combines a sampled input speech or audio signal s(n) with a feedback signal x(n) to produce a quantizer input signal u(n). Quantizer 2058 quantizes input signal u(n) to produce a quantized signal uq(n) associated with a quantization noise or error signal q(n). Combiner 2064 combines (that is, differences) signals u(n) and uq(n) to produce quantization error or noise signal q(n). Composite filter 2066 concurrently long-term and short-term filters noise signal q(n) to produce short-term and long-term filtered, feedback noise signal fq(n). Combiner 2056 combines short-term and long-term filtered, feedback noise signal fq(n) with a short-term and long-term prediction s(n) of input signal s(n) to produce feedback signal x(n). In codec 2050, combiner 2064, composite short-term and long-term filter 2066, and combiner 2056 together form a noise feedback loop around quantizer 2058. This noise feedback loop spectrally shapes the coding noise associated with codec 2050 in accordance with the composite filter, to follow, for example, the short-term and long-term spectral characteristics of input speech signal s(n).

Exiting quantizer 2058, combiner 2060 combines quantizer output signal uq(n) with the short-term and long-term predicted signal ps(n)' to produce a reconstructed output speech signal sq(n). Composite predictor 2062 short-term an long-term predicts input speech signal s(n) (to produce short-term and long-term predicted signal ps(n)) based on reconstructed output speech signal sq(n).

In this invention, the first approach for two-stage NFC described above achieves the goal by re-using the general codec structure of conventional single-stage noise feedback coding (for example, by re-using the structures of codecs 1000 and 2000) but combining what are conventionally separate short-term and long-term predictors into a single composite short-term and long-term predictor. A second preferred approach, described below, allows separate short-term and long-term predictors to be used, but requires a modification of the conventional codec structures 1000 and 2000 of FIGS. 1 and 2.

B. Codec Embodiments Using Separate Short-Term and Long-Term Predictors (Two-Stage Prediction) and Noise Feedback Coding It is not obvious how the codec structures in FIGS. 1 and 2 should be modified in order to achieve two-stage prediction and two-stage noise spectral shaping at the same time. For example, assuming the filters in FIG. 1 are all short-term filters, then, cascading a long-term analysis filter after the short-term analysis filter, cascading a long-term synthesis filter before the short-term synthesis filter, and cascading a long-term noise feedback filter to the short-term noise feedback filter in FIG. 1 will not give a codec that achieves the desired result.

To achieve two-stage prediction and two-stage noise spectral shaping at the same time without combining the two predictors into one, the key lies in recognizing that the quantizer block in FIGS. 1 and 2 can be replaced by a coding system based on long-term prediction. Illustrations of this concept are provided below.

1. Third Codec Embodiment—Two Stage Prediction With One Stage Noise Feedback

As an illustration of this concept, FIG. 3 shows a codec structure where the quantizer block 1008 in FIG. 1 has been replaced by a DPCM-type structure based on long-term prediction (enclosed by the dashed box and labeled as Q' in FIG. 3). FIG. 3 is a block diagram of a first exemplary arrangement of an example NFC structure or codec 3000, according to a third embodiment of the present invention.

Codec 3000 includes the following functional elements: a first short-term predictor 3002 (also referred to as a short-term predictor Ps(z)); a first combiner or adder 3004; a second combiner or adder 3006; predictive quantizer 3008 (also referred to as predictive quantizer Q'); a third combiner or adder 3010; a second short-term predictor 3012 (also referred to as a short-term predictor Ps(z)); a fourth combiner 3014; and a short-term noise feedback filter 3016 (also referred to as a short-term noise feedback filter Fs(z)).

Predictive quantizer Q' (3008) includes a first combiner 3024, either a scalar or a vector quantizer 3028, a second combiner 3030, and a long-term predictor 3034 (also referred to as a long-term predictor (Pl(z)).

Codec 3000 encodes a sampled input speech signal s(n) to produce a coded speech signal, and then decodes the coded speech signal to produce a reconstructed output speech signal sq(n), representative of the input speech signal s(n). Reconstructed speech signal sq(n) is associated with an overall coding noise r(n)=s(n)−sq(n). Codec 3000 operates in the following exemplary manner. First, a sampled input speech or audio signal s(n) is provided to a first input of combiner 3004, and to an input of predictor 3002. Predictor 3002 makes a short-term prediction of input speech signal s(n) based on past samples thereof to produce a predicted input speech signal ps(n). This process is referred to as short-term predicting input speech signal s(n) to produce predicted signal ps(n). Predictor 3002 provides predicted input speech signal ps(n) to a second input of combiner 3004. Combiner 3004 combines signals s(n) and ps(n) to produce a prediction residual signal d(n).

Combiner 3006 combines residual signal d(n) with a first noise feedback signal fqs(n) to produce a predictive quantizer input signal v(n). Predictive quantizer 3008 predictively quantizes input signal v(n) to produce a predictively quantized output signal vq(n) (also referred to as a predictive quantizer output signal vq(n)) associated with a predictive noise or error signal qs(n). Combiner 3014 combines (that is, differences) signals v(n) and vq(n) to produce the predictive quantization error or noise signal qs(n). Short-term filter 3016 short-term filters predictive quantization noise signal q(n) to produce the feedback noise signal fqs(n). Therefore, Noise Feedback (NF) codec 3000 includes an outer NF loop around predictive quantizer 3008, comprising combiner 3014, short-term noise filter 3016, and combiner 3006. This outer NF loop spectrally shapes the coding noise associated with codec 3000 in accordance with filter 3016, to follow, for example, the short-term spectral characteristics of input speech signal s(n).

Predictive quantizer 3008 operates within the outer NF loop mentioned above to predictively quantize predictive quantizer input signal v(n) in the following exemplary manner. Predictor 3034 long-term predicts (i.e., makes a long-term prediction of) predictive quantizer input signal v(n) to produce a predicted, predictive quantizer input signal pv(n). Combiner 3024 combines signal pv(n) with predictive quantizer input signal v(n) to produce a quantizer input signal u(n). Quantizer 3028 quantizes quantizer input signal u(n) using a scalar or vector quantizing technique, to produce a quantizer output signal uq(n). Combiner 3030 combines quantizer output signal uq(n) with signal pv(n) to produce predictively quantized output signal vq(n).

Exiting predictive quantizer 3008, combiner 3010 combines predictive quantizer output signal vq(n) with a prediction ps(n)' of input speech signal s(n) to produce output speech signal sq(n). Predictor 3012 short-term predicts (i.e., makes a short-term prediction of) input speech signal s(n) to produce signal ps(n)', based on output speech signal sq(n).

In the first exemplary arrangement of NF codec 3000 depicted in FIG. 3, predictors 3002, 3012 are short-term predictors and NF filter 3016 is a short-term noise filter, while predictor 3034 is a long-term predictor. In a second exemplary arrangement of NF codec 3000, predictors 3002, 3012 are long-term predictors and NF filter 3016 is a long-term filter, while predictor 3034 is a short-term predictor. The outer NF loop in this alternative arrangement spectrally shapes the coding noise associated with codec 3000 in accordance with filter 3016, to follow, for example, the long-term spectral characteristics of input speech signal s(n).

In the first arrangement described above, the DPCM structure inside the Q' dashed box (3008) does not perform long-term noise spectral shaping. If everything inside the Q' dashed box (3008) is treated as a black box, then for an observer outside of the box, the replacement of a direct quantizer (for example, quantizer 1008) by a long-term-prediction-based DPCM structure (that is, predictive quantizer Q' (3008)) is an advantageous way to improve the quantizer performance. Thus, compared with FIG. 1, the codec structure of codec 3000 in FIG. 3 will achieve the advantage of a lower coding noise, while maintaining the same kind of noise spectral envelope. In fact, the system 3000 in FIG. 3 is good enough for some applications when the bit rate is high enough and it is simple, because it avoids the additional complexity associated with long-term noise spectral shaping.

2. Fourth Codec Embodiment—Two Stage Prediction With Two Stage Noise Feedback (Nested Two Stage Feedback Coding)

Taking the above concept one step further, predictive quantizer Q' (3008) of codec 3000 in FIG. 3 can be replaced by the complete NFC structure of codec 1000 in FIG. 1. A resulting example "nested" or "layered" two-stage NFC codec structure 4000 is depicted in FIG. 4, and described below.

FIG. 4 is a block diagram of a first exemplary arrangement of the example nested two-stage NF coding structure or codec 4000, according to a fourth embodiment of the present invention. Codec 4000 includes the following functional elements: a first short-term predictor 4002 (also referred to as a short-term predictor Ps(z)); a first combiner or adder 4004; a second combiner or adder 4006; a predictive quantizer 4008 (also referred to as a predictive quantizer Q"); a third combiner or adder 4010; a second short-term predictor 4012 (also referred to as a short-term predictor Ps(z)); a fourth combiner 4014; and a short-term noise feedback filter 4016 (also referred to as a short-term noise feedback filter Fs(z)).

Predictive quantizer Q" (4008) includes a first long-term predictor 4022 (also referred to as a long-term predictor Pl(z)), a first combiner 4024, either a scalar or a vector quantizer 4028, a second combiner 4030, a second long-term predictor 4034 (also referred to as a long-term predictor (Pl(z)), a second combiner or adder 4036, and a long-term filter 4038 (also referred to as a long-term filter Fl(z)).

Codec 4000 encodes a sampled input speech signal s(n) to produce a coded speech signal, and then decodes the coded speech signal to produce a reconstructed output speech signal sq(n), representative of the input speech signal s(n). Reconstructed speech signal sq(n) is associated with an overall coding noise r(n)=s(n)−sq(n). In coding input speech signal s(n), predictors 4002 and 4012, combiners 4004, 4006, and 4010, and noise filter 4016 operate similarly to corresponding elements described above in connection with FIG. 3 having reference numerals decreased by "1000". Therefore, NF codec 4000 includes an outer or first stage NF loop comprising combiner 4014, short-term noise filter 4016, and combiner 4006. This outer NF loop spectrally shapes the coding noise associated with codec 4000 in accordance with filter 4016, to follow, for example, the short-term spectral characteristics of input speech signal s(n).

Predictive quantizer Q" (4008) operates within the outer NF loop mentioned above to predictively quantize predictive quantizer input signal v(n) to produce a predictively quantized output signal vq(n) (also referred to as a predictive quantizer output signal vq(n)) in the following exemplary manner. As mentioned above, predictive quantizer Q" has a structure corresponding to the basic NFC structure of codec 1000 depicted in FIG. 1. In operation, predictor 4022 long-term predicts predictive quantizer input signal v(n) to produce a predicted version pv(n) thereof. Combiner 4024 combines signals v(n) and pv(n) to produce an intermediate result signal i(n). Combiner 4026 combines intermediate result signal i(n) with a second noise feedback signal fq(n) to produce a quantizer input signal u(n). Quantizer 4028 quantizes input signal u(n) to produce a quantized output signal uq(n) (or quantizer output signal uq(n)) associated with a quantization error or noise signal q(n). Combiner 4036 combines (differences) signals u(n) and uq(n) to produce the quantization noise signal q(n). Long-term filter 4038 long-term filters the noise signal q(n) to produce feedback noise signal fq(n). Therefore, combiner 4036, long-term filter 4038 and combiner 4026 form an inner or second stage NF loop nested within the outer NF loop. This inner NF loop spectrally shapes the coding noise associated with codec 4000 in accordance with filter 4038, to follow, for example, the long-term spectral characteristics of input speech signal s(n).

Exiting quantizer 4028, combiner 4030 combines quantizer output signal uq(n) with a prediction pv(n)' of predictive quantizer input signal v(n). Long-term predictor 4034 long-term predicts signal v(n) (to produce predicted signal pv(n)') based on signal vq(n).

Exiting predictive quantizer Q" (4008), predictively quantized signal vq(n) is combined with a prediction ps(n)' of input speech signal s(n) to produce reconstructed speech signal sq(n). Predictor 4012 short term predicts input speech signal s(n) (to produce predicted signal ps(n)') based on reconstructed speech signal sq(n).

In the first exemplary arrangement of NF codec 4000 depicted in FIG. 4, predictors 4002 and 4012 are short-term predictors and NF filter 4016 is a short-term noise filter, while predictors 4022, 4034 are long-term predictors and noise filter 4038 is a long-term noise filter. In a second exemplary arrangement of NF codec 4000, predictors 4002, 4012 are long-term predictors and NF filter 4016 is a long-term noise filter (to spectrally shape the coding noise to follow, for example, the long-term characteristic of the input speech signal s(n)), while predictors 4022, 4034 are short-term predictors and noise filter 4038 is a short-term noise filter (to spectrally shape the coding noise to follow, for example, the short-term characteristic of the input speech signal s(n)).

In the first arrangement of codec 4000 depicted in FIG. 4, the dashed box labeled as Q" (predictive filter Q" (4008)) contains an NFC codec structure just like the structure of codec 1000 in FIG. 1, but the predictors 4022, 4034 and noise feedback filter 4038 are all long-term filters. Therefore, the quantization error qs(n) of the "predictive quantizer" Q" (4008) is simply the reconstruction error, or coding noise of the NFC structure inside the Q" dashed box 4008. Hence, from earlier equation, we have $$QS(z) = \frac{1 - Fl(z)}{1 - Pl(z)} Q(z).$$

Thus, the z-transform of the overall coding noise of codec 4000 in FIG. 4 is $$R(z) = S(z) - SQ(z) = \frac{1 - Fs(z)}{1 - Ps(z)} QS(z) = \frac{[1 - Fs(z)]}{[1 - Ps(z)]} \frac{[1 - Fl(z)]}{[1 - Pl(z)]} Q(z).$$

This proves that the nested two-stage NFC codec structure 4000 in FIG. 4 indeed performs both short-term and long-term noise spectral shaping, in addition to short-term and long-term prediction.

One advantage of nested two-stage NFC structure 4000 as shown in FIG. 4 is that it completely decouples long-term noise feedback coding from short-term noise feedback coding. This allows us to use different codec structures for long-term NFC and short-term NFC, as the following examples illustrate.

3. Fifth Codec Embodiment—Two Stage Prediction With Two Stage Noise Feedback (Nested Two Stage Feedback Coding)

Due to the above mentioned "decoupling" between the long-term and short-term noise feedback coding, predictive quantizer Q" (4008) of codec 4000 in FIG. 4 can be replaced by codec 2000 in FIG. 2, thus constructing another example nested two-stage NFC structure 5000, depicted in FIG. 5 and described below.

FIG. 5 is a block diagram of a first exemplary arrangement of the example nested two-stage NFC structure or codec 5000, according to a fifth embodiment of the present invention. Codec 5000 includes the following functional elements: a first short-term predictor 5002 (also referred to as a short-term predictor Ps(z)); a first combiner or adder 5004; a second combiner or adder 5006; a predictive quantizer 5008 (also referred to as a predictive quantizer Q'''); a third combiner or adder 5010; a second short-term predictor 5012 (also referred to as a short-term predictor Ps(z)); a fourth combiner 5014; and a short-term noise feedback filter 5016 (also referred to as a short-term noise feedback filter Fs(z)).

Predictive quantizer Q''' (5008) includes a first combiner 5024, a second combiner 5026, either a scalar or a vector quantizer 5028, a third combiner 5030, a long-term predictor 5034 (also referred to as a long-term predictor (Pl(z)), a fourth combiner 5036, and a long-term filter 5038 (also referred to as a long-term filter Nl(z)−1).

Codec 5000 encodes a sampled input speech signal s(n) to produce a coded speech signal, and then decodes the coded speech signal to produce a reconstructed output speech signal sq(n), representative of the input speech signal s(n). Reconstructed speech signal sq(n) is associated with an overall coding noise r(n)=s(n)−sq(n). In coding input speech signal s(n), predictors 5002 and 5012, combiners 5004, 5006, and 5010, and noise filter 5016 operate similarly to corresponding elements described above in connection with FIG. 3 having reference numerals decreased by "2000". Therefore, NF codec 5000 includes an outer or first stage NF loop comprising combiner 5014, short-term noise filter 5016, and combiner 5006. This outer NF loop spectrally shapes the coding noise associated with codec 5000 according to filter 5016, to follow, for example, the short-term spectral characteristics of input speech signal s(n).

Predictive quantizer 5008 has a structure similar to the structure of NF codec 2000 described above in connection with FIG. 2. Predictive quantizer Q''' (5008) operates within the outer NF loop mentioned above to predictively quantize a predictive quantizer input signal v(n) to produce a predictively quantized output signal vq(n) (also referred to as predicted quantizer output signal vq(n)) in the following exemplary manner. Predictor 5034 long-term predicts input signal v(n) based on output signal vq(n), to produce a predicted signal pv(n) (i.e., representing a prediction of signal v(n)). Combiners 5026 and 5024 collectively combine signal pv(n) with a noise feedback signal fq(n) and with input signal v(n) to produce a quantizer input signal u(n). Quantizer 5028 quantizes input signal u(n) to produce a quantized output signal uq(n) (also referred to as a quantizer output signal uq(n)) associated with a quantization error or noise signal q(n). Combiner 5036 combines (i.e., differences) signals u(n) and uq(n) to produce the quantization noise signal q(n). Filter 5038 long-term filters the noise signal q(n) to produce feedback noise signal fq(n). Therefore, combiner 5036, long-term filter 5038 and combiners 5026 and 5024 form an inner or second stage NF loop nested within the outer NF loop. This inner NF loop spectrally shapes the coding noise associated with codec 5000 in accordance with filter 5038, to follow, for example, the long-term spectral characteristics of input speech signal s(n).

In a second exemplary arrangement of NF codec 5000, predictors 5002, 5012 are long-term predictors and NF filter 5016 is a long-term noise filter (to spectrally shape the coding noise to follow, for example, the long-term characteristic of the input speech signal s(n)), while predictor 5034 is a short-term predictor and noise filter 5038 is a short-term noise filter (to spectrally shape the coding noise to follow, for example, the short-term characteristic of the input speech signal s(n)).

FIG. 5A is a block diagram of an alternative but mathematically equivalent signal combining arrangement 5050 corresponding to the combining arrangement including combiners 5024 and 5026 of FIG. 5. Combining arrangement 5050 includes a first combiner 5024' and a second combiner 5026'. Combiner 5024' receives predictive quantizer input signal v(n) and predicted signal pv(n) directly from predictor 5034. Combiner 5024' combines these two signals to produce an intermediate signal i(n)'. Combiner 5026' receives intermediate signal i(n)' and feedback noise signal fq(n) directly from noise filter 5038. Combiner 5026' combines these two received signals to produce quantizer input signal u(n). Therefore, equivalent combining arrangement 5050 is similar to the combining arrangement including combiners 5024 and 5026 of FIG. 5.

4. Sixth Codec Embodiment—Two Stage Prediction With Two Stage Noise Feedback (Nested Two Stage Feedback Coding)

In a further example, the outer layer NFC structure in FIG. 5 (i.e., all of the functional blocks outside of predictive quantizer Q''' (5008)) can be replaced by the NFC structure 2000 in FIG. 2, thereby constructing a further codec structure 6000, depicted in FIG. 6 and described below.

FIG. 6 is a block diagram of a first exemplary arrangement of the example nested two-stage NF coding structure or codec 6000, according to a sixth embodiment of the present invention. Codec 6000 includes the following functional elements: a first combiner 6004; a second combiner 6006; predictive quantizer Q''' (5008) described above in connection with FIG. 5; a third combiner or adder 6010; a short-term predictor 6012 (also referred to as a short-term predictor Ps(z)); a fourth combiner 6014; and a short-term noise feedback filter 6016 (also referred to as a short-term noise feedback filter Ns(z)−1).

Codec 6000 encodes a sampled input speech signal s(n) to produce a coded speech signal, and then decodes the coded speech signal to produce a reconstructed output speech signal sq(n), representative of the input speech signal s(n). Reconstructed speech signal sq(n) is associated with an overall coding noise r(n)=s(n)−sq(n). In coding input speech signal s(n), an outer coding structure depicted in FIG. 6, including combiners 6004, 6006, and 6010, noise filter 6016, and predictor 6012, operates in a manner similar to corresponding codec elements of codec 2000 described above in connection with FIG. 2 having reference numbers decreased by "4000." A combining arrangement including combiners 6004 and 6006 can be replaced by an equivalent combining arrangement similar to combining arrangement 5050 discussed in connection with FIG. 5A, whereby a combiner 6004' (not shown) combines signals s(n) and ps(n)' to produce a residual signal d(n) (not shown), and then a combiner 6006' (also not shown) combines signals d(n) and fqs(n) to produce signal v(n).

Unlike codec 2000, codec 6000 includes a predictive quantizer equivalent to predictive quantizer 5008 (described above in connection with FIG. 5, and depicted in FIG. 6 for descriptive convenience) to predictively quantize a predictive quantizer input signal v(n) to produce a quantized output signal vq(n). Accordingly, codec 6000 also includes a first stage or outer noise feedback loop to spectrally shape the coding noise to follow, for example, the short-term characteristic of the input speech signal s(n), and a second stage or inner noise feedback loop nested within the outer loop to spectrally shape the coding noise to follow, for example, the long-term characteristic of the input speech signal.

In a second exemplary arrangement of NF codec 6000, predictor 6012 is a long-term predictor and NF filter 6016 is a long-term noise filter, while predictor 5034 is a short-term predictor and noise filter 5038 is a short-term noise filter.

There is an advantage for such a flexibility to mix and match different single-stage NFC structures in different parts of the nested two-stage NFC structure. For example, although the codec 5000 in FIG. 5 mixes two different types of single-stage NFC structures in the two nested layers, it is actually the preferred embodiment of the current invention, because it has the lowest complexity among the three systems 4000, 5000, and 6000, respectively shown in FIGS. 4, 5 and 6.

To see the codec 5000 in FIG. 5 has the lowest complexity, consider the inner layer involving long-term NFC first. To get better long-term prediction performance, we normally use a three-tap pitch predictor of the kind used by Atal and Schroeder in their 1979 paper, rather than a simpler one-tap pitch predictor. With $Fl(z)=Pl(z/\beta)$, the long-term NFC structure inside the Q" dashed box has three long-term filters, each with three taps. In contract, by choosing the harmonic noise spectral shape to be the same as the frequency response of $$N(z)=1+\lambda z^{-p},$$

we have only a three-tap filter Pl(z) (5034) and a one-tap filter (5038) $N(z)-1=\lambda z^{-p}$ in the long-term NFC structure inside the Q''' dashed box (5008) of FIG. 5. Therefore, the inner layer Q''' (5008) of FIG. 5 has a lower complexity than the inner layer Q" (4008) of FIG. 4.

Now consider the short-term NFC structure in the outer layer of codec 5000 in FIG. 5. The short-term synthesis filter (including predictor 5012) to the right of the Q''' dashed box (5008) does not need to be implemented in the encoder (and all three decoders corresponding to FIGS. 4–6 need to implement it). The short-term analysis filter (including predictor 5002) to the left of the symbol d(n) needs to be implemented anyway even in FIG. 6 (although not shown there), because we are using d(n) to derive a weighted speech signal, which is then used for pitch estimation. Therefore, comparing the rest of the outer layer, FIG. 5 has only one short-term filter Fs(z) (5016) to implement, while FIG. 6 has two short-term filters. Thus, the outer layer of FIG. 5 has a lower complexity than the outer layer of FIG. 6.

5. Coding Method

Figure 6A:
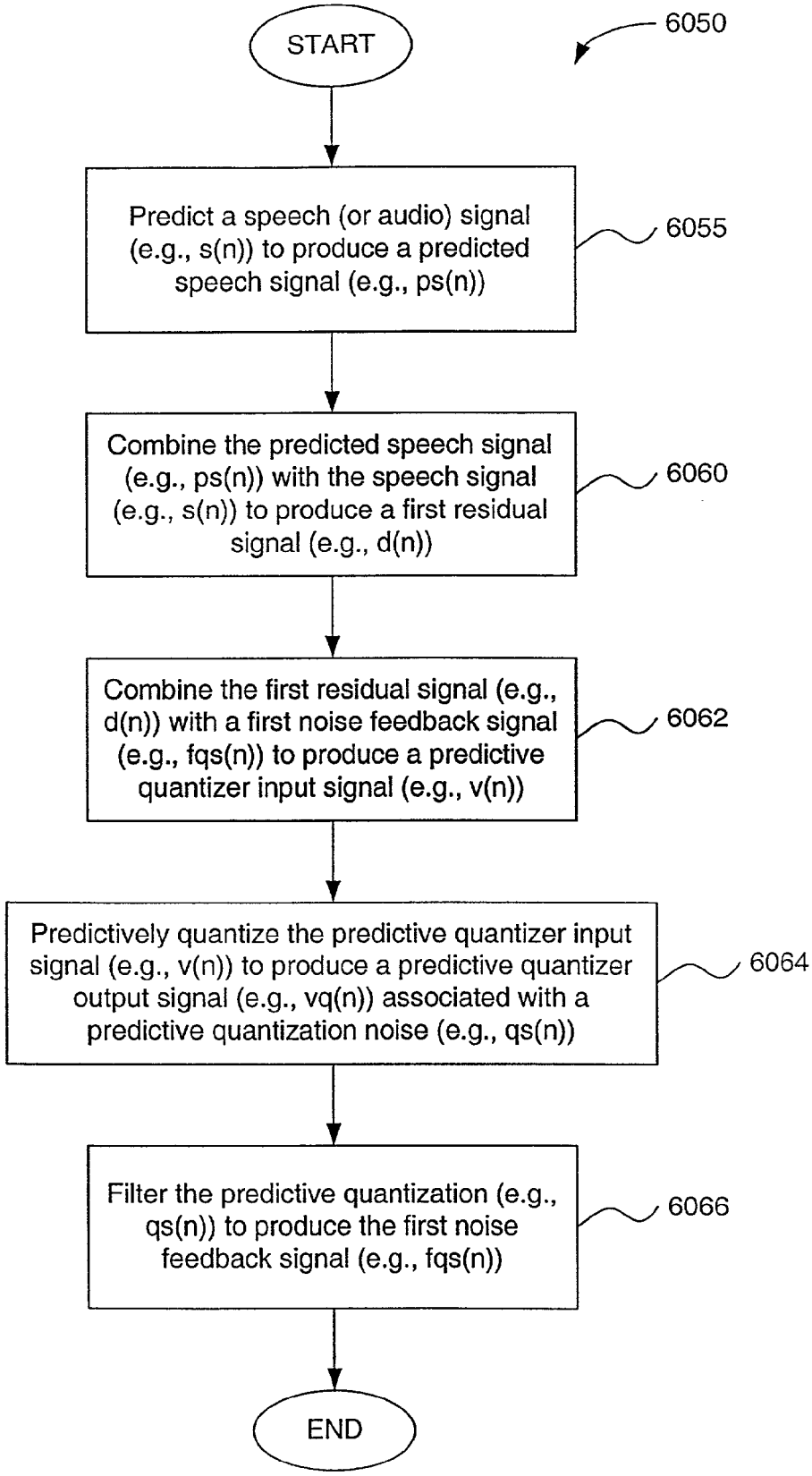
FIG. 6A is an example method of coding a speech or audio signal using any one of the codecs of FIGS. 3–6.

FIG. 6A is an example method 6050 of coding a speech or audio signal using any one of the example codecs 3000, 4000, 5000, and 6000 described above. In a first step 6055, a predictor (e.g., 3002 in FIG. 3, 4002 in FIG. 4, 5002 in FIG. 5 , or 6012 in FIG. 6) predicts an input speech or audio signal (e.g., s(n)) to produce a predicted speech signal (e.g., ps(n) or ps(n)').

In a next step 6060, a combiner (e.g., 3004, 4004, 5004, 6004/6006 or equivalents thereof) combines the predicted speech signal (e.g., ps(n)) with the speech signal (e.g., s(n)) to produce a first residual signal (e.g., d(n)).

In a next step 6062, a combiner (e.g., 3006, 4006, 5006, 6004/6006 or equivalents thereof) combines a first noise feedback signal (e.g., fqs(n)) with the first residual signal (e.g., d(n)) to produce a predictive quantizer input signal (e.g., v(n)).

In a next step 6064, a predictive quantizer (e.g., Q', Q", or Q''') predictively quantizes the predictive quantizer input signal (e.g., v(n)) to produce a predictive quantizer output signal (e.g., vq(n)) associated with a predictive quantization noise (e.g., qs(n)).

In a next step 6066, a filter (e.g., 3016, 4016, or 5016) filters the predictive quantization noise (e.g., qs(n)) to produce the first noise feedback signal (e.g., fqs(n)).

Figure 6B:
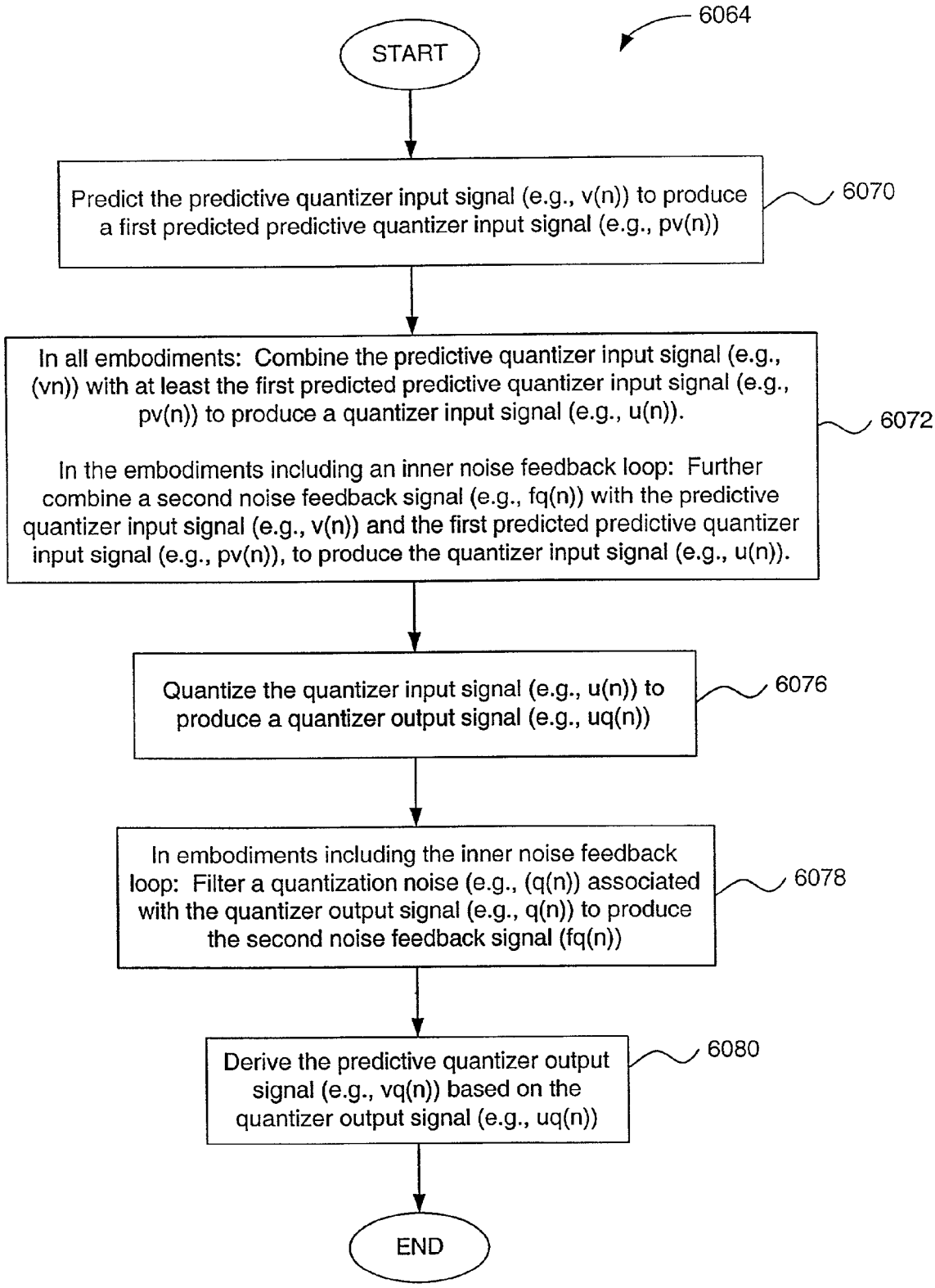
FIG. 6B is a detailed method corresponding to a predictive quantizing step of FIG. 6A.

FIG. 6B is a detailed method corresponding to predictive quantizing step 6064 described above. In a first step 6070, a predictor (e.g., 3034, 4022, or 5034) predicts the predictive quantizer input signal (e.g., v(n)) to produce a predicted predictive quantizer input signal (e.g., pv(n)).

In a next step 6072 used in all of the codecs 3000–6000, a combiner (e.g., 3024, 4024, 5024/5026 or an equivalent thereof, such as 5024') combines at least the predictive quantizer input signal (e.g., v(n)) with at least the first predicted predictive quantizer input signal (e.g., pv(n)) to produce a quantizer input signal (e.g., u(n)).

Additionally, the codec embodiments including an inner noise feedback loop (that is, exemplary codecs 4000, 5000, and 6000) use further combining logic (e.g., combiners 5026/5026' or 4026 or equivalents thereof)) to further combine a second noise feedback signal (e.g., fq(n)) with the predictive quantizer input signal (e.g., v(n)) and the first predicted predictive quantizer input signal (e.g., pv(n)), to produce the quantizer input signal (e.g., u(n)).

In a next step 6076, a scalar or vector quantizer (e.g., 3028, 4028, or 5028) quantizes the input signal (e.g., u(n)) to produce a quantizer output signal (e.g., uq(n)).

In a next step 6078 applying only to those embodiments including the inner noise feedback loop, a filter (e.g., 4038 or 5038) filters a quantization noise (e.g., q(n)) associated with the quantizer output signal (e.g., q(n)) to produce the second noise feedback signal (fq(n)).

In a next step 6080, deriving logic (e.g., 3034 and 3030 in FIG. 3, 4034 and 4030 in FIG. 4, and 5034 and 5030 in FIG. 5) derives the predictive quantizer output signal (e.g., vq(n)) based on the quantizer output signal (e.g., uq(n)).

III. Overview of Preferred Embodiment (Based on the Fifth Embodiment Above)

We now describe our preferred embodiment of the present invention. FIG. 7 shows an example encoder 7000 of the preferred embodiment. FIG. 8 shows the corresponding decoder. As can be seen, the encoder structure 7000 in FIG. 7 is based on the structure of codec 5000 in FIG. 5. The short-term synthesis filter (including predictor 5012) in FIG. 5 does not need to be implemented in FIG. 7, since its output is not used by encoder 7000. Compared with FIG. 5, only three additional functional blocks (10, 20, and 95) are added near the top of FIG. 7. These functional blocks (also singularly and collectively referred to as "parameter deriving logic") adaptively analyze and quantize (and thereby derive) the coefficients of the short-term and long-term filters. FIG. 7 also explicitly shows the different quantizer indices that are multiplexed for transmission to the communication channel. The decoder in FIG. 8 is essentially the same as the decoder of most other modem predictive codecs such as MPLPC and CELP. No postfilter is used in the decoder.

Coder 7000 and coder 5000 of FIG. 5 have the following corresponding functional blocks: predictors 5002 and 5034 in FIG. 5 respectively correspond to predictors 40 and 60 in FIG. 7; combiners 5004, 5006, 5014, 5024, 5026, 5030 and 5036 in FIG. 5 respectively correspond to combiners 45, 55, 90, 75, 70, 85 and 80 in FIG. 7; filters 5016 and 5038 in FIG. 5 respectively correspond to filters 50 and 65 in FIG. 7; quantizer 5028 in FIG. 5 corresponds to quantizer 30 in FIG. 7; signals vq(n), pv(n), fqs(n), and fq(n) in FIG. 5 respectively correspond to signals dq(n), ppv(n), stnf(n), and ltnf(n) in FIG. 7; signals sharing the same reference labels in FIG.5 and FIG. 7 also correspond to each other. Accordingly, the operation of codec 5000 described above in connection with FIG. 5 correspondingly applies to codec 7000 of FIG. 7.

IV. Short-Term Linear Predictive Analysis and Quantization

We now give a detailed description of the encoder operations. Refer to FIG. 7. The input signal s(n) is buffered at block 10, which performs short-term linear predictive analysis and quantization to obtain the coefficients for the short-term predictor 40 and the short-term noise feedback filter 50. This block 10 is further expanded in FIG. 9. The processing blocks within FIG. 9 all employ well-known prior-art techniques.

Refer to FIG. 9. The input signal s(n) is buffered at block 11, where it is multiplied by an analysis window that is 20 ms in length. If the coding delay is not critical, then a frame size of 20 ms and a sub-frame size of 5 ms can be used, and the analysis window can be a symmetric window centered at the mid-point of the last sub-frame in the current frame. In our preferred embodiment of the codec, however, we want the coding delay to be as small as possible; therefore, the frame size and the sub-frame size are both selected to be 5 ms, and no look ahead is allowed beyond the current frame. In this case, an asymmetric window is used. The "left window" is 17.5 ms long, and the "right window" is 2.5 ms long. The two parts of the window concatenate to give a total window length of 20 ms. Let LWINSZ be the number of samples in the left window (LWINSZ=140 for 8 kHz sampling and 280 for 16 kHz sampling), then the left window is given by $$wl(n) = \frac{1}{2}\left[1 - \cos\left(\frac{n\pi}{LWINSZ+1}\right)\right], \quad n = 1, 2, \ldots, LWINSZ.$$

Let RWINSZ be the number of samples in the right window. Then, RWINSZ=20 for 8 kHz sampling and 40 for 16 kHz sampling. The right window is given by $$wr(n) = \cos\left(\frac{(n-1)\pi}{2RWINSZ}\right), \quad n = 1, 2, \ldots, RWINSZ.$$

The concatenation of wl(n) and wr(n) gives the 20 ms asymmetric analysis window. When applying this analysis window, the last sample of the window is lined up with the last sample of the current frame, so there is no look ahead.

After the 5 ms current frame of input signal and the preceding 15 ms of input signal in the previous three frames are multiplied by the 20 ms window, the resulting signal is used to calculate the autocorrelation coefficients r(i), for lags i=0, 1, 2, . . . , M, where M is the short-term predictor order, and is chosen to be 8 for both 8 kHz and 16 kHz sampled signals.

The calculated autocorrelation coefficients are passed to block 12, which applies a Gaussian window to the autocorrelation coefficients to perform the well-known prior-art method of spectral smoothing. The Gaussian window function is given by $$gw(i) = e^{-\frac{(2\pi i\sigma/f_s)^2}{2}}, \; i = 0, 1, 2, \ldots M,$$

where $f_s$ is the sampling rate of the input signal, expressed in Hz, and σ is 40 Hz.

After multiplying r(i) by such a Gaussian window, block 12 then multiplies r(0) by a white noise correction factor of WNCF=1+ϵ, where ϵ=0.0001. In summary, the output of block 12 is given by $$\hat{r}(i) = \begin{cases} (1+\varepsilon)r(0), & i = 0 \\ gw(i)r(i), & i = 1, 2, \ldots, M \end{cases}$$

The spectral smoothing technique smoothes out (widens) sharp resonance peaks in the frequency response of the short-term synthesis filter. The white noise correction adds a white noise floor to limit the spectral dynamic range. Both techniques help to reduce ill conditioning in the Levinson-Durbin recursion of block 13.

Block 13 takes the autocorrelation coefficients modified by block 12, and performs the well-known prior-art method of Levinson-Durbin recursion to convert the autocorrelation coefficients to the short-term predictor coefficients $\hat{a}_i$, i=0, 1, . . . , M. Block 14 performs bandwidth expansion of the resonance spectral peaks by modifying $\hat{a}_i$ as $$a_i = \gamma^i \hat{a}_i,$$

for i=0, 1, . . . , M. In our particular implementation, the parameter γ is chosen as 0.96852.

Block 15 converts the $\{a_i\}$ coefficients to Line Spectrum Pair (LSP) coefficients $\{l_i\}$, which are sometimes also referred to as Line Spectrum Frequencies (LSFs). Again, the operation of block 15 is a well-known prior-art procedure.

Block 16 quantizes and encodes the M LSP coefficients to a pre-determined number of bits. The output LSP quantizer index array LSPI is passed to the bit multiplexer (block 95), while the quantized LSP coefficients are passed to block 17. Many different kinds of LSP quantizers can be used in block 16. In our preferred embodiment, the quantization of LSP is based on inter-frame moving-average (MA) prediction and multi-stage vector quantization, similar to (but not the same as) the LSP quantizer used in the ITU-T Recommendation G.729.

Block 16 is further expanded in FIG. 10. Except for the LSP quantizer index array LSPI, all other signal paths in FIG. 10 are for vectors of dimension M. Block 161 uses the unquantized LSP coefficient vector to calculate the weights to be used later in VQ codebook search with weighted mean-square error (WMSE) distortion criterion. The weights are determined as $$w_i = \begin{cases} 1/(l_2 - l_1), & i = 1 \\ 1/\min(l_1 - l_{i-1}, l_{i+1} - l_i), & 1 < i < M \\ 1/(l_M - l_{M-1}), & i = M \end{cases}.$$

Basically, the i-th weight is the inverse of the distance between the i-th LSP coefficient and its nearest neighbor LSP coefficient. These weights are different from those used in G.729.

Block 162 stores the long-term mean value of each of the M LSP coefficients, calculated off-line during codec design phase using a large training data file. Adder 163 subtracts the LSP mean vector from the unquantized LSP coefficient vector to get the mean-removed version of it. Block 164 is the inter-frame MA predictor for the LSP vector. In our preferred embodiment, the order of this MA predictor is 8. The 8 predictor coefficients are fixed and pre-designed off-line using a large training data file. With a frame size of 5 ms, this $8^{th}$-order predictor covers a time span of 40 ms, the same as the time span covered by the $4^{th}$-order MA predictor of LSP used in G.729, which has a frame size of 10 ms.

Block 164 multiplies the 8 output vectors of the vector quantizer block 166 in the previous 8 frames by the 8 sets of 8 fixed MA predictor coefficients and sum up the result. The resulting weighted sum is the predicted vector, which is subtracted from the mean-removed unquantized LSP vector by adder 165. The two-stage vector quantizer block 166 then quantizes the resulting prediction error vector.

The first-stage VQ inside block 166 uses a 7-bit codebook (128 codevectors). For the narrowband (8 kHz sampling) codec at 16 kb/s, the second-stage VQ also uses a 7-bit codebook. This gives a total encoding rate of 14 bits/frame for the 8 LSP coefficients of the 16 kb/s narrowband codec. For the wideband (16 kHz sampling) codec at 32 kb/s, on the other hand, the second-stage VQ is a split VQ with a 3-5 split. The first three elements of the error vector of first-stage VQ are vector quantized using a 5-bit codebook, and the remaining 5 elements are vector quantized using another 5-bit codebook. This gives a total of (7+5+5)=17 bits/frame encoding rate for the 8 LSP coefficients of the 32 kb/s wideband codec. The selected codevectors from the two VQ stages are added together to give the final output quantized vector of block 166.

During codebook searches, both stages of VQ within block 166 use the WMSE distortion measure with the weights $\{w_l\}$ calculated by block 161. The codebook indices for the best matches in the two VQ stages (two indices for 16 kb/s narrowband codec and three indices for 32 kb/s wideband codec) form the output LSP index array LSPI, which is passed to the bit multiplexer block 95 in FIG. 7.

The output vector of block 166 is used to update the memory of the inter-frame LSP predictor block 164. The predicted vector generated by block 164 and the LSP mean vector held by block 162 are added to the output vector of block 166, by adders 167 and 168, respectively. The output of adder 168 is the quantized and mean-restored LSP vector.

It is well known in the art that the LSP coefficients need to be in a monotonically ascending order for the resulting synthesis filter to be stable. The quantization performed in FIG. 10 may occasionally reverse the order of some of the adjacent LSP coefficients. Block 169 check for correct ordering in the quantized LSP coefficients, and restore correct ordering if necessary. The output of block 169 is the final set of quantized LSP coefficients $\{\hat{l}_i\}$.

Now refer back to FIG. 9. The quantized set of LSP coefficients $\{\hat{l}_i\}$, which is determined once a frame, is used by block 17 to perform linear interpolation of LSP coefficients for each sub-frame within the current frame. In a general coding scheme based on the current invention, there may be two or more sub-frames per frame. For example, the sub-frame size can stay at 5 ms, while the frame size can be 10 ms or 20 ms. In this case, the linear interpolation of LSP coefficients is a well-known prior art. In the preferred embodiment of the current invention, to keep the coding delay low, the frame size is chosen to be 5 ms, the same as the sub-frame size. In this degenerate case, block 17 can be omitted. This is why it is shown in dashed box.

Block 18 takes the set of interpolated LSP coefficients $\{l_i\}$ and converts it to the corresponding set of direct-form linear predictor coefficients $\{\tilde{a}_i\}$ for each sub-frame. Again, such a conversion from LSP coefficients to predictor coefficients is well known in the art. The resulting set of predictor coefficients $\{\tilde{a}_i\}$ are used to update the coefficients of the short-term predictor block 40 in FIG. 7.

Block 19 performs further bandwidth expansion on the set of predictor coefficients $\{\tilde{a}_i\}$ using a bandwidth expansion factor of $\gamma_1$=0.75. The resulting bandwidth-expanded set of filter coefficients is given by $$\acute{a}_i = \gamma_1^i \tilde{a}_i, \text{ for } i=0, 1, 2, \ldots M.$$

This bandwidth-expanded set of filter coefficients $\{\acute{a}_i\}$ are used to update the coefficients of the short-term noise feedback filter block 50 in FIG. 7 and the coefficients of the weighted short-term synthesis filter block 21 in FIG. 11 (to be discussed later). This completes the description of short-term predictive analysis and quantization block 10 in FIG. 7.

V. Short-Term Linear Prediction of Input Signal

Now refer to FIG. 7 again. Except for block 10 and block 95, whose operations are performed once a frame, the operations of most of the rest of the blocks in FIG. 7 are performed once a sub-frame, unless otherwise noted. The short-term predictor block 40 predicts the input signal sample s(n) based on a linear combination of the preceding M samples. The adder 45 subtracts the resulting predicted value from s(n) to obtain the short-term prediction residual signal, or the difference signal, d(n). Specifically, $$d(n) = s(n) - \sum_{i=1}^{M} \tilde{a}_i s(n-i).$$

VI. Long-Term Linear Predictive Analysis and Quantization

The long-term predictive analysis and quantization block 20 uses the short-term prediction residual signal {d(n)} of the current sub-frame and its quantized version {dq(n)} in the previous sub-frames to determine the quantized values of the pitch period and the pitch predictor taps. This block 20 is further expanded in FIG. 11.

Now refer to FIG. 11. The short-term prediction residual signal d(n) passes through the weighted short-term synthesis filter block 21, whose output is calculated as $$dw(n) = d(n) + \sum_{i=1}^{M} a_i' dw(n-i)$$

The signal dw(n) is basically a perceptually weighted version of the input signal s(n), just like what is done in CELP codecs. This dw(n) signal is passed through a low-pass filter block 22, which has a −3 dB cut off frequency at about 800 Hz. In the preferred embodiment, a $4^{th}$-order elliptic filter is used for this purpose. Block 23 down-samples the low-pass filtered signal to a sampling rate of 2 kHz. This represents a 4:1 decimation for the 16 kb/s narrowband codec or 8:1 decimation for the 32 kb/s wide-band codec.

The first-stage pitch search block 24 then uses the decimated 2 kHz sampled signal dwd(n) to find a "coarse pitch period", denoted as cpp in FIG. 11. A pitch analysis window of 10 ms is used. The end of the pitch analysis window is lined up with the end of the current sub-frame. At a sampling rate of 2 kHz, 10 ms correspond to 20 samples. Without loss of generality, let the index range of n=1 to n=20 correspond to the pitch analysis window for dwd(n). Block 24 first calculates the following correlation function and energy values $$c(k) = \sum_{n=1}^{20} dwd(n)dwd(n-k)$$

$$E(k) = \sum_{n=1}^{20} dw(d(n-k))^2$$

for k=MINPPD−1 to k=MAXPPD 1, where MINPPD and MAXPPD are the minimum and maximum pitch period in the decimated domain, respectively.

For the narrowband codec, MINPPD=4 samples and MAXPPD=36 samples. For the wideband codec, MINPPD=2 samples and MAXPPD=34 samples. Block 24 then searches through the calculated {c(k)} array and identifies all positive local peaks in the {c(k)} sequence. Let $K_p$ denote the resulting set of indices $k_p$ where $c(k_p)$ is a positive local peak, and let the elements in $K_p$ be arranged in an ascending order.

If there is no positive local peak at all in the {c(k)} sequence, the processing of block 24 is terminated and the output coarse pitch period is set to cpp=MINPPD. If there is at least one positive local peak, then the block 24 searches through the indices in the set $K_p$ and identifies the index $k_p$ that maximizes $c(k_p)^2/E(k_p)$. Let the resulting index be $k_p$*.

To avoid picking a coarse pitch period that is around an integer multiple of the true coarse pitch period, the following simple decision logic is used.

1. If $k_p$* corresponds to the first positive local peak (i.e. it is the first element of $K_p$), use $k_p$* as the final output cpp of block 24 and skip the rest of the steps.
2. Otherwise, go from the first element of $K_p$ to the element of $K_p$ that is just before the element $k_p$*, find the first $k_p$ in $K_p$ that satisfies $c(k_p)^2/E(k_p) > T_1[c(k_p^*)^2/E(k_p^*)]$, where $T_1$=0.7. The first $k_p$ that satisfies this condition is the final output cpp of block 24.
3. If none of the elements of $K_p$ before $k_p$* satisfies the inequality in 2. above, find the first $k_p$ in $K_p$ that satisfies the following two conditions:

$$c(k_p)^2/E(k_p) > T_2[c(k_p^*)^2/E(k_p^*)],$$

where $T_2$=0.39, and $$|k_p - cpp'| \leq T_3 cpp',$$

where $T_3$=0.25, and cpṕ is the block 24 output cpp for the last sub-frame.

The first $k_p$ that satisfies these two conditions is the final output cpp of block 24.

4. If none of the elements of $K_p$ before $k_p$* satisfies the inequalities in 3. above, then use $k_p$* as the final output cpp of block 24.

Block 25 takes cpp as its input and performs a second-stage pitch period search in the undecimated signal domain to get a refined pitch period pp. Block 25 first converts the coarse pitch period cpp to the undecimated signal domain by multiplying it by the decimation factor DECF. (This decimation factor DECF=4 and 8 for narrowband and wideband codecs, respectively). Then, it determines a search range for the refined pitch period around the value cpp*DECF. The lower bound of the search range is lb=max(MINPP, cpp*DECF−DECF+1), where MINPP=17 samples is the minimum pitch period. The upper bound of the search range is ub=min(MAXPP, cpp*DECF+DECF−1), where MAXPP is the maximum pitch period, which is 144 and 272 samples for narrowband and wideband codecs, respectively.

Block 25 maintains a signal buffer with a total of MAXPP+1+SFRSZ samples, where SFRSZ is the sub-frame size, which is 40 and 80 samples for narrowband and wideband codecs, respectively. The last SFRSZ samples of this buffer are populated with the open-loop short-term prediction residual signal d(n) in the current sub-frame. The first MAXPP+1 samples are populated with the MAXPP+1 samples of quantized version of d(n), denoted as dq(n), immediately preceding the current sub-frame. For convenience of equation writing later, we will use dq(n) to denote the entire buffer of MAXPP+1+SFRSZ samples, even though the last SFRSZ samples are really d(n) samples. Again, without loss of generality, let the index range from n=1 to n=SFRSZ denotes the samples in the current sub-frame.

After the lower bound lb and upper bound ub of the pitch period search range are determined, block 25 calculates the following correlation and energy terms in the undecimated dq(n) signal domain for time lags k within the search range [lb, ub].

$$\tilde{c}(k) = \sum_{n=1}^{SFRSZ} dq(n)dq(n-k)$$

$$\tilde{E}(k) = \sum_{n=1}^{SFRSZ} d(q(n-k))^2$$

The time lag k∈[lb, ub] that maximizes the ratio $\tilde{c}^2(k)/\tilde{E}(k)$ is chosen as the final refined pitch period. That is, $$pp = \max_{k\in[lb,ub]}{}^{-1}\left[\frac{\tilde{c}^2(k)}{\tilde{E}(k)}\right].$$

Once the refined pitch period pp is determined, it is encoded into the corresponding output pitch period index PPI, calculated as $$PPI=pp-17$$

Possible values of PPI are 0 to 127 for the narrowband codec and 0 to 255 for the wideband codec. Therefore, the refined pitch period pp is encoded into 7 bits or 8 bits, without any distortion.

Block 25 also calculates ppt1, the optimal tap weight for a single-tap pitch predictor, as follows $$ppt1 = \frac{\tilde{c}(pp)}{\tilde{E}(pp)}.$$

Block 27 calculates the long-term noise feedback filter coefficient λ as follows.

$$\lambda = \begin{cases} LTWF, & ppt1 \geq 1 \\ LTWF * ppt1, & 0 < ppt1 < 1 \\ 0 & ppt1 \leq 0 \end{cases}$$

Pitch predictor taps quantizer block 26 quantizes the three pitch predictor taps to 5 bits using vector quantization. Rather than minimizing the mean-square error of the three taps as in conventional VQ codebook search, block 26 finds from the VQ codebook the set of candidate pitch predictor taps that minimizes the pitch prediction residual energy in the current sub-frame. Using the same dq(n) buffer and time index convention as in block 25, and denoting the set of three taps corresponding to the j-th codevector as $\{b_{j1},b_{j2},b_{j3}\}$, we can express such pitch prediction residual energy as $$E_j = \sum_{n=1}^{SFRSZ}\left[dq(n) - \sum_{i=1}^{3} b_{ji}dq(n-pp+2-i)\right]^2.$$

This equation can be re-written as $$E_j = \sum_{n=1}^{SFRSZ} dq^2(n) = p^T x_j,$$

where $$x_j=[2b_{j1},2b_{j2},2b_{j3},-2b_{j1}b_{j2},-2b_{j2}b_{j3},-2b_{j3}b_{j1},-b_{j1}^2,-b_{j2}^2,-b_{j3}^2]^T,$$

$$p^T=[v_1,v_2,v_3,\phi_{12},\phi_{23},\phi_{31},\phi_{11},\phi_{22},\phi_{33}],$$

$$v_i = \sum_{n=1}^{SFRSZ} dq(n)dq(n-pp+2-i),$$

and $$\phi_{ij} = \sum_{n=1}^{SFRSZ} dq(n-pp+2-i)dq(n-pp+2-j).$$

In the codec design stage, the optimal three-tap codebooks $\{b_{j1}, b_{j2}, b_{j3}\}$, j=0, 1, 2, . . . , 31 are designed off-line. The corresponding 9-dimensional codevectors $x_j$, j=0, 1, 2, . . . , 31 are calculated and stored in a codebook. In actual encoding, block 26 first calculates the vector $p^T$, then it calculates the 32 inner products $p^Tx_j$ for j=0, 1, 2, . . . , 31. The codebook index j* that maximizes such an inner product also minimizes the pitch prediction residual energy $E_j$. Thus, the output pitch predictor taps index PPTI is chosen as $$PPTI=j^*={}_j max^{-1}(p^Tx_j).$$

The corresponding vector of three quantized pitch predictor taps, denoted as ppt in FIG. 11, is obtained by multiplying the first three elements of the selected codevector $X_{j*}$ by 0.5.

Once the quantized pitch predictor taps have been determined, block 28 calculates the open-loop pitch prediction residual signal e(n) as follows.

$$e(n) = dq(n) - \sum_{i=1}^{3} b_{j\times i}dq(n-pp+2-i)$$

Again, the same dq(n) buffer and time index convention of block 25 is used here. That is, the current sub-frame of dq(n) for n=1, 2, . . . , SFRSZ is actually the unquantized open-loop short-term prediction residual signal d(n).

This completes the description of block 20, long-term predictive analysis and quantization.

VII. Quantization of Residual Gain

The open-loop pitch prediction residual signal e(n) is used to calculate the residual gain. This is done inside the prediction residual quantizer block 30 in FIG. 7. Block 30 is further expanded in FIG. 12.

Refer to FIG. 12. Block 301 calculates the residual gain in the base-2 logarithmic domain. Let the current sub-frame corresponds to time indices from n=1 to n=SFRSZ. For the narrowband codec, the logarithmic gain (log-gain) is calculated once a sub-frame as $$lg = \log_2\left[\frac{1}{SFRSZ}\sum_{n=1}^{SFRSZ} e^2(n)\right].$$

For the wideband codec, on the other hand, two log-gains are calculated for each sub-frame. The first log-gain is calculated as $$lg(1) = \log_2\left[\frac{2}{SFRSZ}\sum_{n=1}^{SFRSZ/2} e^2(n)\right]$$

and the second log-gain is calculated as $$lg(2) = \log_2\left[\frac{2}{SFRSZ}\sum_{n=SFRSZ/2+1}^{SFRSZ} e^2(n)\right].$$

Lacking a better name, we will use the term "gain frame" to refer to the time interval over which a residual gain is calculated. Thus, the gain frame size is SFRSZ for the narrowband codec and SFRSZ/2 for the wideband codec. All the operations in FIG. 12 are done on a once-per-gain-frame basis.

The long-term mean value of the log-gain is calculated off-line and stored in block 302. The adder 303 subtracts this long-term mean value from the output log-gain of block 301 to get the mean-removed version of the log-gain. The MA log-gain predictor block 304 is an FIR filter, with order 8 for the narrowband codec and order 16 for the wideband codec. In either case, the time span covered by the log-gain predictor is 40 ms. The coefficients of this log-gain predictor are pre-determined off-line and held fixed. The adder 305 subtracts the output of block 304, which is the predicted log-gain, from the mean-removed log-gain. The scalar quantizer block 306 quantizes the resulting log-gain prediction residual. The narrowband codec uses a 4-bit quantizer, while the wideband codec uses a 5-bit quantizer here.

The gain quantizer codebook index GI is passed to the bit multiplexer block 95 of FIG. 7. The quantized version of the log-gain prediction residual is passed to block 304 to update the MA log-gain predictor memory. The adder 307 adds the predicted log-gain to the quantized log-gain prediction residual to get the quantized version of the mean-removed log-gain. The adder 308 then adds the log-gain mean value to get the quantized log-gain, denoted as qlg.

Block 309 then converts the quantized log-gain to the quantized residual gain in the linear domain as follows:

$$g=2^{qlg/2}.$$

Block 310 scales the residual quantizer codebook. That is, it multiplies all entries in the residual quantizer codebook by g. The resulting scaled codebook is then used by block 311 to perform residual quantizer codebook search.

The prediction residual quantizer in the current invention of TSNFC can be either a scalar quantizer or a vector quantizer. At a given bit-rate, using a scalar quantizer gives a lower codec complexity at the expense of lower output quality. Conversely, using a vector quantizer improves the output quality but gives a higher codec complexity. A scalar quantizer is a suitable choice for applications that demand very low codec complexity but can tolerate higher bit rates. For other applications that do not require very low codec complexity, a vector quantizer is more suitable since it gives better coding efficiency than a scalar quantizer.

In the next two sections, we describe the prediction residual quantizer codebook search procedures in the current invention, first for the case of scalar quantization in SQ-TSNFC, and then for the case of vector quantization in VQ-TSNFC. The codebook search procedures are very different for the two cases, so they need to be described separately.

VIII. Scalar Quantization of Linear Prediction Residual Signal

If the residual quantizer is a scalar quantizer, the encoder structure of FIG. 7 is directly used as is, and blocks 50 through 90 operate on a sample-by-sample basis. Specifically, the short-term noise feedback filter block 50 of FIG. 7 uses its filter memory to calculate the current sample of the short-term noise feedback signal stnf(n) as follows.

$$stnf(n) = \sum_{i=1}^{M} a_i' qs(n-i)$$

The adder 55 adds stnf(n) to the short-term prediction residual d(n) to get v(n).

$$v(n)=d(n)+stnf(n)$$

Next, using its filter memory, the long-term predictor block 60 calculates the pitch-predicted value as $$ppv(n) = \sum_{i=1}^{3} b_{j+i} dq(n-pp+2-i),$$

and the long-term noise feedback filter block 65 calculates the long-term noise feedback signal as $$ltnf(n)=\lambda q(n-pp).$$

The adders 70 and 75 together calculates the quantizer input signal u(n) as $$u(n)=v(n)-[ppv(n)+ltnf(n)].$$

Next, Block 311 of FIG. 12 quantizes u(n) by simply performing the codebook search of a conventional scalar quantizer. It takes the current sample of the unquantized signal u(n), find the nearest neighbor from the scaled codebook provided by block 310, passes the corresponding codebook index CI to the bit multiplexer block 95 of FIG. 7, and passes the quantized value uq(n) to the adders 80 and 85 of FIG. 7.

The adder 80 calculates the quantization error of the quantizer block 30 as $$q(n)=u(n)-uq(n).$$

This q(n) sample is passed to block 65 to update the filter memory of the long-term noise feedback filter.

The adder 85 adds ppv(n) to uq(n) to get dq(n), the quantized version of the current sample of the short-term prediction residual.

$$dq(n)=uq(n)+ppv(n)$$

This dq(n) sample is passed to block 60 to update the filter memory of the long-term predictor.

The adder 90 calculates the current sample of qs(n) as $$qs(n)=v(n)-dq(n)$$

and then passes it to block 50 to update the filter memory of the short-term noise feedback filter. This completes the sample-by-sample quantization feedback loop.

We found that for speech signals at least, if the prediction residual scalar quantizer operates at a bit rate of 2 bits/sample or higher, the corresponding SQ-TSNFC codec output has essentially transparent quality.

IX. Vector Quantization of Linear Prediction Residual Signal

If the residual quantizer is a vector quantizer, the encoder structure of FIG. 7 cannot be used directly as is. An alternative approach and alternative structures need to be used. To see this, consider a conventional vector quantizer with a vector dimension K. Normally, an input vector is presented to the vector quantizer, and the vector quantizer searches through all codevectors in its codebook to find the nearest neighbor to the input vector. The winning codevector is the VQ output vector, and the corresponding address of that codevector is the quantizer out codebook index. If such a conventional VQ scheme is to be used with the codec structure in FIG. 7, then we need to determine K samples of the quantizer input u(n) at a time. Determining the first sample of u(n) in the VQ input vector is not a problem, as we have already shown how to do that in the last section. However, the second through the K-th samples of the VQ input vector cannot be determined, because they depend on the first through the (K−1)-th samples of the VQ output vector of the signal uq(n), which have not been determined yet.

The present invention avoids this chicken-and-egg problem by modifying the VQ codebook search procedure, as described below beginning with reference to FIG. 13A.

A. General VQ Search

1. High-Level Embodiment a. System

Figure 13A:
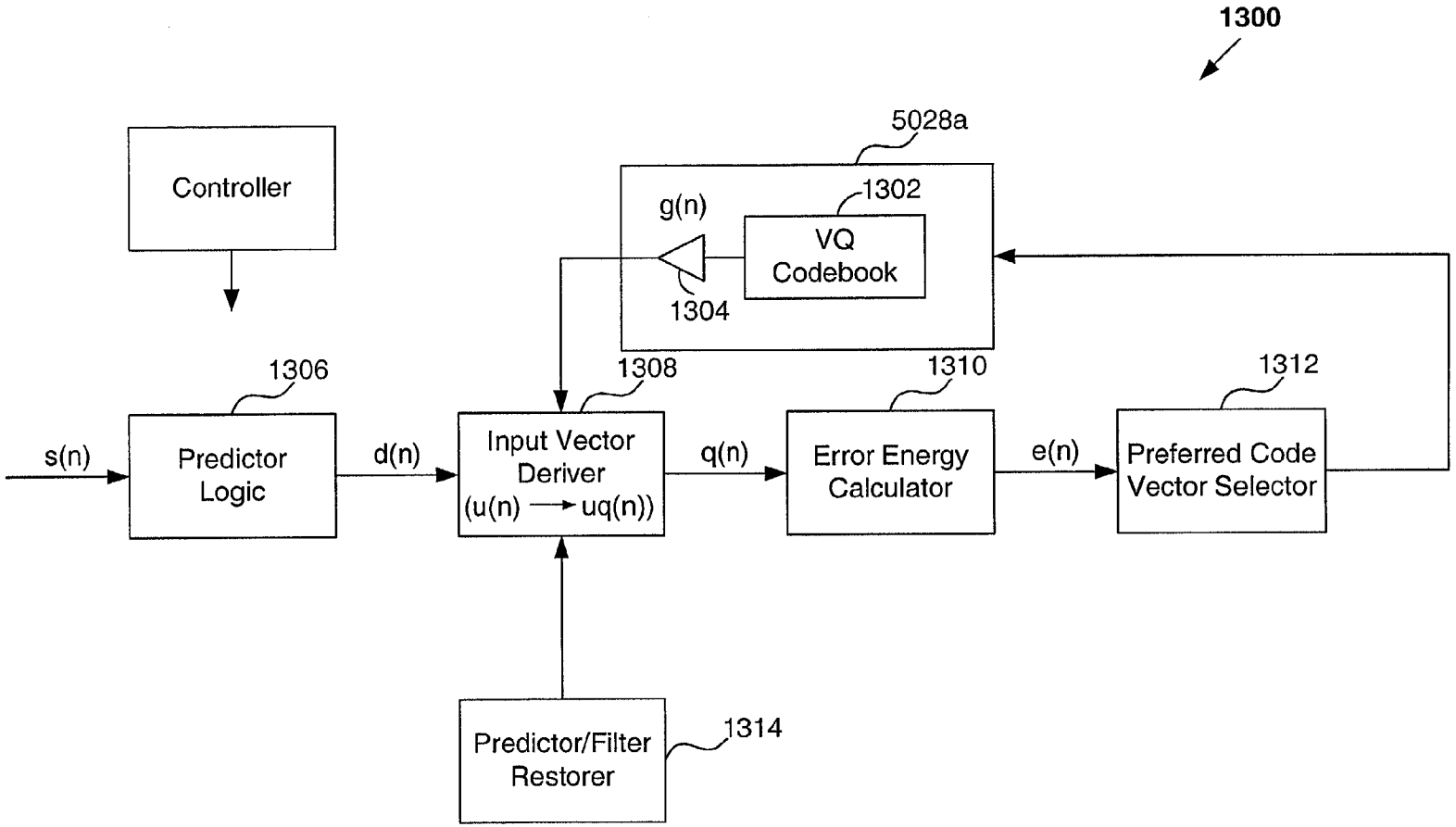
FIG. 13A is a block diagram of an example NFC system for searching through N VQ codevectors stored in a VQ codebook for a preferred one of the N VQ codevectors to be used for coding a speech or audio signal.

FIG. 13A is a block diagram of an example Noise Feedback Coding (NFC) system 1300 for searching through N VQ codevectors, stored in a scaled VQ codebook 5028a, for a preferred one of the N VQ codevectors to be used for coding a speech or audio signal s(n). System 1300 includes scaled VQ codebook 5028*a* including a VQ codebook 1302 and a gain scaling unit 1304. Scaled VQ codebook 5028*a* corresponds to quantizer 3028, 4028, 5028, or 30, described above in connection with FIGS. 3, 4, 5, or 7, respectively.

VQ codebook 1302 includes N VQ codevectors. VQ codebook 1302 provides each of the N VQ codevectors stored in the codebook to gain scaling unit 1304. Gain scaling unit 1304 scales the codevectors, and provides scaled codevectors to an output of scaled VQ codebook 5028*a*. Symbol g(n) represents the quantized residual gain in the linear domain, as calculated in previous sections. The combination of VQ codebook 1302 and gain scaling unit 1304 (also labeled g(n)) is equivalent to a scaled VQ codebook.

System 1300 further includes predictor logic unit 1306 (also referred to as a predictor 1306), an input vector deriver 1308, an error energy calculator 1310, a preferred codevector selector 1312, and a predictor/filter restorer 1314. Predictor 1306 includes combining and predicting logic. Input vector deriver 1308 includes combining, filtering, and predicting logic, corresponding to such logic used in codecs 3000, 4000, 5000, 6000, and 7000, for example, as will be further described below. The logic used in predictor 1306, input vector deriver 1308, and quantizer 1508*a* operates sample-by-sample in the same manner as described above in connection with codecs 3000–7000. Nevertheless, the VQ systems and methods are described below in terms of performing operations on "vectors" instead of individual samples. A "vector" as used herein refers to a group of samples. It is to be understood that the VQ systems and methods described below process each of the samples in a vector (that is, in a group of samples) one sample at a time. For example, a filter filters an input vector in the following manner: a first sample of the input vector is applied to an input of the filter; the filter processes the first sample of the vector to produce a first sample of an output vector corresponding to the first sample of the input vector; and the process repeats for each of the next sequential samples of the input vector until there are no input vector samples left, whereby the filter sequentially produces each of the next samples of the output vector. The last sample of the output vector to be produced or output by the filter can remain at the filter output such that it is available for processing immediately or at some later sample time (for example, to be combined, or otherwise processed, with a sample associated with another vector). A predictor predicts an input vector in much the same way as the filter processes (that is, filters) the input vector. Therefore, the term "vector" is used herein as a convenience to describe a group of samples to be sequentially processed in accordance with the present invention.

b. Methods

A brief overview of a method of operation of system 1300 is now provided. In the modified VQ codebook search procedure of the current invention implemented using system 1300, we provide one VQ codevector at a time from scaled VQ codebook 5028*a*, perform all predicting, combining, and filtering functions of predictor 1306 and input vector deriving logic 1308 to calculate the corresponding VQ input vector of the signal u(n), and then calculate the energy of the quantization error vector of the signal q(n) using error energy calculator 1310. This process is repeated for N times for the N codevectors in scaled VQ codebook 5028*a*, with the filter memories in input vector deriving logic 1308 reset to their initial values before we repeat the process for each new codevector. After all the N codevectors have been tried, we have calculated N corresponding quantization error energy values of q(n). The VQ codevector that minimizes the energy of the quantization error vector is the winning codevector and is used as the VQ output vector. The address of this winning codevector is the output VQ codebook index CI that is passed to the bit multiplexer block 95.

The bit multiplexer block 95 in FIG. 7 packs the five sets of indices LSPI, PPI, PPTI, GI, and CI into a single bit stream. This bit stream is the output of the encoder. It is passed to the communication channel.

Figure 13B:
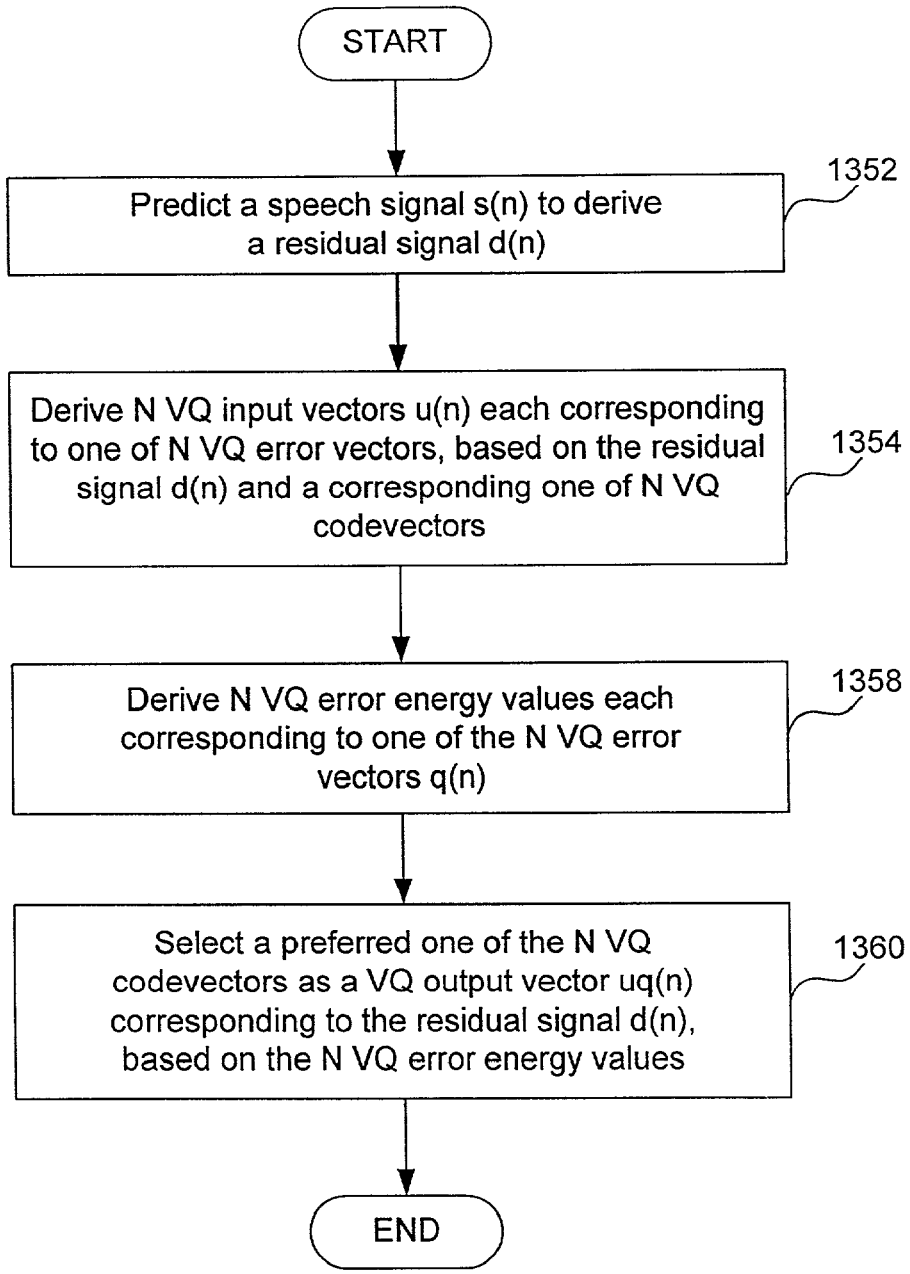
FIG. 13B is a flow diagram of an example method, corresponding to the NFC system of FIG. 13A, of searching N VQ codevectors stored in VQ codebook for a preferred one of the N VQ codevectors to be used in coding a speech or audio signal.

FIG. 13B is a flow diagram of an example method 1350 of searching the N VQ codevectors stored in VQ codebook 1302 for a preferred one of the N VQ codevectors to be used in coding a speech or audio signal (method 1350 is also referred to as a prediction residual VQ codebook search of an NFC). Method 1350 is implemented using system 1300. With reference to FIGS. 13A and 13B, at a first step 1352, predictor 1306 predicts a speech signal s(n) to derive a residual signal d(n). Predictor 1306 can include a predictor and a combiner, such as predictor 5002 and combiner 5004 discussed above in connection with FIG. 5, for example.

At a next step 1354, input vector deriver 1308 derives N VQ input vectors u(n) each based on the residual signal d(n) and a corresponding one of the N VQ codevector stored in codebook 1302. Each of the VQ input vectors u(n) corresponds to one of N VQ error vectors q(n). Input vector deriver 1308 and step 1354 are described in further detail below.

At a next step 1358, error energy calculator 1310 derives N VQ error energy values e(n) each corresponding to one of the N VQ error vectors q(n) associated with the N VQ input vectors u(n) of step 1354. Error energy calculator 1310 performs a squaring operation, for example, on each of the error vectors q(n) to derive the energy values corresponding to the error vectors.

At a next step 1360, preferred codevector selector 1312 selects a preferred one of the N VQ codevectors as a VQ output vector uq(n) corresponding to the residual signal d(n), based on the N VQ error energy values e(n) derived by error energy calculator 1310.

Predictor/filter restorer 1314 initializes and restores (that is, resets) the filter states and predictor states of various filters and predictors included in system 1300, during method 1350, as will be further described below.

2. Example Specific Embodiment a. System

Figure 13C:
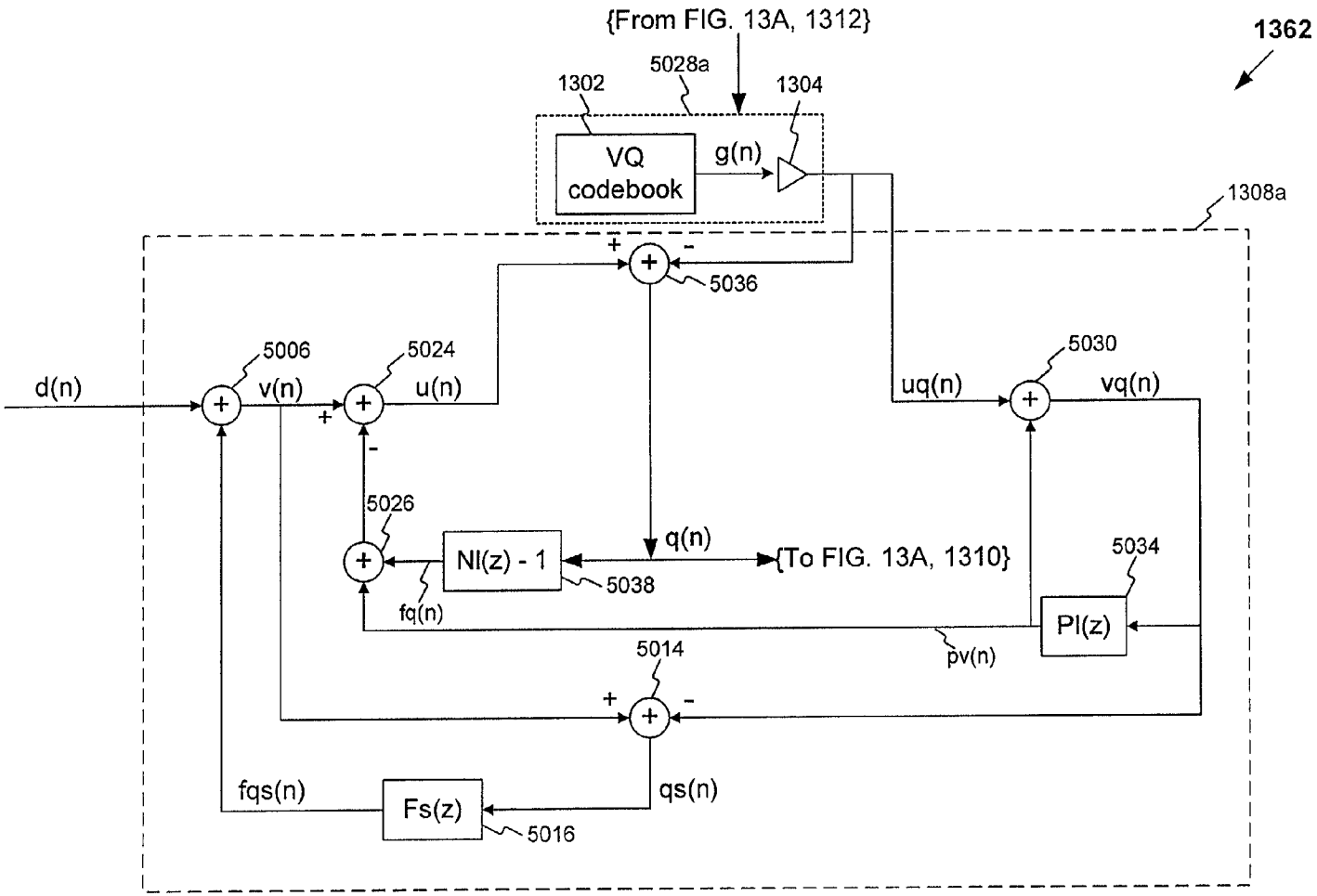
FIG. 13C is a block diagram of a portion of an example codec structure or system used in an example prediction residual VQ codebook search of the codec of FIG. 5.

FIG. 13C is a block diagram of a portion of an example codec structure or system 1362 used in a prediction residual VQ codebook search of TSNFC 5000 (discussed above in connection with FIG. 5). System 1362 includes scaled VQ codebook 5028*a*, and an input vector deriver 1308*a* (a specific embodiment of input vector deriver 1308) configured according to the embodiment of TSNFC 5000 of FIG. 5. Input vector deriver 1308*a* includes essentially the same feedback structure involved in the quantizer codebook search as in FIG. 7, except the shorthand z-transform notations of filter blocks in FIG. 5 are used. Input vector deriver 1308*a* includes an outer or first stage NF loop including NF filter 5016, and an inner or second stage NF loop including NF filter 5038, as described above in connection with FIG. 5. Also, all of the filter blocks and adders (combiners) in input vector deriver 1308*a* operate sample-by-sample in the same manner as described in connection with FIG. 5.

b. Methods

The method of operation of codec structure 1362 can be considered to encompass a single method. Alternatively, the method of operation of codec structure 1362 can be considered to include a first method associated with the inner NF loop of codec structure 1362 (mentioned above in connection with FIG. 13C), and a second method associated with the outer NF loop of the codec structure (also mentioned above). The first and second methods associated respectively with the inner and outer NF loops of codec structure 1362 operate concurrently, and in an inter-related manner (that is, together), with one another to form the single method. The aforementioned first and second methods (that is, the inner and outer NF loop methods, respectively) are now described in sequence below.

Figure 13D:
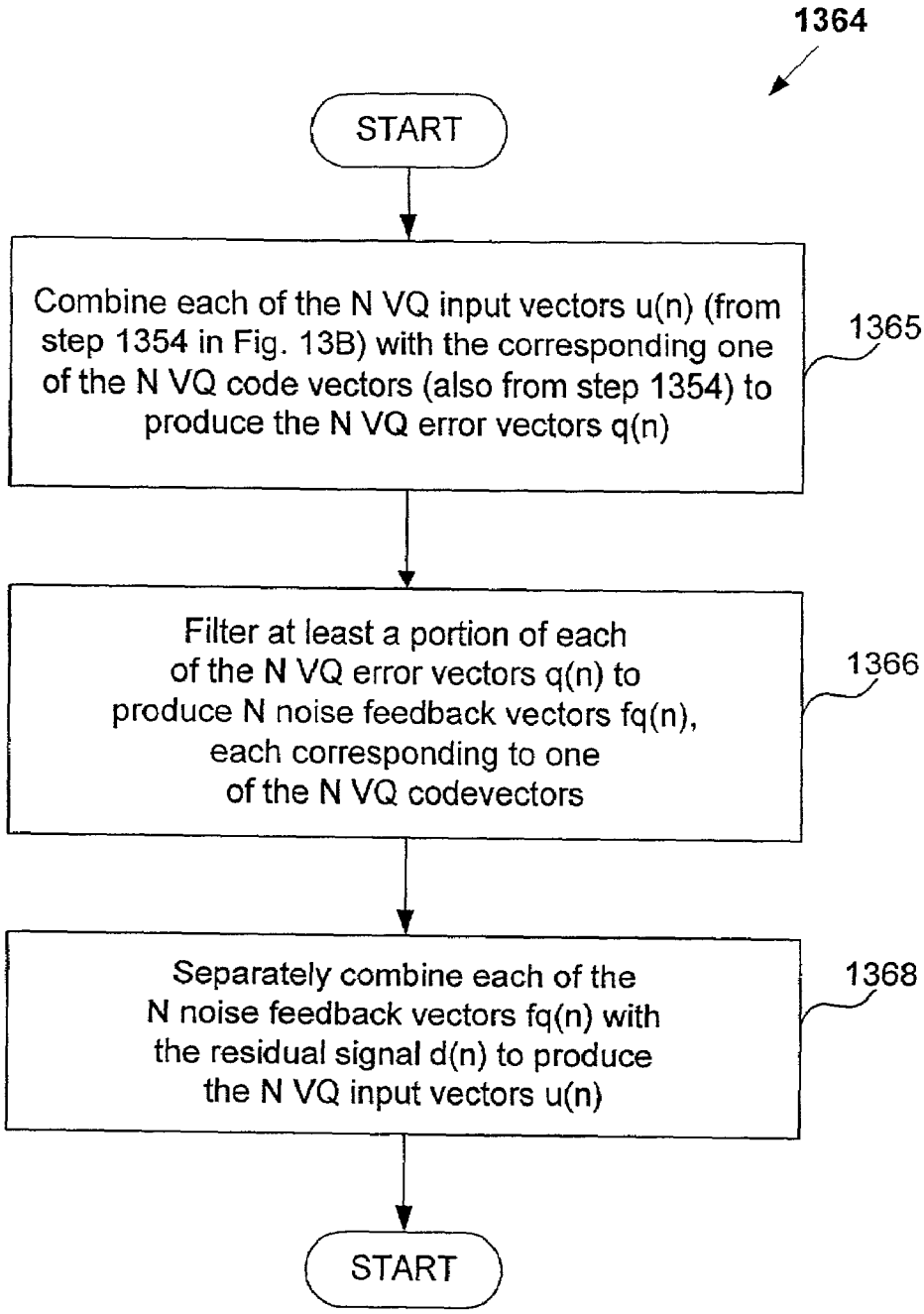
FIG. 13D is an example method implemented by the system of FIG. 13C.

FIG. 13D is an example first (inner NF loop) method 1364 implemented by system 1362 depicted in FIG. 13C. Method 1364 uses the inner NF loop of system 1362, as mentioned above. At a first step 1365, combiner 5036 combines each of the N VQ input vectors u(n) (mentioned above in connection with FIG. 13A) with the corresponding one of the N VQ codevectors from scaled VQ codebook 5028*a* to produce the N VQ error vectors q(n).

At a next step 1366, filter 5038 separately filters at least a portion of each of the N VQ error vectors q(n) to produce N noise feedback vectors fq(n) each corresponding to one of the N VQ codevectors. Filter 5038 can perform either long-term or short-term filtering. Filter 5038 filters each of the error vectors q(n) on a sample-by-sample basis (that is, the samples of each error vector q(n) are filtered sequentially, sample-by-sample). Filter 5038 filters each of the N VQ error vectors q(n) based on an initial filter state of the filter corresponding to a previous preferred codevector (the previous preferred codevector corresponds to a previous residual signal). Therefore, restorer 1314 restores filter 5038 to the initial filter state before the filter filters each of the N VQ codevectors. As would be apparent to one of ordinary skill in the speech coding art, the initial filter state mentioned above is typically established as a result of processing many, that is, one or more, previous preferred codevectors.

At a next step 1368, combining logic (5006, 5024, and 5026), separately combines each of the N noise feedback vectors fq(n) with the residual signal d(n) to produce the N VQ input vectors u(n).

Figure 13E:
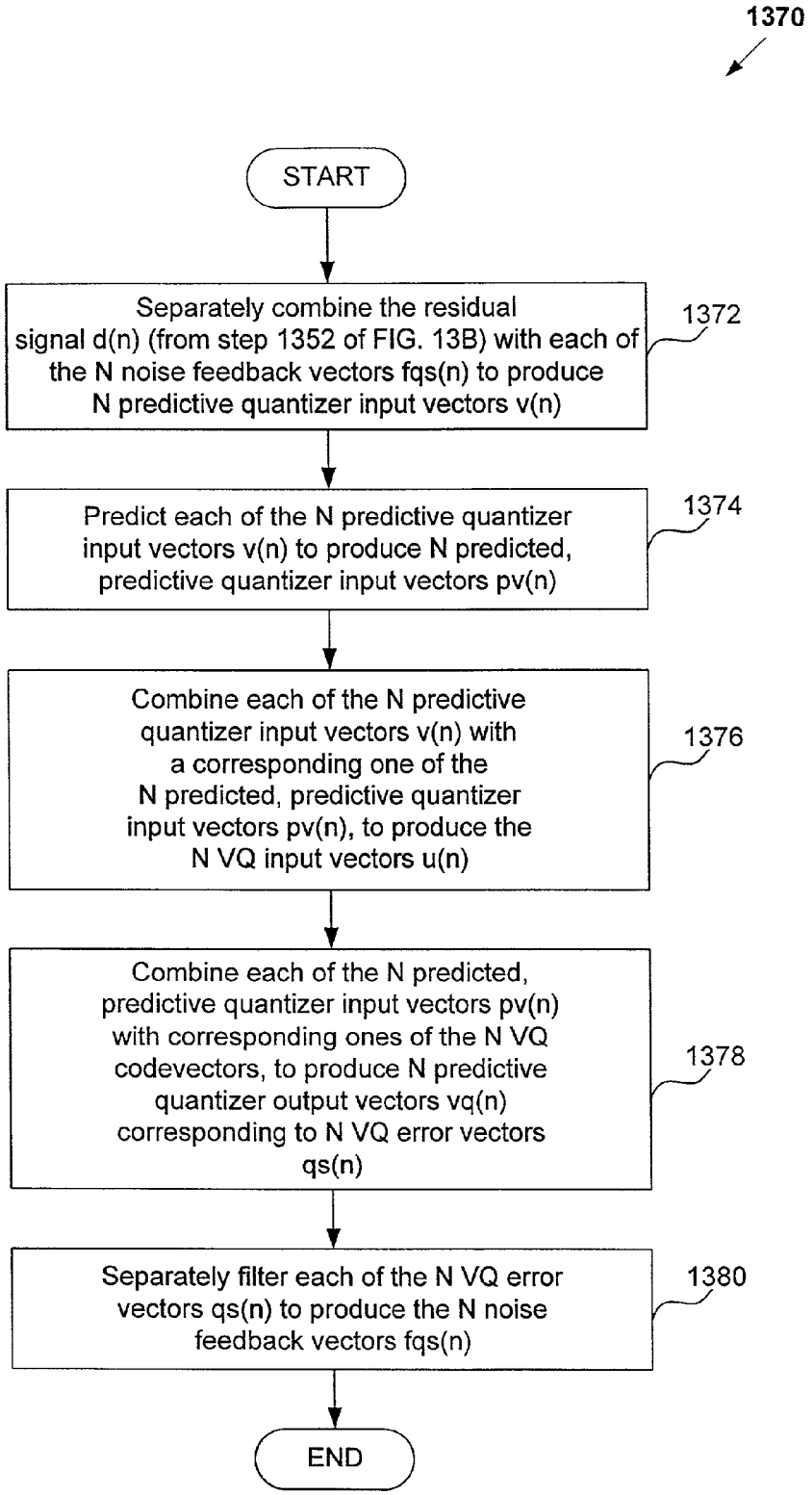
FIG. 13E is an example method executed concurrently with the method of FIG. 13D using the system of FIG. 13C.

FIG. 13E is an example second (outer NF loop) method 1370 executed concurrently and together with method 1364 by system 1362. Method 1370 uses the outer NF loop of system 1362, as mentioned above. At a first step 1372 of method 1370, combiner 5006 separately combines the residual signal d(n) with each of the N noise feedback vectors fqs(n) to produce N predictive quantizer input vectors v(n).

At a next step 1374, predictor 5034 predicts each of the N predictive quantizer input vectors v(n) to produce N predictive, predictive quantizer input vectors pv(n). Predictor 5034 predicts input vectors v(n) based on an initial predictor state of the predictor corresponding to (that is, established by) the previous preferred codevector. Therefore, restorer 1314 restores predictor 5034 to the initial predictor state before predictor 5034 predicts each of the N predictive quantizer input vectors v(n) in step 1374.

At a next step 1376, combining logic (e.g., combiners 5024, and 5026) separately combines each of the N predictive quantizer input vectors v(n) with a corresponding one of the N predicted, predictive quantizer input vectors pv(n) to produce the N VQ input vectors u(n).

At a next step 1378, a combiner (e.g. combiner 5030) combines each of the N predicted, predictive quantizer input vectors pv(n) with corresponding ones of the N VQ codevectors, to produce N predictive quantizer output vectors vq(n) corresponding to N VQ error vectors qs(n).

At a next step 1380, filter 5016 separately filters each of the N VQ error vectors qs(n) to produce the N noise feedback vectors fqs(n). Filter 5016 can perform either long-term or short-term filtering. Filter 5016 filters each of the N VQ error vectors qs(n) on a sample-by-sample basis, and based on an initial filter state of the filter corresponding to at least the previous preferred codevector (see predicting step 1374 above). Therefore, restorer 1314 restores filter 5016 to the initial filter state before filter 5016 filters each of the N VQ codevectors in step 1380.

Alternative embodiments of VQ search systems and corresponding methods, including embodiments based on codecs 3000, 4000, and 6000, for example, would be apparent to one of ordinary skill in designing speech codecs, based on the exemplary VQ search system and methods described above.

The fundamental ideas behind the modified VQ codebook search methods described above are somewhat similar to the ideas in the VQ codebook search method of CELP codecs. However, the feedback filter structures of input vector deriver 1308 (for example, input vector deriver 1308*a*, and so on) are completely different from the structure of a CELP codec, and it is not readily obvious to those skilled in the art that such a VQ codebook search method can be used to improve the performance of a conventional NFC codec or a two-stage NFC codec.

Our simulation results show that this vector quantizer approach indeed works, gives better codec performance than a scalar quantizer at the same bit rate, and also achieves desirable short-term and long-term noise spectral shaping. However, according to another novel feature of the current invention described below, this VQ codebook search method can be further improved to achieve significantly lower complexity while maintaining mathematical equivalence.

B. Fast VQ Search

A computationally more efficient codebook search method according to the present invention is based on the observation that the feedback structure in FIG. 13C, for example, can be regarded as a linear system with the VQ codevector out of scaled VQ codebook 5028*a* as its input signal, and the quantization error q(n) as its output signal. The output vector of such a linear system can be decomposed into two components: a ZERO-INPUT response vector qzi(n) and a ZERO-STATE response vector qzs(n). The ZERO-INPUT response vector qzi(n) is the output vector of the linear system when its input vector is set to zero. The ZERO-STATE response vector qzs(n) is the output vector of the linear system when its internal states (filter memories) are set to zero (but the input vector is not set to zero).

1. High-Level Embodiment a. System

Figure 14A:
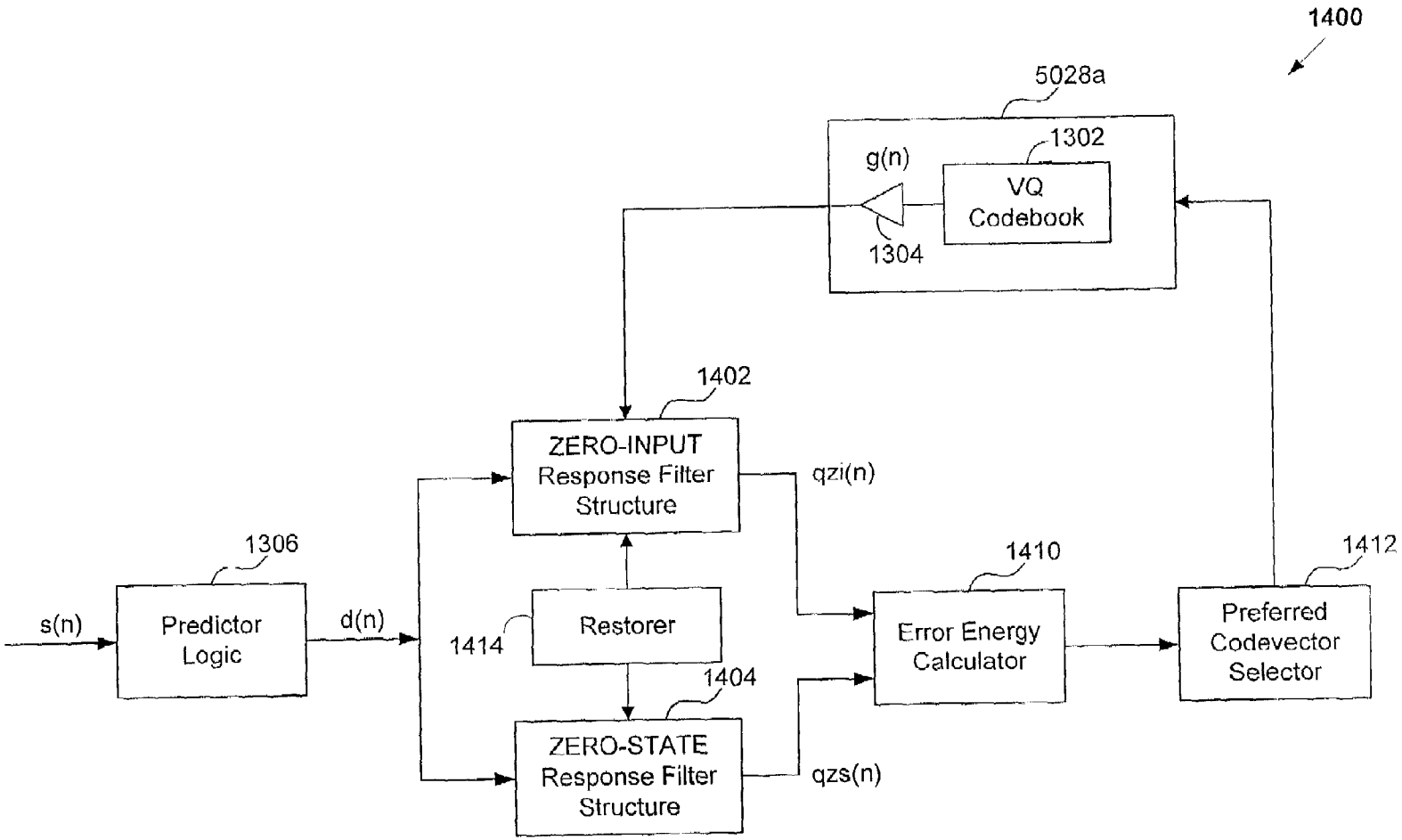
FIG. 14A is a block diagram of an example NFC system for efficiently searching through N VQ codevectors stored in a VQ codebook for a preferred one of the N VQ codevectors to be used for coding a speech or audio signal.

FIG. 14A is a block diagram of an example NFC system 1400 for efficiently searching through N VQ codevectors, stored in the VQ codebook 1302 of scaled VQ codebook 5028*a*, for a preferred one of the N VQ codevectors to be used for coding a speech or audio signal. System 1400 includes scaled VQ codebook 5028*a*, a ZERO-INPUT response filter structure 1402, a ZERO-STATE response filter structure 1404, a restorer 1414 similar to restorer 1314 in FIG. 13A, an error energy calculator 1410 similar to error energy calculator 1310 in FIG. 13A, and a preferred codevector selector 1412 similar to preferred codevector selector 1312 in FIG. 13A.

b. Methods

Figure 14B:
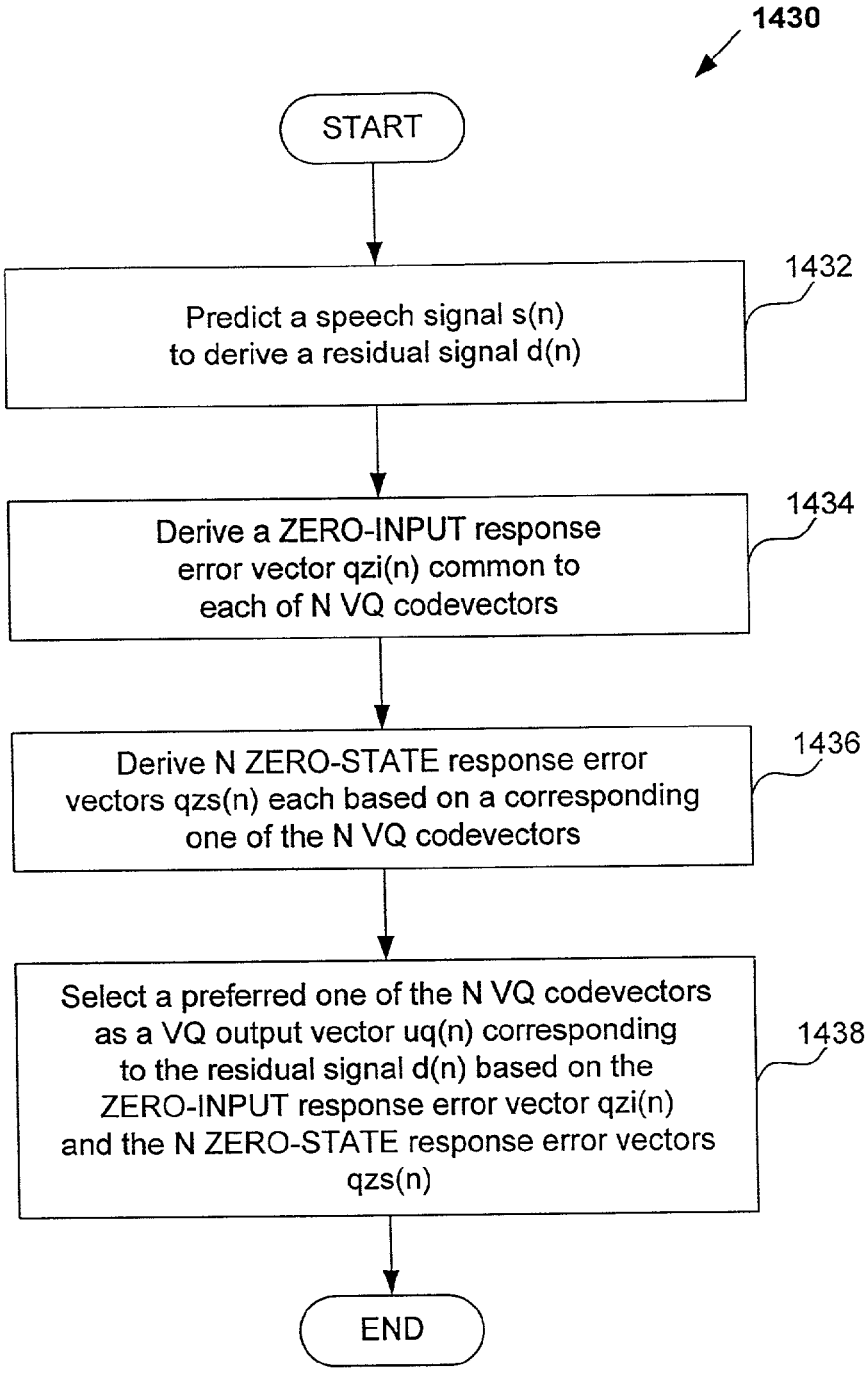
FIG. 14B is an example method implemented using the system of FIG. 14A.

FIG. 14B is an example, computationally efficient, method 1430 of searching through N VQ codevectors for a preferred one of the N VQ codevectors, using system 1400. In a first step 1432, predictor 1306 predicts speech signal s(n) to derive a residual signal d(n).

At a next step 1434, ZERO-INPUT response filter structure 1402 derives ZERO-INPUT response error vector qzi (n) common to each of the N VQ codevectors stored in VQ codebook 1302.

At a next step 1436, ZERO-STATE response filter structure 1404 derives N ZERO-STATE response error vectors qzs(n) each based on a corresponding one of the N VQ codevectors stored in VQ codebook 1302.

At a next step 1438, error energy calculator 1410 derives N VQ error energy values each based on the ZERO-INPUT response error vector qzi(n) and a corresponding one of the N ZERO-STATE response error vectors qzs(n). Preferred codevector selector 1412 selects the preferred one of the N VQ codevectors based on the N VQ error energy values derived by error energy calculator 1410.

The qzi(n) vector derived at step 1434 captures the effects due to (1) initial filter memories in ZERO-INPUT response filter structure 1402, and (2) the signal vector of d(n). Since the initial filter memories and the signal d(n) are both independent of the particular VQ codevector tried, there is only one ZERO-INPUT response vector, and it only needs to be calculated once for each input speech vector.

During the calculation of the ZERO-STATE response vector qzs(n) at step 1436, the initial filter memories and d(n) are set to zero. For each VQ codebook vector tried, there is a corresponding ZERO-STATE response vector qzs(n). Therefore, for a codebook of N codevectors, we need to calculate N ZERO-STATE response vectors qzs(n) for each input speech vector, in one embodiment of the present invention. In a more computationally efficient embodiment, we calculate a set of N ZERO-STATE response vectors qzs(n) for a group of input speech vectors, instead of for each of the input speech vectors, as is further described below.

2. Example Specific Embodiments a. ZERO-INPUT Response

Figure 14C:
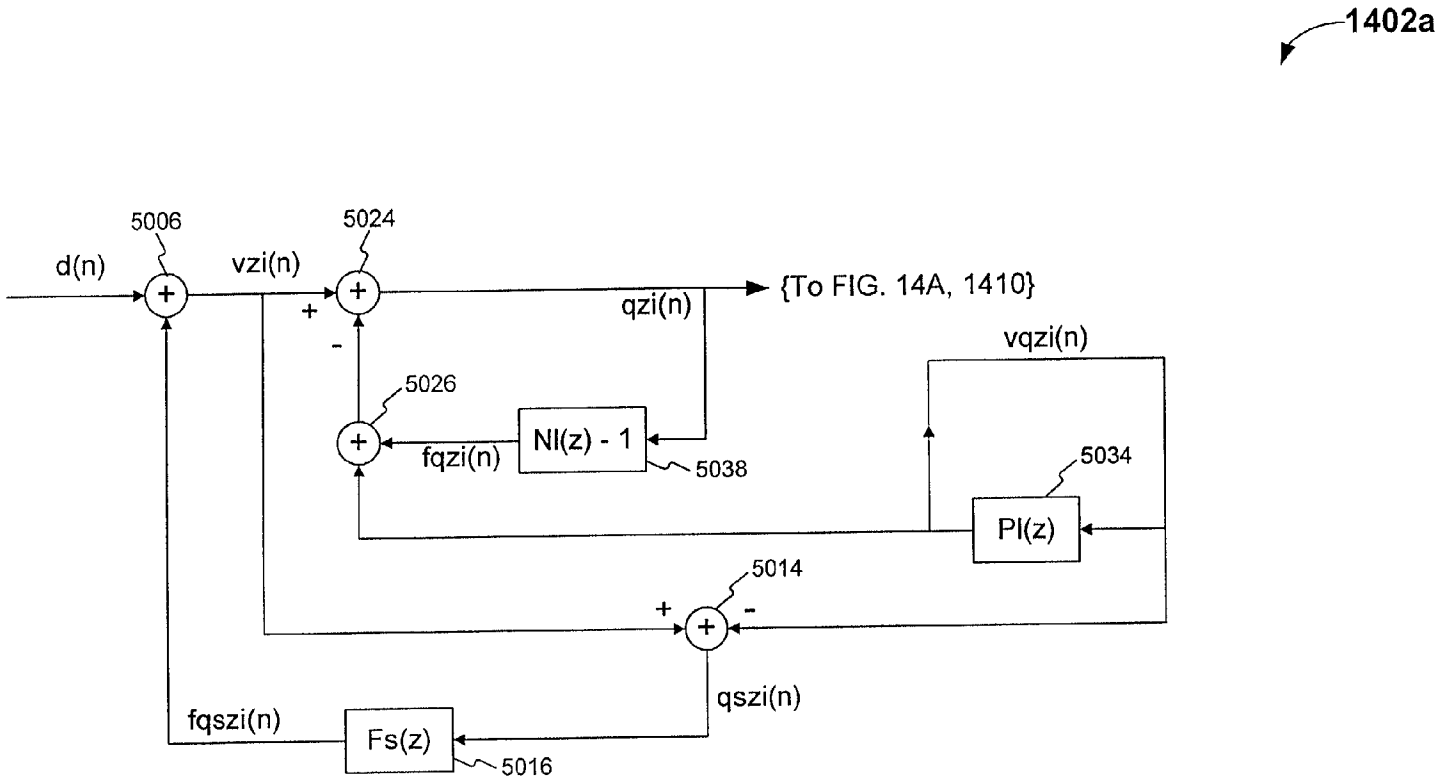
FIG. 14C is an example filter structure, during a calculation of a ZERO-INPUT response of a quantization error signal, used in the example prediction residual VQ codebook search corresponding to FIG. 13C.

FIG. 14C is a block diagram of an example ZERO-INPUT response filter structure 1402*a* (a specific embodiment of filter structure 1402) used during the calculation of the ZERO-INPUT response of q(n) of FIG. 13C. During the calculation of the ZERO-INPUT response vector qzi(n), certain branches in FIG. 13C can be omitted because the signals going through those branches are zero. The resulting structure is depicted in FIG. 14C. ZERO-INPUT response filter structure 1402*a* includes filter 5038 associated with an inner NF loop of the filter structure, and filter 5016 associated with an outer NF loop of the filter structure.

The method of operation of codec structure 1402*a* can be considered to encompass a single method. Alternatively, the method of operation of codec structure 1402*a* can be considered to include a first method associated with the inner NF loop of codec structure 1402*a*, and a second method associated with the outer NF loop of the codec structure. The first and second methods associated respectively with the inner and outer NF loops of codec structure 1402*a* operate concurrently, and together, with one another to form the single method. The aforementioned first and second methods (that is, the inner and outer NF loop methods, respectively) are now described in sequence below.

Figure 14D:
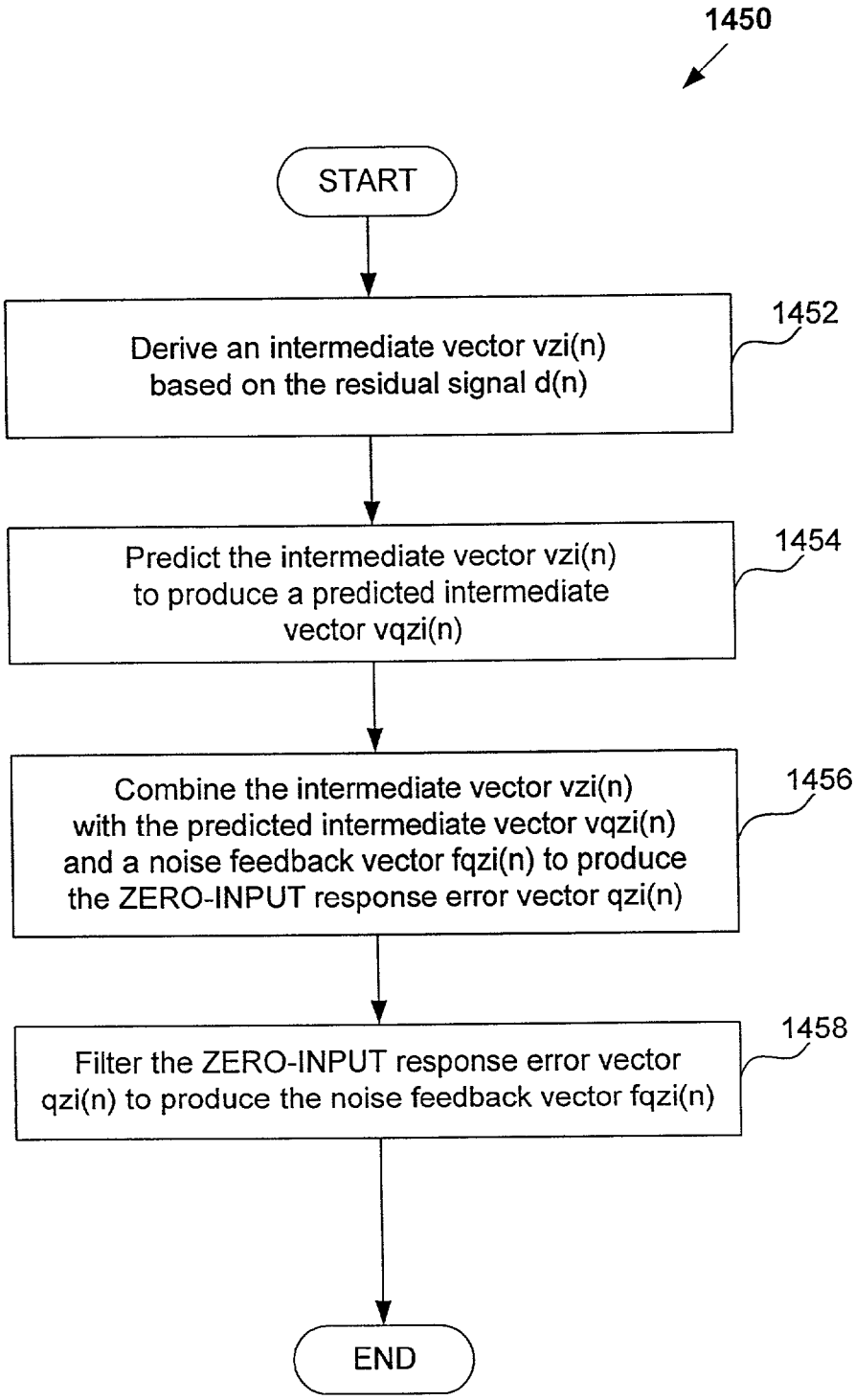
FIG. 14D is an example method of deriving a ZERO-INPUT response using the ZERO-INPUT response filter structure of FIG. 14C.

FIG. 14D is an example first (inner NF loop) method 1450 of deriving a ZERO-INPUT response using ZERO-INPUT response filter structure 1402*a* of FIG. 14C. Method 1450 includes operation of the inner NF loop of system 1402*a*.

In a first step 1452, an intermediate vector vzi(n) is derived based on the residual signal d(n).

In a next step 1454, the intermediate vector vzi(n) is predicted (using predictor 5034, for example) to produce a predicted intermediate vector vqzi(n). Intermediate vector vzi(n) is predicted based on an initial predictor state (of predictor 5034, for example) corresponding to a previous preferred codevector. As would be apparent to one of ordinary skill in the speech coding art, the initial filter state mentioned above is typically established as a result of a history of many, that is, one or more, previous preferred codevectors.

In a next step 1456, the intermediate vector vzi(n) and the predicted intermediate vector vqzi(n) are combined with a noise feedback vector fqzi(n) (using combiners 5026 and 5024, for example) to produce the ZERO-INPUT response error vector qzi(n).

In a next step 1458, the ZERO-INPUT response error vector qzi(n) is filtered (using filter 5038, for example) to produce the noise feedback vector fqzi(n). Error vector qzi(n) can be either long-term or short-term filtered. Also, error vector qzi(n) is filtered based on an initial filter state (of filter 5038, for example) corresponding to the previous preferred codevector (see predicting step 1454 above).

Figure 14E:
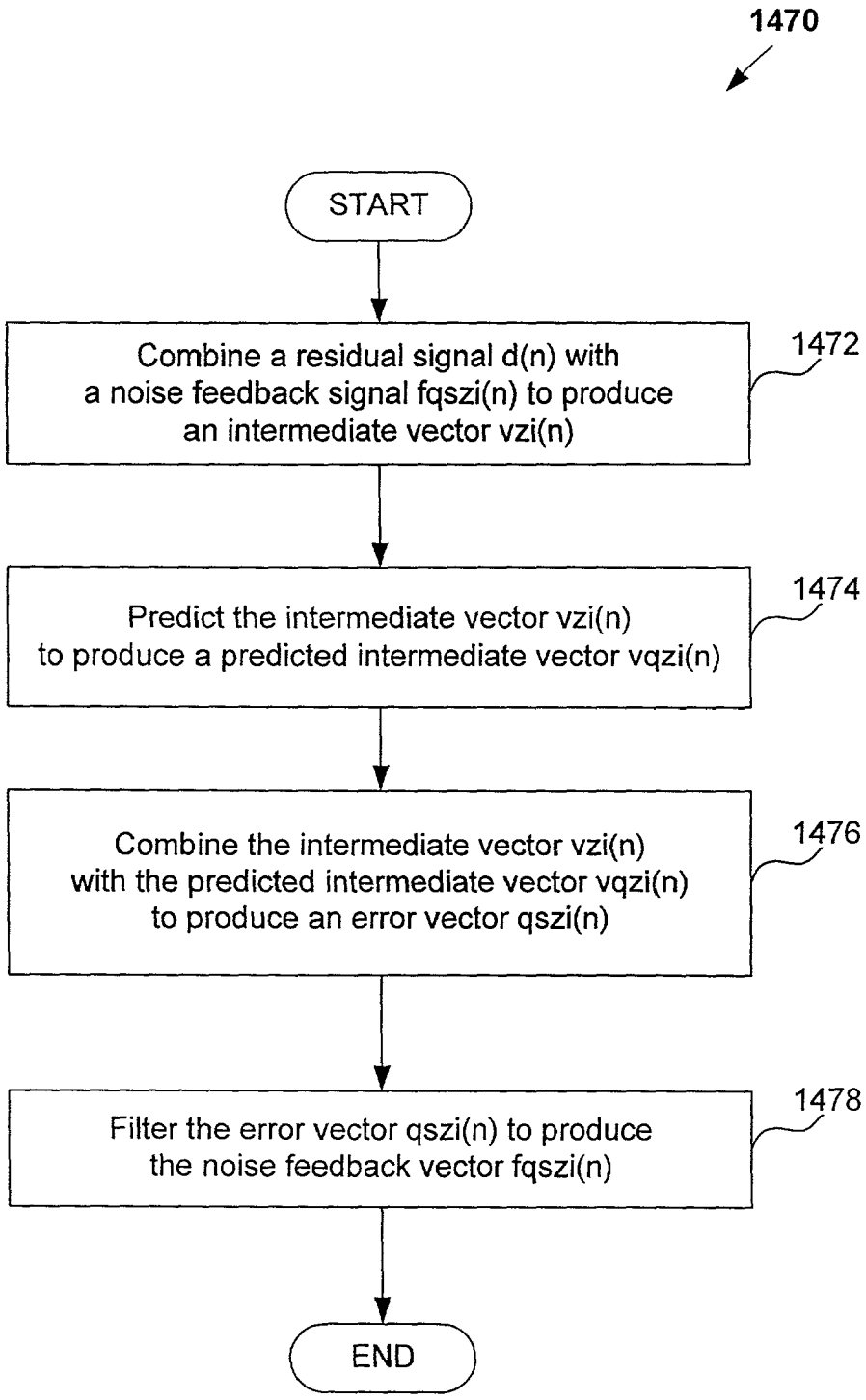
FIG. 14E is another example method of deriving a ZERO-INPUT response, executed concurrently with the method of FIG. 14D, using the ZERO-INPUT response filter structure of FIG. 14C.

FIG. 14E is an example second (outer NF loop) method 1470 of deriving a ZERO-INPUT response, executed concurrently with method 1450, using ZERO-INPUT response filter structure 1402*a*. Method 1470 includes operation of the outer NF loop of system 1402*a*. Method 1470 shares some method steps with method 1450, described above.

In a first step 1472, the residual signal d(n) is combined with a noise feedback signal fqszi(n) (using combiner 5006, for example) to produce an intermediate vector vzi(n).

At a next step 1474, the intermediate vector vzi(n) is predicted to produce a predicted intermediate vector vqzi(n).

At a next step 1476, the intermediate vector vzi(n) is combined with the predicted intermediate vector vqzi(n) (using combiner 5014, for example) to produce an error vector qszi(n).

At a next step 1478, the error vector qszi(n) is filtered (using filter 5016, for example) to produce the noise feedback vector fqszi(n). Error vector qszi(n) can be either long-term or short-term filtered. Also, error vector qszi(n) is filtered based on an initial filter state (of filter 5038, for example) corresponding to the previous preferred codevector (see predicting step 1454 above).

b. ZERO-STATE Response

1. ZERO-STATE Response—First Embodiment

Figure 15A:
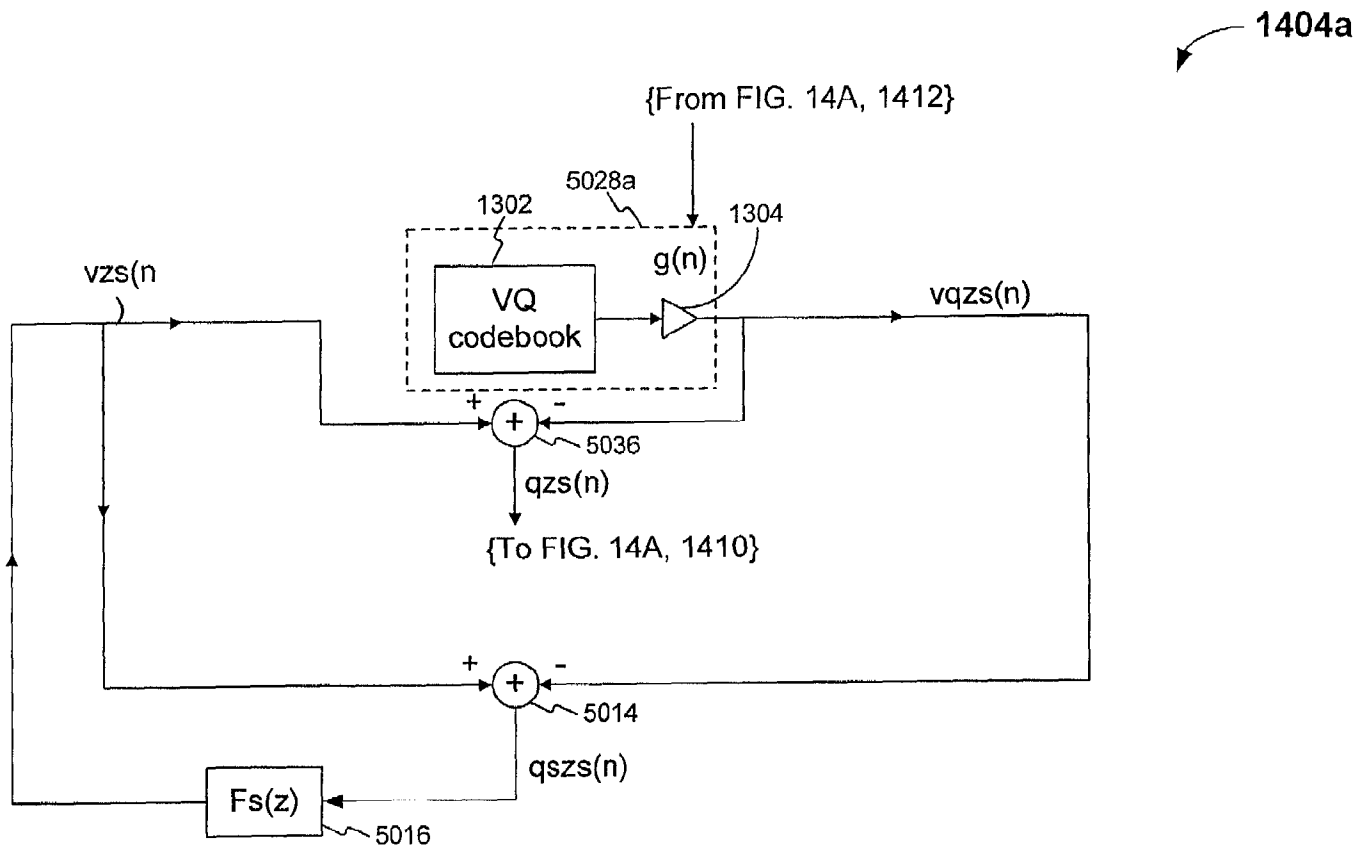
FIG. 15A is a block diagram of an example filter structure, during a calculation of a ZERO-STATE response of a quantization error signal, used in the example prediction residual VQ codebook search corresponding to FIGS. 13C and 14C.

FIG. 15A is a block diagram of an example ZERO-STATE response filter structure 1404*a* (a specific embodiment of filter structure 1404) used during the calculation of the ZERO-STATE response of q(n) in FIG. 13C.

If we choose the vector dimension to be smaller than the minimum pitch period minus one, or K<MINPP−1, which is true in our preferred embodiment, then with zero initial memory, the two long-term filters 5038 and 5034 in FIG. 13A have no effect on the calculation of the ZERO-STATE response vector. Therefore, they can be omitted. The resulting structure during ZERO-STATE response calculation is depicted in FIG. 15A.

Figure 15B:
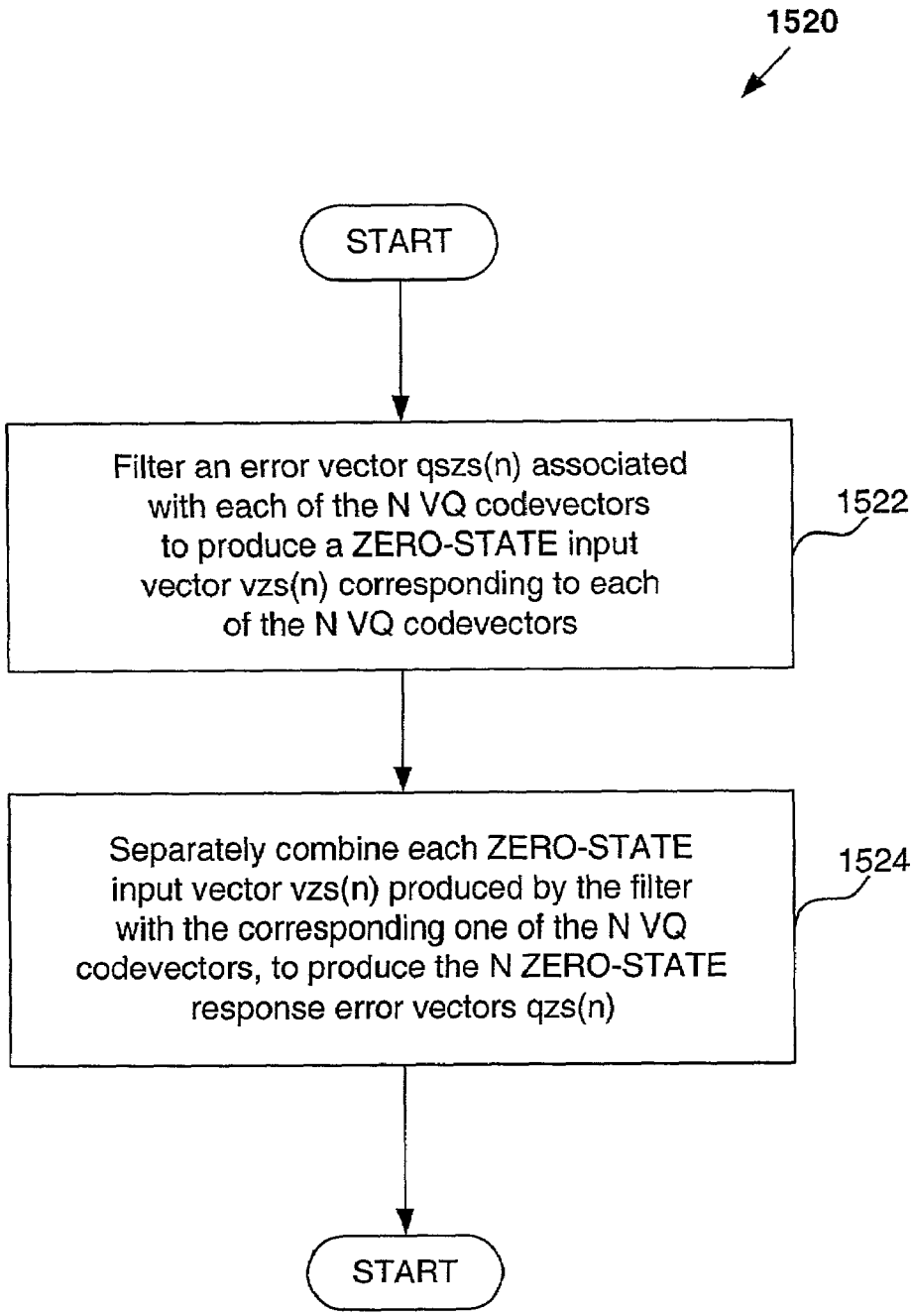
FIG. 15B is a flowchart of an example method of deriving a ZERO-STATE response using the filter structure of FIG. 15A.

FIG. 15B is a flowchart of an example method 1520 of deriving a ZERO-STATE response using filter structure 1404*a* depicted in FIG. 15A. In a first step 1522, an error vector qszs(n) associated with each of the N VQ codevectors stored in scaled VQ codebook 5028*a* is filtered (using filter 5016, for example) to produce a ZERO-STATE input vector vzs(n) corresponding to each of the N VQ codevectors. Each of the error vectors qszs(n) is filtered based on an initially zeroed filter state (of filter 5016, for example). Therefore, the filter state is zeroed (using restorer 1414, for example) to produce the initially zeroed filter state before each error vector qszs(n) is filtered.

In a next step 1524, each ZERO-STATE input vector vzs(n) produced in filtering step 1522 is separately combined with the corresponding one of the N VQ codevectors (using combiner 5036, for example), to produce the N ZERO-STATE response error vectors qzs(n).

2. ZERO-STATE Response—Second Embodiment

Figure 16A:
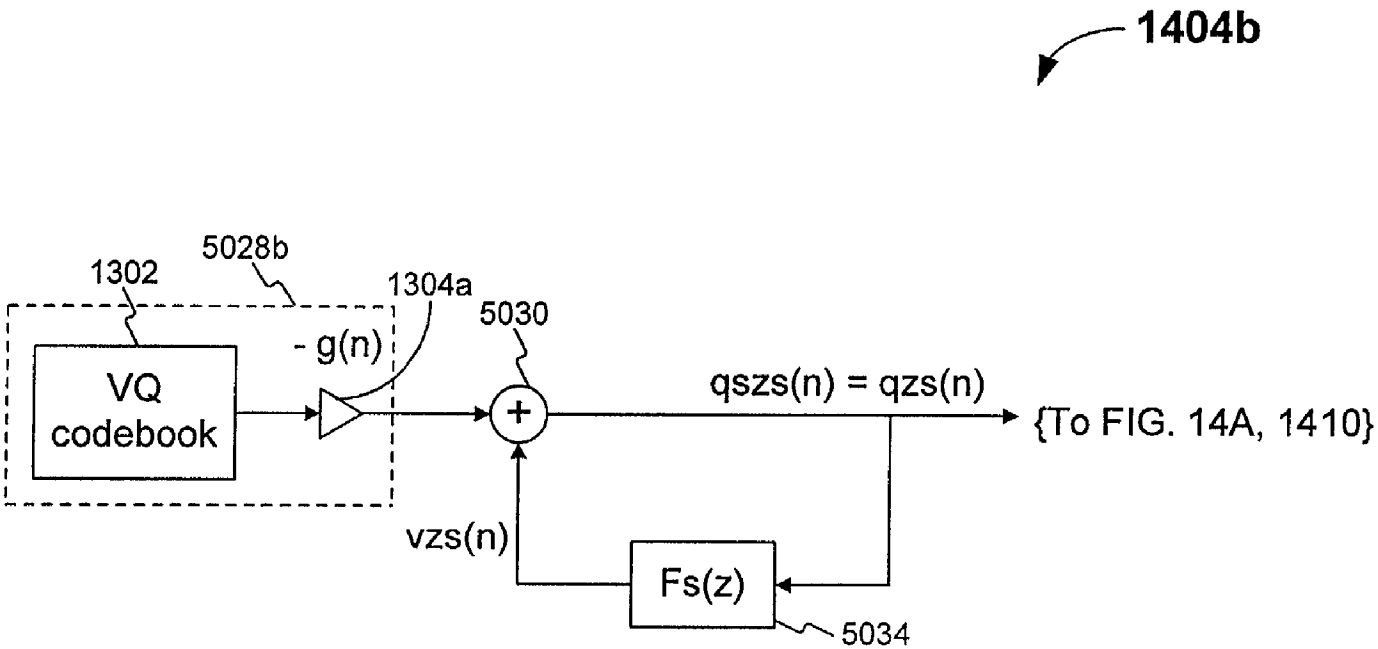
FIG. 16A is a block diagram of a filter structure according to another embodiment of the ZERO-STATE response filter structure of FIG. 14A.

Note that in FIG. 15A, qszs(n) is equal to qzs(n). Hence, we can simply use qszs(n) as the output of the linear system during the calculation of the ZERO-STATE response vector. This allows us to simplify FIG. 15A further into a simplified structure 1404*b* in FIG. 16A, which is no more than just scaling the VQ codevector by the negative gain −g(n), and then passing the result through a feedback filter structure with a transfer function of H(z)=1/[1−Fs(z)]. Therefore, FIG. 16A is a block diagram of filter structure 1404*b* according to a simplified embodiment of ZERO-STATE response filter structure 1404. Filter structure 1404*b* is equivalent to filter structure 1404*a* of FIG. 15A.

If we start with a scaled codebook (use g(n) to scale the codebook) as mentioned in the description of block 30 in an earlier section, and pass each scaled codevector through the filter H(z) with zero initial memory, then, subtracting the corresponding output vector from the ZERO-INPUT response vector of qzi(n) gives us the quantization error vector of q(n) for that particular VQ codevector.

Figure 16B:
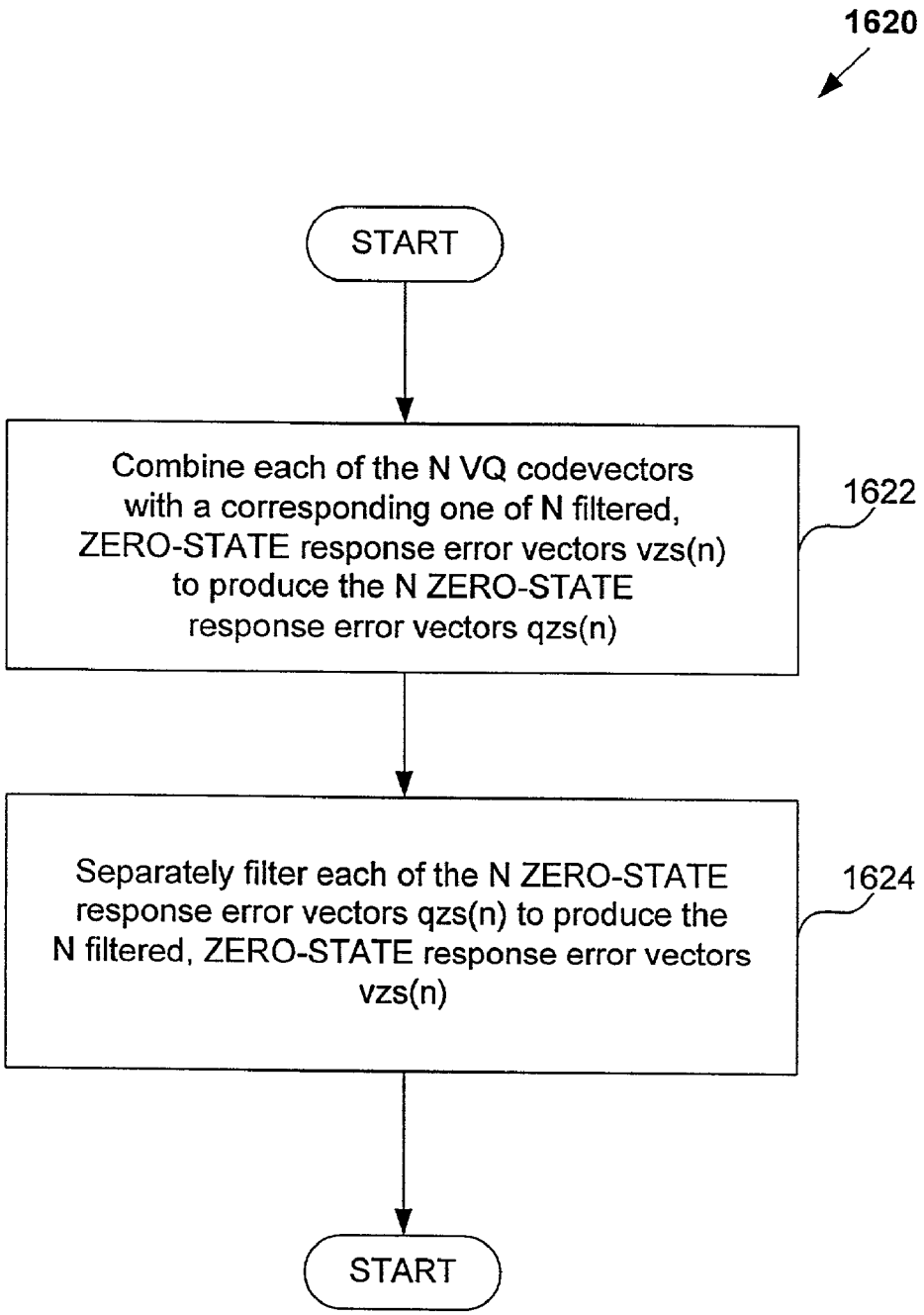
FIG. 16B is a flowchart of an example method of deriving a ZERO-STATE response using the filter structure of FIG. 16A.

FIG. 16B is a flowchart of an example method 1620 of deriving a ZERO-STATE response using filter structure 1404*b* of FIG. 16A. In a first step 1622, each of N VQ codevectors is combined with a corresponding one of N filtered, ZERO-STATE response error vectors vzs(n) to produce the N ZERO-STATE response error vectors qzs(n).

At a next step 1624, each of the N ZERO-STATE response error vectors qzs(n) is separately filtered to produce the N filtered, ZERO-STATE response error vectors vzs(n). Each of the error vectors qzs(n) is filtered based on an initially zeroed filter state. Therefore, the filter state is zeroed to produce the initially zeroed filter state before each error vector qzs(n) is filtered. The following enumerated steps represent an example of processing one VQ codevector CV(n) including four samples $CV(n)_{0..3}$ sample-by-sample according to steps 1622 and 1624 using filter structure 1404*b*, to produce a corresponding ZERO-STATE error vector qzs(n) including four samples $qzs(n)_{0..3}$:

1. combiner 5030 combines first codevector sample $CV(n)_0$ of codevector CV(n) with an initial zero state feedback sample vzs(n)i from filter 5034, to produce first error sample $qzs(n)_0$ of error vector qzs(n) (which corresponds to first codevector sample $CV(n)_0$) (part of step 1622);
2. filter 5034 filters first error sample $qzs(n)_0$ to produce a first feedback sample $vzs(n)_0$ of a feedback vector vzs(n) (part of step 1624);
3. combiner 5030 combines feedback sample $vzs(n)_0$ with second codevector sample $CV(n)_1$, to produce second error sample $qzs(n)_1$; (part of step 1622)
4. filter 5034 filters second error sample $qzs(n)_1$ to produce a second feedback sample $vzs(n)_1$ of feedback vector vzs(n) (part of step 1624);
5. combiner 5030 combines feedback sample $vzs(n)_1$ with third codevector sample $CV(n)_2$, to produce third error sample $qzs(n)_2$ (part of step 1622);
6. filter 5034 filters third error sample $qzs(n)_2$ to produce a third feedback sample $vzs(n)_2$ (part of step 1624); and
7. combiner 5030 combines feedback sample $vzs(n)_2$ with fourth (and last) codevector sample $CV(n)_3$, to produce fourth error sample $qzs(n)_3$, whereby the four samples of vector qzs(n) are produced based on the four samples of VQ codevector CV(n) (part of step 1622). Steps 1-7 described above are repeated for each of the N VQ codevectors in accordance with method 1620, to produce the N error vectors qzs(n).

This second approach (corresponding to FIGS. 16A and 16B) is computationally more efficient than the first (and more straightforward) approach (corresponding to FIGS. 15A and 15B). For the first approach, the short-term noise feedback filter takes KM multiply-add operations for each VQ codevector. For the second approach, only K(K−1)/2 multiply-add operations are needed if K<M. In our preferred embodiment, M=8, and K=4, so the first approach takes 32 multiply-adds per codevector for the short-term filter, while the second approach takes only 6 multiply-adds per codevector. Even with all other calculations included, the second codebook search approach still gives a very significant reduction in the codebook search complexity. Note that the second approach is mathematically equivalent to the first approach, so both approaches should give an identical codebook search result.

Again, the ideas behind this second codebook search approach are somewhat similar to the ideas in the codebook search of CELP codecs. However, the actual computational procedures and the codec structure used are quite different, and it is not readily obvious to those skilled in the art how the ideas can be used correctly in the framework of two-stage noise feedback coding.

Using a sign-shape structured VQ codebook can further reduce the codebook search complexity. Rather than using a B-bit codebook with $2^B$ independent codevectors, we can use a sign bit plus a (B−1)-bit shape codebook with $2^{B-1}$ independent codevectors. For each codevector in the (B−1)-bit shape codebook, the negated version of it, or its mirror image with respect to the origin, is also a legitimate codevector in the equivalent B-bit sign-shape structured codebook. Compared with the B-bit codebook with $2^B$ independent codevectors, the overall bit rate is the same, and the codec performance should be similar. Yet, with half the number of codevectors, this arrangement cut the number of filtering operations through the filter H(z)=1/[1−Fs(z)] by half, since we can simply negate a computed ZERO-STATE response vector corresponding to a shape codevector in order to get the ZERO-STATE response vector corresponding to the mirror image of that shape codevector. Thus, further complexity reduction is achieved.

In the preferred embodiment of the 16 kb/s narrowband codec, we use 1 sign bit with a 4-bit shape codebook. With a vector dimension of 4, this gives a residual encoding bit rate of (1+4)/4=1.25 bits/sample, or 50 bits/frame (1 frame=40 samples=5 ms). The side information encoding rates are 14 bits/frame for LSPI, 7 bits/frame for PPI, 5 bits/frame for PPTI, and 4 bits/frame for GI. That gives a total of 30 bits/frame for all side information. Thus, for the entire codec, the encoding rate is 80 bits/frame, or 16 kb/s. Such a 16 kb/s codec with a 5 ms frame size and no look ahead gives output speech quality comparable to that of G.728 and G.729E.

For the 32 kb/s wideband codec, we use 1 sign bit with a 5-bit shape codebook, again with a vector dimension of 4. This gives a residual encoding rate of (1+5)/4=1.5 bits/sample=120 bits/frame (1 frame=80 samples=5 ms). The side information bit rates are 17 bits/frame for LSPI, 8 bits/frame for PPI, 5 bits/frame for PPTI, and 10 bits/frame for GI, giving a total of 40 bits/frame for all side information. Thus, the overall bit rate is 160 bits/frame, or 32 kb/s. Such a 32 kb/s codec with a 5 ms frame size and no look ahead gives essentially transparent quality for speech signals.

3. Further Reduction in Computational Complexity

The speech signal used in the vector quantization embodiments described above can comprise a sequence of speech vectors each including a plurality of speech samples. As described in detail above, for example, in connection with FIG. 7, the various filters and predictors in the codec of the present invention respectively filter and predict various signals to encode speech signal s(n) based on filter and predictor (or prediction) parameters (also referred to in the art as filter and predictor taps, respectively). The codec of the present invention includes logic to periodically derive, that is, update, the filter and predictor parameters, and also the gain g(n) used to scale the VQ codebook entries, based on the speech signal, once every M speech vectors, where M is greater than one. Codec embodiments for periodically deriving filter, prediction, and gain scaling parameters were described above in connection with FIG. 7.

The present invention takes advantage of such periodic updating of the aforementioned parameters to further reduce the computational complexity associated with calculating the N ZERO-STATE response error vectors qzs(n), described above. With reference again to FIG. 16A, the N ZERO-STATE response error vectors qzs(n) derived using filter structure 1404*b* depend on only the N VQ codevectors, the gain value g(n), and the filter parameters (taps) applied to filter 5034. Since the gain value g(n) and filter taps applied to filter 5034 are constant over M speech vectors, that is, between updates, and since the N VQ codevectors are also constant, the N ZERO-STATE response error vectors qzs(n) corresponding to the N VQ codevectors are correspondingly constant over the M speech vectors. Therefore, the N ZERO-STATE response error vectors qzs(n) need only be derived when the gain g(n) and/or filter parameters for filter 5034 are updated once every M speech vectors, thereby reducing the overall computational complexity associated with searching the VQ codebook for a preferred one of the VQ codevectors.

Figure 17:
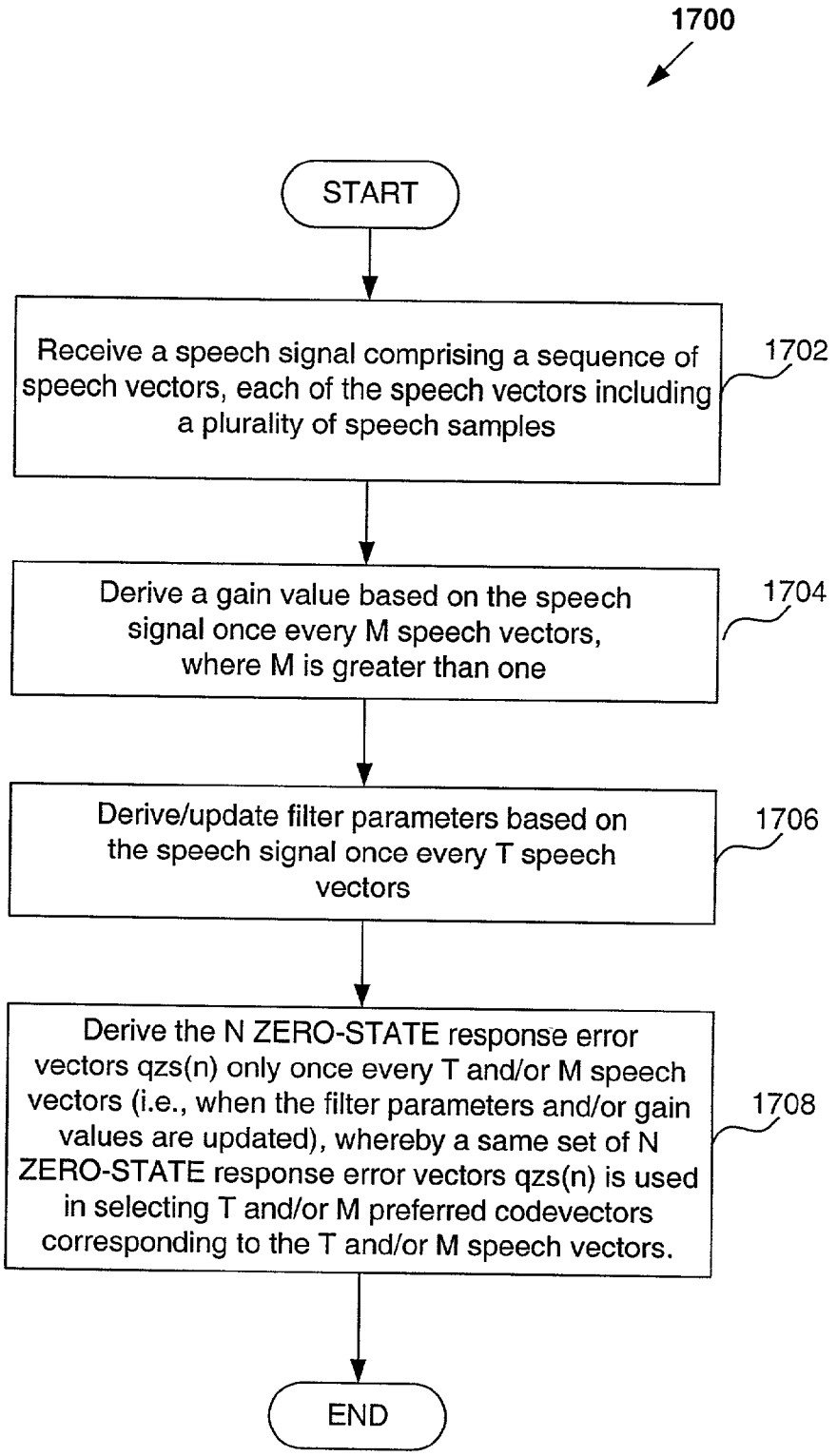
FIG. 17 is a flowchart of an example method of reducing the computational complexity associated with searching a VQ codebook, according to the present invention

FIG. 17 is a flowchart of an example method 1700 of further reducing the computational complexity associated with searching the VQ codebook for a preferred one of the VQ codevectors, in accordance with the above description. In a first step 1702, a speech signal is received. The speech signal comprises a sequence of speech vectors, each of the speech vectors including a plurality of speech samples.

At a next step 1704, a gain value is derived based on the speech signal once every M speech vectors, where M is an integer greater than 1.

At a next step 1706, filter parameters are derived/updated based on the speech signal once every T speech vectors, where T is an integer greater than one, and where T may, but does not necessarily, equal M.

At a next step 1708, the N ZERO-STATE response error vectors qzs(n) are derived once every T and/or M speech vectors (i.e., when the filter parameters and/or gain values are updated, respectively), whereby a same set of N ZERO-STATE response error vectors qzs(n) is used in selecting a plurality of preferred codevectors corresponding to a plurality of speech vectors.

Alternative embodiments of VQ search systems and corresponding methods, including embodiments based on codecs 3000, 4000, and 6000, for example, would be apparent to one of ordinary skill in designing speech codecs, based on the exemplary VQ search system and methods described above.

X. Closed-Loop Residual Codebook Optimization

According to yet another novel feature of the current invention, we can use a closed-loop optimization method to optimize the codebook for prediction residual quantization in TSNFC. This method can be applied to both vector quantization and scalar quantization codebook. The closed-loop optimization method is described below.

Let K be the vector dimension, which can be 1 for scalar quantization. Let $y_j$ be the j-th codevector of the prediction residual quantizer codebook. In addition, let H(n) be the K×K lower triangular Toeplitz matrix with the impulse response of the filter H(z) as the first column. That is, $$H(n)=\begin{bmatrix} h(0) & 0 & 0 & . & . & . & 0 \\ h(1) & h(0) & 0 & 0 & . & . & . \\ h(2) & h(1) & h(0) & 0 & 0 & . & . \\ . & . & h(1) & . & 0 & 0 & . \\ . & . & . & . & . & 0 & 0 \\ . & . & . & . & . & h(0) & 0 \\ h(K-1) & . & . & . & h(2) & h(1) & h(0) \end{bmatrix},$$

where {h(i)} is the impulse response sequence of the filter H(z), and n is the time index for the input signal vector. Then, the energy of the quantization error vector corresponding to $y_j$ is $$d_j(n)=\|q(n)\|^2=\|qzi(n)-g(n)H(n)y_j\|^2.$$

The closed-loop codebook optimization starts with an initial codebook, which can be populated with Gaussian random numbers, or designed using open-loop training procedures. The initial codebook is used in a fully quantized TSNFC codec according to the current invention to encode a large training data file containing typical kinds of audio signals the codec is expected to encounter in the real world. While performing the encoding operation, the best codevector from the codebook is identified for each input signal vector. Let $N_j$ be the set of time indices n when $y_j$ is chosen as the best codevector that minimizes the energy of the quantization error vector. Then, the total quantization error energy for all residual vectors quantized into $y_j$ is given by $$D_j = \sum_{n \in N_j} d_j(n) = \sum_{n \in N_j} [qzi(n) - g(n)H(n)y_j]^T [qzi(n) - g(n)H(n)y_j].$$

To update the j-th codevector $y_j$ in order to minimize $D_j$, we take the gradient of $D_j$ with respect to $y_j$, and setting the result to zero. This gives us $$\nabla_{y_j} D_j = \sum_{n \in N_j} 2[-g(n)H^T(n)][qzi(n) - g(n)H(n)y_j] = 0.$$

This can be re-written as $$\left[\sum_{n \in N_j} g^2(n)H^T(n)H(n)\right] y_j = \left[\sum_{n \in N_j} g(n)H^T(n)qzi(n)\right].$$

Let A, be the K×K matrix inside the square brackets on the left-hand-side of the equation, and let $b_j$ be the K×1 vector inside the square brackets on the right-hand-side of the equation. Then, solving the equation $A_j y_j = b_j$ for $y_j$ gives the updated version of the j-th codevector. This is the so-called "centroid condition" for the closed-loop quantizer codebook design. Solving $A_j y_j = b_j$ for j=0, 1, 2, . . . , N−1 updates the entire codebook. The updated codebook is used in the next iteration of the training procedure. The entire training database file is encoded again using the updated codebook. The resulting $A_j$ and $b_j$ are calculated, and a new set of codevectors are obtained again by solving the new sets of linear equations $A_j y_j = b_j$ for j=0, 1, 2, . . . , N−1. Such iterations are repeated until no significant reduction in quantization distortion is observed.

This closed-loop codebook training is not guaranteed to converge. However, in reality, starting with an open-loop-designed codebook or a Gaussian random number codebook, this closed-loop training always achieve very significant distortion reduction in the first several iterations. When this method was applied to optimize the 4-dimensional VQ codebooks used in the preferred embodiment of 16 kb/s narrowband codec and the 32 kb/s wideband codec, it provided as much as 1 to 1.8 dB gain in the signal-to-noise ratio (SNR) of the codec, when compared with open-loop optimized codebooks. There was a corresponding audible improvement in the perceptual quality of the codec outputs.

Figure 18:
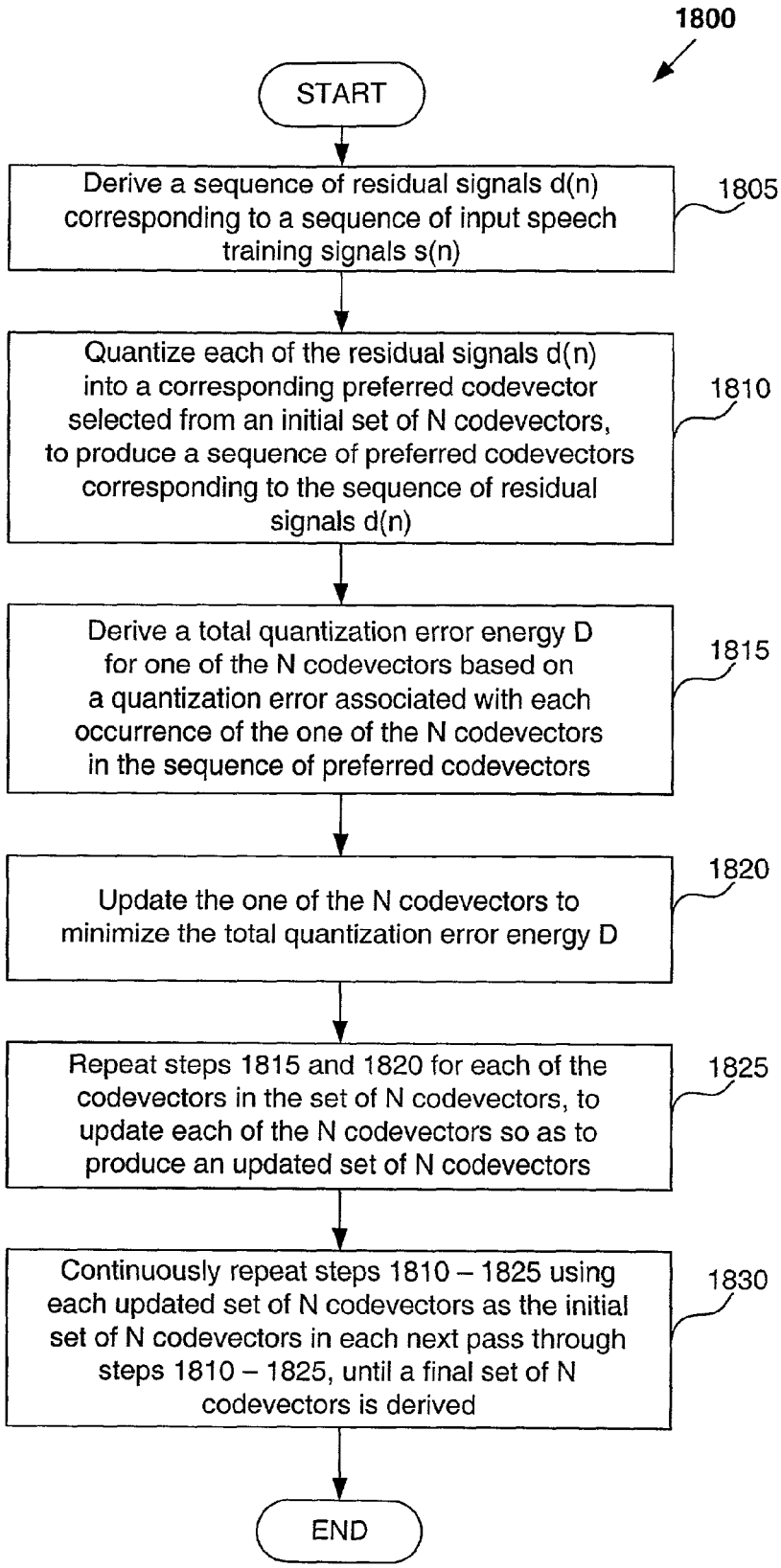
FIG. 18 is a flowchart of an example high-level method of performing a Closed-Loop Residual Codebook Optimization, according to the present invention.

FIG. 18 is a flowchart of a high-level example method 1800 of Closed-Loop Residual Codebook Optimization according to the present invention.

In a first step 1805, a sequence of residual signals d(n) is derived corresponding to a sequence of input speech training signals s(n).

At a next step 1810, a preferred codevector is selected from an initial set of N codevectors for, and based on, each of the residual signals d(n), to produce a sequence of preferred codevectors corresponding to the sequence of residual signals d(n).

At a next step 1815, a total quantization error energy $D_j$ is derived for a corresponding one of the N codevectors (for example, codevector $y_j$) based on a quantization error associated with each occurrence of the one of the N codevectors (for example, codevector $y_j$) in the sequence of preferred codevectors.

At a next step 1820, the one of the N codevectors (for example, codevector $y_j$) is updated to minimize the total quantization error energy $D_j$.

At a next step 1825, steps 1815 and 1820 are repeated for each of the codevectors in the set of N codevectors, to update each of the N codevectors so as to produce an updated set of N codevectors.

At a next step 1830, steps 1810–1825 are continuously repeated using each updated set of N codevectors as the initial set of N codevectors in each next pass through steps 1810–1825 until a final set of N codevectors is derived.

XI. Decoder Operations

The decoder in FIG. 8 is very similar to the decoder of other predictive codecs such as CELP and MPLPC. The operations of the decoder are well-known prior art.

Refer to FIG. 8. The bit de-multiplexer block 100 unpacks the input bit stream into the five sets of indices LSPI, PPI, PPTI, GI, and CI. The long-term predictive parameter decoder block 110 decodes the pitch period as pp=17+PPI. It also uses PPTI as the address to retrieve the corresponding codevector from the 9-dimensional pitch tap codebook and multiplies the first three elements of the codevector by 0.5 to get the three pitch predictor coefficients $\{b_{j*1}, b_{j*2}, b_{j*3}\}$. The decoded pitch period and pitch predictor taps are passed to the long-term predictor block 140.

The short-term predictive parameter decoder block 120 decodes LSPI to get the quantized version of the vector of LSP inter-frame MA prediction residual. Then, it performs the same operations as in the right half of the structure in FIG. 10 to reconstruct the quantized LSP vector, as is well known in the art. Next, it performs the same operations as in blocks 17 and 18 to get the set of short-term predictor coefficients $\{\tilde{a}_i\}$, which is passed to the short-term predictor block 160.

The prediction residual quantizer decoder block 130 decodes the gain index GI to get the quantized version of the log-gain prediction residual. Then, it performs the same operations as in blocks 304, 307, 308, and 309 of FIG. 12 to get the quantized residual gain in the linear domain. Next, block 130 uses the codebook index CI to retrieve the residual quantizer output level if a scalar quantizer is used, or the winning residual VQ codevector is a vector quantizer is used, then it scales the result by the quantized residual gain. The result of such scaling is the signal uq(n) in FIG. 8.

The long-term predictor block 140 and the adder 150 together perform the long-term synthesis filtering to get the quantized version of the short-term prediction residual dq(n) as follows.

$$dq(n) = uq(n) + \sum_{i=1}^{3} b_{j*i} dq(n - pp + 2 - i)$$

The short-term predictor block 160 and the adder 170 then perform the short-term synthesis filtering to get the decoded output speech signal sq(n) as $$sq(n) = dq(n) + \sum_{i=1}^{M} \bar{a}_i sq(n-i).$$

This completes the description of the decoder operations.

XII. Hardware and Software Implementations

Figure 19:
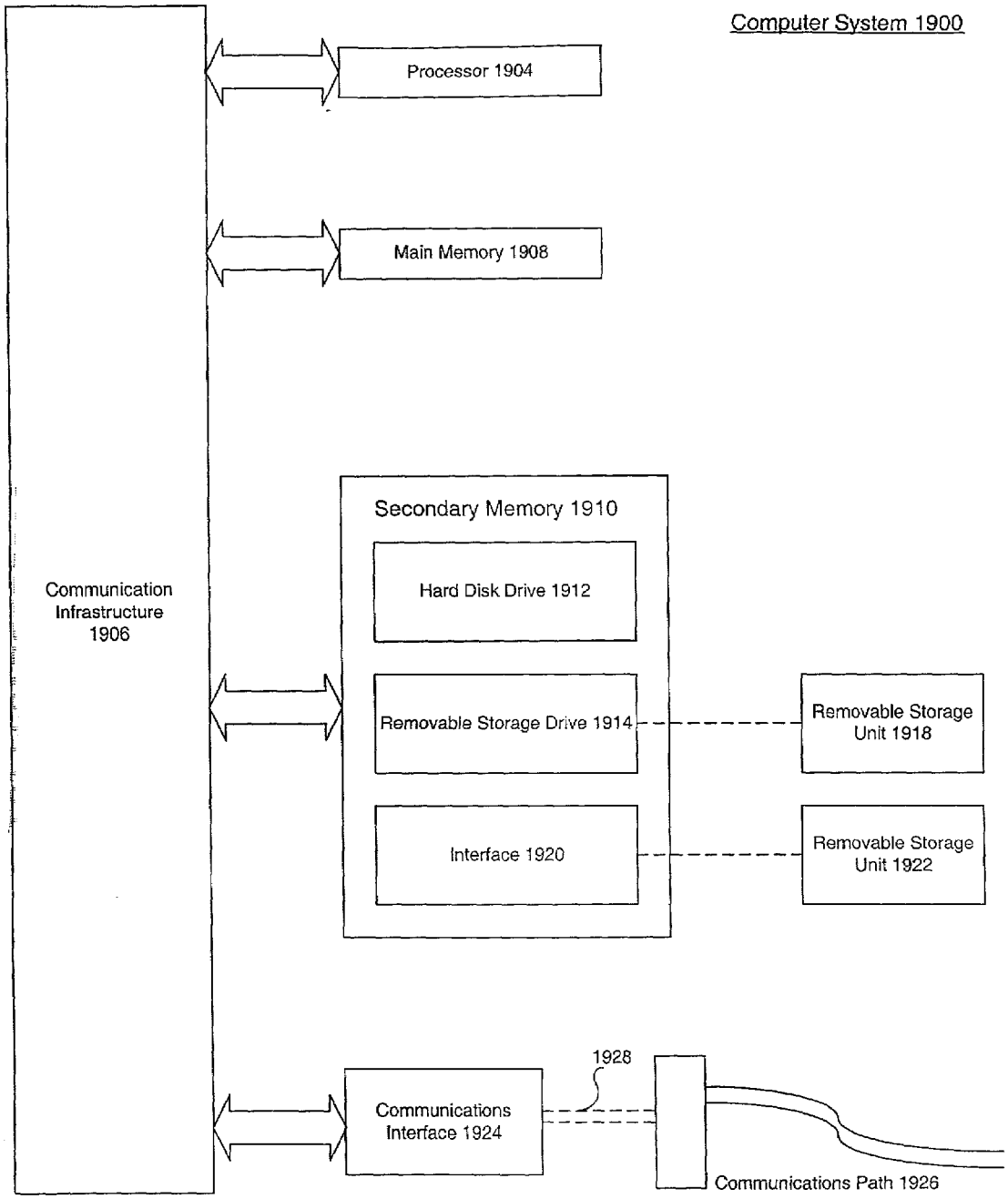
FIG. 19 is a block diagram of a computer system on which the present invention can be implemented.

The following description of a general purpose computer system is provided for completeness. The present invention can be implemented in hardware, or as a combination of software and hardware. Consequently, the invention may be implemented in the environment of a computer system or other processing system. An example of such a computer system 1900 is shown in FIG. 19. In the present invention, all of the signal processing blocks of codecs 1050, 2050, and 3000–7000, for example, can execute on one or more distinct computer systems 1900, to implement the various methods of the present invention. The computer system 1900 includes one or more processors, such as processor 1904. Processor 1904 can be a special purpose or a general purpose digital signal processor. The processor 1904 is connected to a communication infrastructure 1906 (for example, a bus or network). Various software implementations are described in terms of this exemplary computer system. After reading this description, it will become apparent to a person skilled in the relevant art how to implement the invention using other computer systems and/or computer architectures.

Computer system 1900 also includes a main memory 1908, preferably random access memory (RAM), and may also include a secondary memory 1910. The secondary memory 1910 may include, for example, a hard disk drive 1912 and/or a removable storage drive 1914, representing a floppy disk drive, a magnetic tape drive, an optical disk drive, etc. The removable storage drive 1914 reads from and/or writes to a removable storage unit 1918 in a well known manner. Removable storage unit 1918, represents a floppy disk, magnetic tape, optical disk, etc. which is read by and written to by removable storage drive 1914. As will be appreciated, the removable storage unit 1918 includes a computer usable storage medium having stored therein computer software and/or data.

In alternative implementations, secondary memory 1910 may include other similar means for allowing computer programs or other instructions to be loaded into computer system 1900. Such means may include, for example, a removable storage unit 1922 and an interface 1920. Examples of such means may include a program cartridge and cartridge interface (such as that found in video game devices), a removable memory chip (such as an EPROM, or PROM) and associated socket, and other removable storage units 1922 and interfaces 1920 which allow software and data to be transferred from the removable storage unit 1922 to computer system 1900.

Computer system 1900 may also include a communications interface 1924. Communications interface 1924 allows software and data to be transferred between computer system 1900 and external devices. Examples of communications interface 1924 may include a modem, a network interface (such as an Ethernet card), a communications port, a PCMCIA slot and card, etc. Software and data transferred via communications interface 1924 are in the form of signals 1928 which may be electronic, electromagnetic, optical or other signals capable of being received by communications interface 1924. These signals 1928 are provided to communications interface 1924 via a communications path 1926. Communications path 1926 carries signals 1928 and may be implemented using wire or cable, fiber optics, a phone line, a cellular phone link, an RF link and other communications channels.

In this document, the terms "computer program medium" and "computer usable medium" are used to generally refer to media such as removable storage drive 1914, a hard disk installed in hard disk drive 1912, and signals 1928. These computer program products are means for providing software to computer system 1900.

Computer programs (also called computer control logic) are stored in main memory 1908 and/or secondary memory 1910. Computer programs may also be received via communications interface 1924. Such computer programs, when executed, enable the computer system 1900 to implement the present invention as discussed herein. In particular, the computer programs, when executed, enable the processor 1904 to implement the processes of the present invention, such as the methods implemented using the various codec structures described above, such as methods 6050, 1350, 1364, 1430, 1450, 1470, 1520, 1620, 1700 and 1800, for example. Accordingly, such computer programs represent controllers of the computer system 1900. By way of example, in the embodiments of the invention, the processes performed by the signal processing blocks of codecs 1050, 2050, and 3000–7000 can be performed by computer control logic. Where the invention is implemented using software, the software may be stored in a computer program product and loaded into computer system 1900 using removable storage drive 1914, hard drive 1912 or communications interface 1924.

In another embodiment, features of the invention are implemented primarily in hardware using, for example, hardware components such as Application Specific Integrated Circuits (ASICs) and gate arrays. Implementation of a hardware state machine so as to perform the functions described herein will also be apparent to persons skilled in the relevant art(s).

XIII. Conclusion

While various embodiments of the present invention have been described above, it should be understood that they have been presented by way of example, and not limitation. It will be apparent to persons skilled in the relevant art that various changes in form and detail can be made therein without departing from the spirit and scope of the invention.

The present invention has been described above with the aid of functional building blocks and method steps illustrating the performance of specified functions and relationships thereof. The boundaries of these functional building blocks and method steps have been arbitrarily defined herein for the convenience of the description. Alternate boundaries can be defined so long as the specified functions and relationships thereof are appropriately performed. Any such alternate boundaries are thus within the scope and spirit of the claimed invention. One skilled in the art will recognize that these functional building blocks can be implemented by discrete components, application specific integrated circuits, processors executing appropriate software and the like or any combination thereof. Thus, the breadth and scope of the present invention should not be limited by any of the above-described exemplary embodiments, but should be defined only in accordance with the following claims and their equivalents.

What is claimed is:

1. In a Noise Feedback Coding (NFC) system, a method of efficiently searching N predetermined Vector Quantization (VQ) codevectors for a preferred one of the N VQ codevectors to be used in coding a speech or audio signal, comprising the steps of:

(a) predicting the speech signal to derive a residual signal;

(b) deriving a ZERO-INPUT response error vector common to each of the N VQ codevectors, wherein the ZERO-INPUT response error vector is a component of a quantization error vector;

(c) deriving N ZERO-STATE response error vectors each based on a corresponding one of the N VQ codevectors, wherein each of the N ZERO-STATE response error vectors is a component of a quantization error vector; and (d) selecting the preferred one of the N VQ codevectors as the VQ output vector corresponding to the residual signal based on the ZERO-INPUT response error vector and the N ZERO-STATE response error vectors.

2. The method of claim 1, further comprising the step of:

separately combining the ZERO-INPUT response error vector with each one of the N ZERO-STATE response error vectors to produce an error energy value corresponding to each one of the N VQ codevectors, wherein step (d) comprises selecting one of the N VQ codevectors corresponding to a minimum error energy value as the preferred one of the N VQ codevectors.

3. The method of claim 1, wherein step (b) comprises the steps of:

(b)(i) deriving an intermediate vector based on the residual signal;

(b)(ii) predicting the intermediate vector to produce a predicted intermediate vector;

(b)(iii) combining the intermediate vector with the predicted intermediate vector and a noise feedback vector to produce the ZERO-INPUT response error vector; and (b)(iv) filtering the ZERO-INPUT response error vector to produce the noise feedback vector.

4. The method of claim 3, wherein:

step (b)(ii) comprises long-term predicting the intermediate vector to produce the predicted intermediate vector; and step (b)(iv) comprises long-term filtering the ZERO-INPUT response error vector to produce the noise feedback vector.

5. The method of claim 3, wherein:

step (b)(ii) comprises predicting the intermediate vector based on an initial predictor state corresponding to a previous preferred codevector; and step (b)(iv) comprises filtering the ZERO-INPUT response error vector based on an initial filter state corresponding to the previous preferred codevector.

6. The method of claim 1, wherein step (b) comprises the steps of:

(b)(i) combining the residual signal with a noise feedback signal to produce an intermediate vector;

(b)(ii) predicting the intermediate vector to produce a predicted intermediate vector;

(b)(iii) combining the intermediate vector with the predicted intermediate vector to produce an error vector; and (b)(iv) filtering the error vector to produce the noise feedback signal.

7. The method of claim 6, wherein:

step (b)(ii) comprises long-term predicting the intermediate vector to produce the predicted intermediate vector; and step (b)(iv) comprises short-term filtering the error vector to produce the noise feedback signal.

8. The method of claim 6, wherein:

step (b)(ii) comprises predicting the intermediate vector based on an initial predictor state corresponding to a previous preferred codevector; and step (b)(iv) comprises filtering the error vector based on an initial filter state corresponding to the previous preferred codevector.

9. The method of claim 1, wherein step (c) comprises the steps of:

(c)(i) separately filtering an error vector associated with each of the N VQ codevectors to produce a ZERO-STATE input vector corresponding to each of the N VQ codevectors; and (c)(ii) separately combining each ZERO-STATE input vector from step (c)(i) with the corresponding one of the N VQ codevectors, to produce the N ZERO-STATE response error vectors.

10. The method of claim 9, wherein the filtering in step (c)(i) comprises short-term filtering of the error vector.

11. The method of claim 9, wherein the filtering in step (c)(i) is based on an initially zeroed filter state, and wherein step (c) further comprises the step of:

(c)(iii) zeroing the filter state to produce the initially zeroed filter state before each pass through step (c)(i).

12. The method of claim 1, wherein step (c) comprises the steps of:

(c)(i) separately combining each of the N VQ codevectors with a corresponding one of N filtered, ZERO-STATE response error vectors to produce the N ZERO-STATE response error vectors; and (c)(ii) separately filtering each of the N ZERO-STATE response error vectors to produce the N filtered, ZERO-STATE response error vectors.

13. The method of claim 12, wherein the filtering in step (c)(ii) comprises short-term filtering.

14. The method of claim 12, wherein the filtering in step (c)(ii) is based on an initially zeroed filter state, and wherein step (c) further comprises the step of:

(c)(iii) zeroing the filter state to produce the initially zeroed filter state before each pass through step (c)(ii).

15. The method of claim 12, further comprising the steps of:

deriving a gain value based on the speech signal; and scaling at least some of the N VQ codevectors based on the gain value.

16. The method of claim 12, further comprising the steps of:

deriving a set of filter parameters based on the speech signal; and filtering the N VQ codevectors in step (c)(ii) based on the set of filter parameters.

17. The method of claim 12, wherein the speech signal comprises a sequence of speech vectors each including a plurality of speech samples, the method further comprising the steps of:

deriving a set of filter parameters based on the speech signal once every T speech vectors, where T is greater than one; and performing step (c) only when a set of filter parameters is derived the once every T speech vectors, whereby a same set of N ZERO-STATE response error vectors is used in selecting each of T preferred codevectors in step (d) corresponding to the T speech vectors.

18. The method of claim 1, wherein the speech signal comprises a sequence of speech vectors each including a plurality of speech samples, the method further comprising the step of:

performing step (c) once every T speech vectors, where T is greater than one, whereby a same set of N ZERO-STATE response error vectors is used in selecting T preferred codevectors in step (d) corresponding to the T speech vectors.

19. The method of claim 1, wherein the speech signal comprises a sequence of speech vectors each including a plurality of speech samples, the method further comprising the steps of:

deriving a gain value based on the speech signal once every M speech vectors, where M is greater than one;

scaling the N VQ codevectors the once every M speech vectors based on the gain value; and deriving the N ZERO-STATE response error vectors in step (c) only when the gain value is derived the once every M speech vectors, whereby a same set of N ZERO-STATE response error vectors is used in selecting each of M preferred codevectors in step (d) corresponding to the M speech vectors.

20. A Noise Feedback Coding (NEC) system for fast searching N Vector Quantization (VQ) codevectors stored in a VQ codebook for a preferred one of the N VQ codevectors to be used for coding a speech or audio signal, comprising:

predicting logic adapted to predict the speech signal to derive a residual signal;

a ZERO-INPUT filter structure adapted to derive a ZERO-INPUT response error vector common to each of the N VQ codevectors in the VQ codebook, wherein the ZERO-INPUT response error vector is a component of a quantization error vector;

a ZERO-STATE filter structure adapted to derive N ZERO-STATE response error vectors each based on a corresponding one of the N VQ codevectors in the VQ codebook, wherein each of the N ZERO-STATE response error vectors is a component of a quantization error vector; and a selector adapted to select the preferred one of the N VQ codevectors as a VQ output vector corresponding to the residual signal based on the ZERO-INPUT response error vector and the N ZERO-STATE response error vectors.

21. The system of claim 20, further comprising:

a combiner adapted to separately combine the ZERO-INPUT response error vector with each one of the N ZERO-STATE response error vectors to produce an error energy value corresponding to each of the N VQ codevectors, the selector being adapted to select one of the N VQ codevectors corresponding to a minimum error energy value as the preferred one of the VQ codevectors.

22. The system of claim 20, wherein the ZERO-INPUT filter structure comprises:

an intermediate vector deriver adapted to derive an intermediate vector based on the residual signal;

a predictor adapted to predict the intermediate vector to produce a predicted intermediate vector;

combining logic adapted to combine the intermediate vector with the predicted intermediate vector and a noise feedback vector to produce the ZERO-INPUT response error vector; and a filter adapted to filter the ZERO-INPUT response error vector to produce the noise feedback vector.

23. The system of claim 22, wherein:

the predictor is adapted to long-term predict the intermediate vector; and the filter is adapted to long-term filter the ZERO-INPUT response error vector.

24. The system of claim 22, wherein:

the predictor is adapted to predict based on an initial predictor state corresponding to a previous preferred codevector; and the filter is adapted to filter based on an initial filter state corresponding to the previous preferred codevector.

25. The system of claim 20, wherein the ZERO-INPUT filter structure comprises:

a first combiner adapted to combine the residual signal with a noise feedback signal to produce an intermediate vector;

a predictor adapted to predict the intermediate vector to produce a predicted intermediate vector;

a second combiner adapted to combine the intermediate vector with the predicted intermediate vector to produce an error vector; and a filter adapted to filter the error vector to produce the noise feedback signal.

26. The system of claim 25, wherein:

the predictor is adapted to long-term predict the intermediate vector to produce the predicted intermediate vector; and the filter is adapted to short-term filter the error vector to produce the noise feedback signal.

27. The system of claim 25, wherein the predictor is adapted to predict based on an initial predictor state corresponding to a previous preferred codevector, and the filter is adapted to filter based on an initial filter state corresponding to the previous preferred codevector.

28. The system of claim 20, wherein the ZERO-STATE filter structure comprises:

a filter adapted to separately filter an error vector associated with each of the N VQ codevectors to produce a ZERO-STATE input vector corresponding to each of the N VQ codevectors; and a combiner adapted to separately combine each ZERO-STATE input vector produced by the filter with the corresponding one of the N VQ codevectors, to produce the N ZERO-STATE response error vectors.

29. The system of claim 28, wherein the filter is adapted to short-term filter the error vector.

30. The system of claim 28, further comprising filter zeroing logic adapted to zero the filter state to produce an initially zeroed filter state before the filter filters each of the N error vectors.

31. The system of claim 20, wherein the ZERO-STATE filter structure comprises:

a combiner adapted to separately combine each of the N VQ codevectors with a corresponding one of N filtered, ZERO-STATE response error vectors to produce the N ZERO-STATE response error vectors; and a filter adapted to separately filter each of the N ZERO-STATE response error vectors to produce the N filtered, ZERO-STATE response error vectors.

32. The system of claim 31, wherein the filter is adapted to short-term filter each of the N ZERO-STATE response error vectors.

33. The system of claim 31, further comprising filter zeroing logic adapted to zero the filter state to produce an initially zeroed filter state before the filter filters each of the N ZERO-STATE response error vectors.

34. The system of claim 31, further comprising:

gain deriving logic adapted to derive a gain value based on the speech signal; and a gain scaling unit adapted to scale at least some of the N VQ codevectors based on the gain value.

35. The system of claim 31, further comprising:

filter parameter deriving logic adapted to derive a set of filter parameters based on the speech signal; and a filter adapted to filter the N VQ codevectors based on the set of filter parameters.

36. The system of claim 31, wherein:

the speech signal comprises a sequence of speech vectors each including a plurality of speech samples;

the filter parameter deriving logic is adapted to update the set of filter parameters based on the speech signal once every T speech vectors, where T is greater than one; and the ZERO-STATE filter structure is adapted to derive the N ZERO-STATE response error vectors only when the set of filter parameters is updated the once every T speech vectors.

37. The system of claim 20, wherein the speech signal comprises a sequence of speech vectors each including a plurality of speech samples, the ZERO-STATE filter structure being adapted to derive the N ZERO-STATE response error vectors once every T speech vectors, whereby a same set of N ZERO-STATE response error vectors is used in selecting T preferred codevectors corresponding to the T speech vectors.

38. The system of claim 20, wherein the speech signal comprises a sequence of speech vectors each including a plurality of speech samples, the system further comprising:

gain deriving logic adapted to derive a gain value based on the speech signal once every M speech vectors, where M is greater than one; and a gain scaling unit adapted to scale the N VQ codevectors once every M speech vectors based on the gain value, wherein the ZERO-STATE filter structure is adapted to derive the N ZERO-STATE response error vectors once every M speech vectors, whereby a same set of N ZERO-STATE response error vectors is used in selecting M preferred codevectors corresponding to the M speech vectors.

* * * * *